US008500515B2

(12) United States Patent
Duescher

(10) Patent No.: US 8,500,515 B2
(45) Date of Patent: Aug. 6, 2013

(54) FIXED-SPINDLE AND FLOATING-PLATEN ABRASIVE SYSTEM USING SPHERICAL MOUNTS

(76) Inventor: Wayne O. Duescher, Roseville, MN (US)

( * ) Notice: Subject to any disclaimer, the term of this patent is extended or adjusted under 35 U.S.C. 154(b) by 575 days.

(21) Appl. No.: 12/807,802

(22) Filed: Sep. 14, 2010

(65) Prior Publication Data

US 2011/0223838 A1 Sep. 15, 2011

Related U.S. Application Data

(63) Continuation-in-part of application No. 12/799,841, filed on May 3, 2010, which is a continuation-in-part of application No. 12/661,212, filed on Mar. 12, 2010.

(51) Int. Cl.
*B24B 7/22* (2006.01)
*B24B 53/00* (2006.01)

(52) U.S. Cl.
USPC ..... 451/11; 451/5; 451/288

(58) Field of Classification Search
USPC ..... 451/5, 11, 28, 36, 37, 41, 59, 64, 451/259, 260, 270, 271, 280, 283, 285, 288, 451/287, 443, 444, 56
See application file for complete search history.

(56) References Cited

U.S. PATENT DOCUMENTS

| | | | |
|---|---|---|---|
| 1,989,074 | A | 1/1935 | Bullard |
| 2,410,752 | A | 11/1946 | Sells et al. |
| 2,696,067 | A | 12/1954 | Leach |
| 2,973,605 | A | 3/1961 | Carman et al. |
| 2,979,868 | A | 4/1961 | Emeis |
| 3,342,652 | A | 9/1967 | Reisman et al. |
| 3,475,867 | A | 11/1969 | Walsh |
| 3,662,498 | A | 5/1972 | Caspers |
| 4,104,099 | A | 8/1978 | Scherrer |
| 4,165,584 | A | 8/1979 | Scherrer |
| 4,256,535 | A | 3/1981 | Banks |
| 4,315,383 | A | 2/1982 | Day |
| 4,588,473 | A | 5/1986 | Hisatomi et al. |
| 4,593,495 | A | 6/1986 | Kawakami et al. |
| 4,720,938 | A | 1/1988 | Gosis |
| 4,735,679 | A | 4/1988 | Lasky |
| 4,910,155 | A | 3/1990 | Cote et al. |
| 4,918,870 | A | 4/1990 | Torbert et al. |

(Continued)

OTHER PUBLICATIONS

International Search Report from related International Application No. PCT/US2011/028088 (13 sheets).

*Primary Examiner* — Robert Rose
(74) *Attorney, Agent, or Firm* — Mark A. Litman & Associates, P.A.

(57) ABSTRACT

A method and apparatus for releasably attaching flexible abrasive disks to a flat-surfaced platen that floats in three-point abrading contact with three flat-surfaced rotatable fixed-position workpiece spindles that are mounted on spherical-rotation two-piece spindle-mount devices that are attached to a nominally-flat abrading machine base. The spindle-top flat surfaces are precisely co-planar with each other. The three spindles are positioned to form a triangle of platen supports where the rotational-centers of each of the spindles are positioned at the center of the annular width of the platen abrading-surface. Flat surfaced workpieces are attached to the spindles and the rotating floating-platen abrasive surface contacts the workpieces to perform single-sided abrading on them. The disk abrasive surfaces can be re-flattened by attaching abrasive disk-type components to the three spindles that are rotated while in abrading contact with the rotating abrasive disk. There is no wear of the abrasive-disk protected platen surface.

20 Claims, 25 Drawing Sheets

U.S. PATENT DOCUMENTS 5,014,468 A 5/1991 Ravipati et al.
5,032,544 A 7/1991 Ito et al.
5,137,542 A 8/1992 Buchanan et al.
5,191,738 A 3/1993 Nakazato et al.
5,205,082 A 4/1993 Shendon et al.
5,274,960 A 1/1994 Karlsrud
5,314,513 A 5/1994 Miller et al.
5,364,655 A 11/1994 Nakamura et al.
5,422,316 A 6/1995 Desai et al.
5,454,844 A 10/1995 Hibbard et al.
5,456,627 A 10/1995 Jackson et al.
5,538,460 A 7/1996 Onodera
5,569,062 A 10/1996 Karlsrud
5,643,067 A 7/1997 Katsuoka et al.
5,769,697 A 6/1998 Nishio
5,800,254 A 9/1998 Motley et al.
5,833,519 A 11/1998 Moore
5,840,629 A 11/1998 Carpio
5,857,898 A 1/1999 Hiyama et al.
5,860,847 A 1/1999 Sakurai et al.
5,863,306 A 1/1999 Wei et al.
5,882,245 A 3/1999 Popovich et al.
5,910,041 A 6/1999 Duescher
5,916,009 A 6/1999 Izumi et al.
5,938,506 A 8/1999 Fruitman et al.
5,964,651 A 10/1999 Hose
5,967,882 A 10/1999 Duescher
5,972,792 A 10/1999 Hudson
5,975,997 A 11/1999 Minami
5,981,454 A 11/1999 Small
5,989,104 A 11/1999 Kim et al.
5,993,298 A 11/1999 Duescher
6,001,008 A 12/1999 Fujimori et al.
6,007,407 A 12/1999 Rutherford et al.
6,022,266 A 2/2000 Bullard et al.
6,048,254 A 4/2000 Duescher
6,077,153 A 6/2000 Fujita et al.
6,089,959 A 7/2000 Nagahashi
6,102,777 A 8/2000 Duescher et al.
6,120,352 A 9/2000 Duescher
6,139,428 A 10/2000 Drill et al.
6,149,506 A 11/2000 Duescher
6,165,056 A 12/2000 Hayashi et al.
6,168,506 B1 1/2001 McJunken
6,217,433 B1 4/2001 Herrman et al.
6,273,786 B1 8/2001 Chopra et al.
6,371,838 B1 4/2002 Holzapfel
6,398,906 B1 6/2002 Kobayashi et al.
6,425,809 B1 7/2002 Ichimura
6,439,965 B1 8/2002 Ichino et al.
6,506,105 B1 1/2003 Kajiwara et al.
6,520,833 B1 2/2003 Saldana et al.
6,607,157 B1 8/2003 Duescher
6,632,127 B1 10/2003 Zimmer et al.
6,652,764 B1 11/2003 Blalock
6,702,866 B2 3/2004 Kamboj
6,752,700 B2 6/2004 Duescher
6,769,969 B1 8/2004 Duescher
6,786,810 B2 9/2004 Muilenburg et al.
6,893,332 B2 5/2005 Castor
6,896,584 B2 5/2005 Perlov et al.
6,899,603 B2 5/2005 Homma et al.
6,935,013 B1 8/2005 Markevitch et al.
7,001,251 B2 2/2006 Doan et al.
7,008,303 B2 3/2006 White et al.
7,014,535 B2 3/2006 Custer et al.
7,029,380 B2 4/2006 Horiguchi et al.
7,033,251 B2 4/2006 Elledge
7,044,838 B2 5/2006 Maloney et al.
7,125,313 B2 10/2006 Zelenski et al.
7,144,304 B2 12/2006 Moore
7,147,541 B2 12/2006 Nagayama et al.
7,166,016 B1 1/2007 Chen
7,214,125 B2 5/2007 Sharples et al.
7,250,368 B2 7/2007 Kida et al.
7,276,446 B2 10/2007 Robinson et al.
7,357,699 B2 4/2008 Togawa et al.
7,364,495 B2 4/2008 Tominaga et al.
7,367,867 B2 5/2008 Boller
7,393,790 B2 7/2008 Britt et al.
7,422,634 B2 9/2008 Powell et al.
7,446,018 B2 11/2008 Brogan et al.
7,449,124 B2 11/2008 Webb et al.
7,456,106 B2 11/2008 Koyata et al.
7,470,169 B2 12/2008 Taniguchi et al.
7,491,342 B2 2/2009 Kamiyama et al.
7,507,148 B2 3/2009 Kitahashi et al.
7,520,800 B2 4/2009 Duescher
7,527,722 B2 5/2009 Sharan
7,582,221 B2 9/2009 Netsu et al.
7,585,425 B2 9/2009 Ward
7,588,674 B2 9/2009 Frodis et al.
7,614,939 B2 11/2009 Tolles et al.
7,632,434 B2 12/2009 Duescher
7,635,291 B2 12/2009 Muldowney
7,648,409 B1 1/2010 Horiguchi et al.
2005/0118939 A1 6/2005 Duescher
2008/0182413 A1 7/2008 Menk et al.
2008/0299875 A1 12/2008 Duescher
2010/0003904 A1 1/2010 Duescher

*Fig. 41*
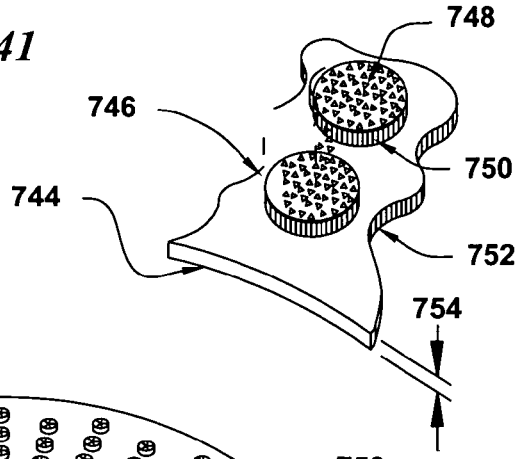
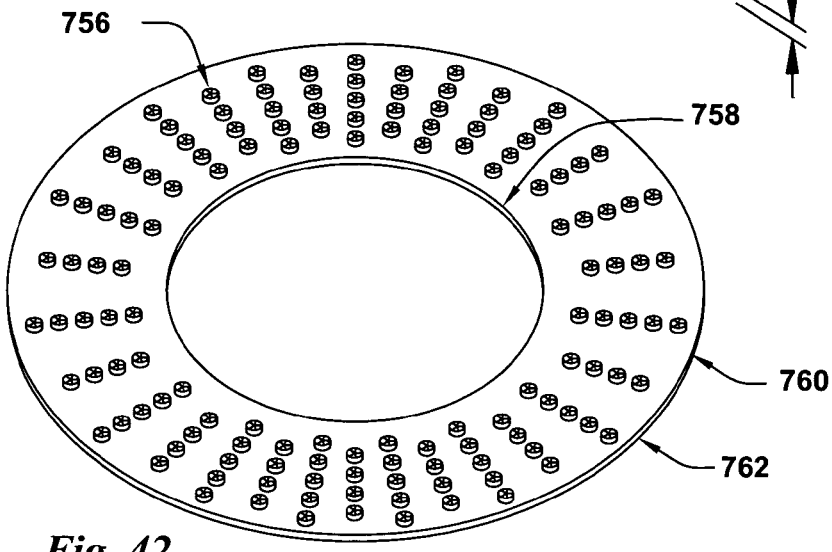
*Fig. 42*
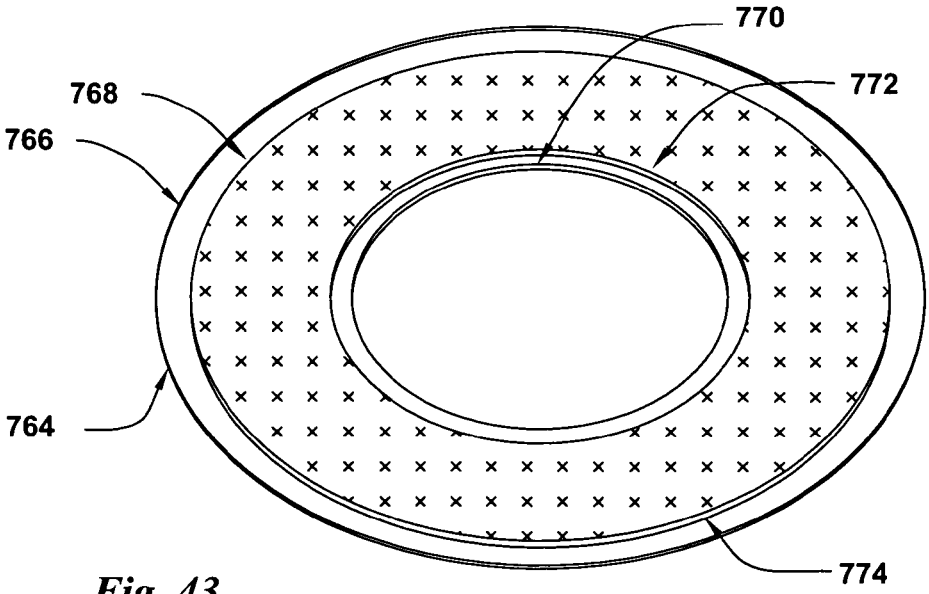
*Fig. 43*

FIXED-SPINDLE AND FLOATING-PLATEN ABRASIVE SYSTEM USING SPHERICAL MOUNTS

CROSS REFERENCE TO RELATED APPLICATION

This invention is a continuation-in-part of the U.S. patent application Ser. No. 12/799,841 filed May 3, 2010 that is a continuation-in-part of the U.S. patent application Ser. No. 12/661,212 filed Mar. 12, 2010.

BACKGROUND OF THE INVENTION

Field of the Invention

The present invention relates to the field of abrasive treatment of surfaces such as grinding, polishing and lapping. In particular, the present invention relates to a high speed lapping system that provides simplicity, quality and efficiency to existing lapping technology using a rotary abrasive floating platen that is supported by multiple fixed-position rotary workpiece spindles that have two-piece spherical-rotation spindle-mounting devices.

Fixed-Spindle-Floating-Platen System

The present invention relates to methods and devices for a single-sided lapping machine that is capable of flat-lapping ultra-thin semiconductor wafer workpieces at high abrading speeds. This is done by providing a nominally-flat granite machine base that is used as the stable support for three rigid flat-surfaced rotatable equal-height workpiece spindles that are attached to the machine base. Each of the three near-equal-spaced rotary spindles form a stable three-point support of the rotary platen. The spindles have flat-surfaced rotary spindle-tops that are aligned to be precisely co-planar with each other. The co-planar flat surfaces of the spindle-tops are precisely co-planar with the precision-flat platen abrading-surface of a rotary platen when the platen conformably contacts the spindle-tops. Precision-thickness flexible abrasive disks having annular bands of abrasives are attached to the rigid precision-flat abrading-surface of the rotary platens that float in three-point abrading contact with the three equal-spaced flat-surfaced rotatable workpiece spindles. Water coolant is used with abrasive disks having abrasive coated raised island abrasive.

Presently, floating abrasive platens are used in double-sided lapping and double-sided micro-grinding (flat-honing) but the abrading speeds of both of these systems are very low. The upper floating platens used with these systems are positioned in conformal contact with multiple equal-thickness workpieces that are in flat contact with the flat abrading surface of a lower platen. Both the upper and lower abrasive coated platens are typically concentric with each other and they are rotated independent of each other. Often the platens are rotated in opposite directions to minimize the net abrading forces that are applied to the workpieces that are sandwiched between the flat surfaces of the two platens.

In order to compensate for the different abrading speeds that exist at the inner and outer radii of the annular band of abrasive that is on the rotating platens, the workpieces are rotated. The speed of the rotated workpiece reduces the too-fast platen speed at the outer periphery of the platen and increases the too-slow speed at the inner periphery when the platen and the workpiece are both rotated in the same direction. However, if the upper abrasive platen and the lower abrasive platen are rotated in opposite directions, then rotation of the workpieces is favorable to the platen that is rotated in the same direction as the workpiece and unfavorable for the other platen. Here, the speed differential of the rotated workpiece acts against the other platen that is rotated in a direction that is reversed from the workpiece rotation.

Rotation of the workpieces is done with thin gear driven planetary workholder disks that carry the individual workpieces while they are sandwiched between the two platens. Workpieces comprising semiconductor wafers are very thin so the planetary workholders must be even thinner to allow unimpeded abrading contact with both surfaces of the workpieces. The gear teeth on these thin workholder disks that are used to rotate the disks are very fragile, which prevents fast rotation of the workpieces. The resultant slow-rotation workpieces prevent fast abrading speeds of the abrasive platens. Also, because the workholder disks are fragile, the upper and lower platens are often rotated in opposite directions to minimize the net abrading forces on individual workpieces because a portion of this net abrasive force is applied to the fragile disk-type workholders. It is not practical to abrade very thin workpieces with double-sided platen abrasive systems because the required planetary workholder disks are so fragile.

Multiple workpieces are often slurry lapped using flat-surfaced single-sided platens that are coated with a layer of loose abrasive particles that are in a liquid mixture. Slurry lapping is very slow, and also, very messy.

The platen abrasive surfaces also wear continually during the workpiece abrading action with the result that the platen abrasive surfaces become non-flat. Non-flat platen abrasive surfaces result in non-flat workpiece surfaces. These platen abrasive surfaces must be periodically reconditioned to provide flat workpieces. Conditioning rings are typically placed in abrading contact with the moving abrasive surface to re-establish the planar flatness of the platen annular band of abrasive.

In single-sided lapping, a rigid rotating platen has a coating of abrasive in an annular band on its planar surface. Floating-type workholder spindles hold individual workpieces in flat-surfaced abrading contact with the moving platen abrasive with controlled abrading pressure. The spindles typically have spherical-action devices that rotate the workpieces as they are in abrading contact with the rotating abrasive coated platens.

The fixed-spindle-floating-platen abrading system has many unique features that allow it to provide flat-lapped precision-flat and smoothly-polished thin workpieces at high abrading speeds. Here, the top flat surfaces of the equal-height rotary spindles are in a common plane that is approximately parallel with the granite flat-reference surface. Each of the three rigid spindles is positioned with equal spacing between them to form a triangle of platen spindle-support locations.

The fixed-spindle-floating platen system can be used at high abrading speeds to produce precision-flat and mirror-smooth workpieces at very high production rates. There is no abrasive wear of the platen surface because it is protected by the attached flexible abrasive disks. A minimum of three spindles are used to support the floating platen but more spindles can be added to the three spindles to provide additional workpiece abrading workstations. However, all of the spindle top flat surfaces must be precisely positioned in a common plane.

Non-Precision-Flat Rotary Platens

A rotatable floating platen having a horizontal flat-surfaced annular abrasive surface is positioned above the flat-surfaced spindles that all have horizontal flat surfaces. Here precision-thickness abrasive disks are attached to the precision-flat abrading-surface of the rotary platen. The rotational-centers of each of the spindles are positioned on the granite so that they are located at the radial center of the annular width of the precision-flat abrading platen surface. Equal-thickness flat-surfaced workpieces are attached to the flat-surfaced tops of each of the spindles. The rigid rotating floating-platen abrasive surface contacts all the workpieces attached to the three rotating spindles to perform single-sided abrading on the exposed surfaces of the workpieces.

Precision-flat platen annular abrading-surfaces that have a flatness variation of less than 0.0001 inches are required to be successfully used for high speed flat lapping. Non-precision-flat platen abrading-surfaces having a flatness variation that exceeds 0.0003 inches makes them unsuitable for high speed flat lapping.

Air-Bearing Flat-Surfaced Spindles

This fixed-spindle-floating-platen system is particularly suited for flat-lapping large-sized workpieces that must be extremely flat and also have extremely smooth polished surfaces such as large-diameter semiconductor wafers. Here, high-value large-sized workpieces such as 12 inch diameter (300 mm) semiconductor wafers can be attached to ultra-precise flat-surfaced air bearing spindles for precision lapping. Ultra-precise air bearing spindles can be mounted on structurally-stable granite bases to provide the desired ultra-flat workpieces. The high-speed spindles and other components can be easily assembled to construct these lapper machines that can be operated at high lapping speeds. Ultra-precise 12 inch diameter air bearing spindles provide flat rotary mounting surfaces for flat workpieces. These spindles provide flatness accuracy of 5 millionths of an inches (or less) during rotation, are very stiff in resisting abrading load deflections and can support loads of 900 lbs. A typical air bearing spindle having a stiffness of 4,000,000 lbs/inch is more resistant to deflections from abrading forces than a spindle having steel roller bearings. The weight of a single 12 inch diameter spindle is typically 130 lbs and the required set of three spindles weighs 390 lbs. Air bearing spindles are preferred because of the precision flatness of the spindle surfaces at all abrading speeds. Commercial 12 inch (300 mm) diameter ultra-flat air bearing spindles, weighing approximately 85 lbs, are available from the Nelson Air Corp, Milford, N.H.

Non-Precision-Flat Granite Machine Bases

Thick-section granite bases that have flat surfaces, structural stiffness and dimensional stability to support these heavy air bearing spindles without distortion are also commercially available. Fluid passageways in the granite bases can allow the circulation of heat transfer fluids that thermally stabilize them to provide long-term dimensional stability of the nominally-flat granite bases. Floating platens having precision-flat planar annular surfaces that are dimensionally stable can also be fabricated or readily purchased.

Granite is the material-of-choice for machine bases because they provide time-stable reference surfaces that can be maintained in a dimensionally stable condition. Epoxy-granite is another machine based material that is used. These granite bases are used for precision motion machine tools or component inspection or component measurement devices such as coordinate measurement machines (CMM). Relatively inexpensive flat-surfaced granite bases are often provided which have nominally-flat surfaces. Granite surface plates can also be purchased that have precision-flat surfaces which allows them to be used in laboratories, as inspection plates or for precision-motion machine bases.

However, there are a number of issues related to these precision-flat granite bases. First, the lapping process that is required to create a precision-flat surface on a flat-surfaced granite base is time consuming and expensive. Granite bases having nominally-flat surfaces are typically abraded by abrading machines to produce that flatness. These nominally-flat or non-precision-flat granite bases often have surface flatness variations that exceed 0.0005 inches which is much larger than the often-required 0.0001 inch variations. It is typically necessary to hand-lap the flat surfaces of granite bases to produce precision-flat surfaces that have a surface flatness variation of less than 0.0001 inches over the surfaces of large sized granite bases. These precision-flat granite bases are expensive because the required hand lapping is an expensive and time consuming process compared to machine abrading. Further, the granite base must be provided with a three-point support when this surface lapping procedure is done. This same three-point support must be maintained throughout the life of the granite base to maintain this original precision-flatness. If the support system of the granite base is changed, the granite base will distort and the granite surface will no longer have the required precision-flat surface.

The flatness accuracy of precision-flat granite bases that can be used in applications requiring precision-flat surfaces often have an allowable flatness tolerance variation of 0.0001 inches across the full surface of the granite base. Large granite bases that have this precision-flatness over long granite base surface spans require larger granite base purchase investments because of the addition costs of process required for surface-measuring and flat-lapping them. This precision-flat granite surface accuracy has been required for some workpiece flat-lapping machines that are used to successfully perform high speed flat-lapping. This same 0.0001 inch surface variation precision-flatness tolerance is required for the abrading-surfaces of the rotary platens to which the precision-thickness abrasive disks are attached that are also used in the high speed lapper system. Often, the larger size of the granite bases that are required for use with typical 3 or 4 foot diameter raised island abrasive disks (or larger) results in the purchase of very expensive precision-flat granite bases to achieve this less than 0.0001 inch granite surface precision-flatness. Granite base are available from the Tru-Stone Division of the Starrett Company at Waite Park, Mn.

Developing techniques to successfully use non-precision-flat, but dimensionally stable, granite bases is very desirable. The rotary spindle mounting system described here can utilize these non-precision-flat granite bases. The precision-flat workpiece spindles can be mounted to these non-precision-flat granite bases where all of the spindle-tops are precisely aligned to be precisely co-planar with each other within 0.0001 inches or less. This provides significant cost savings and abrading performance advantages for these non-precision-flat granite base abrading systems.

Spindle-Top Alignment of Spindles Mounted on a Non-Precision-Flat Machine Base

The three-point fixed-spindles can also be attached to the horizontal flat surface of a rigid machine base where the nominally-flat machine base surface is not precisely flat. By precisely aligning all three of the flat-surfaced spindle tops in a common plane, these rotary co-planar spindle tops can be used to perform precision flat lapping or other types of precision abrading. Each of the three (or more) rotary workpiece spindles have three (or more) spindle mounting legs that form a three-point support of each spindle. These three spindle legs are spaced equal distances around the outer periphery of the stationary rotary-spindle bodies to form a three-point triangle support of the spindle. The spindles are rigidly attached to a spherical rotor that is mounted in a matching spherical base where both the rotor and the base share a common spherical diameter. The spindles are attached to the spindle spherical rotor with threaded fasteners at each of the three spindle legs and the spindle spherical bases are attached to the top nominally-flat top surface of the machine base. Here, the top flat surfaces of the three rigid-body flat-topped spindles are positioned in a common plane by rotating the spindle spherical rotor while the rotor is mounted in the matching spindle spherical base.

To precisely align all three spindle top flat surfaces in a common plane, a number of different spindle alignment procedures can be followed. In one spindle alignment procedure, a first of the three spindles is attached to a rotor that is mounted in a spherical base that is attached to the rigid and structurally-stable machine base where the spindle rotatable top portion flat top surface is approximately parallel to the nominally-flat machine base. Then, spherical rotor rotations are independently made at each of the three rotary to allow co-planar alignment of all of the spindle-top flat surfaces with the use of spindle-top surface-flatness alignment instruments.

This precision co-planar alignment of all the spindles is completely independent of the localized non-flat defect-type contours of the machine base nominally-flat (non-precision-flat) top horizontal surface.

Another spindle-top alignment technique is to contact the spindle-top flat surfaces of the floating spindles that are attached to the spherical rotors with the precision-flat surface of a platen to allow the spindle tops to assume the precision-flatness of the platen abrading surface. The spindles can be vibrated during the alignment procedure to assure that the spindle-tops are conformably seated with the platen abrading surface. Also, pressurized air can be applied to the common contact surfaces of the flat spindle-tops and the platen flat abrading surface to act as a low-friction air-gap between the platen abrading surface and the spindle-tops. This pressurized air aids the conformal alignment of the spindle-top's flat surfaces with the platen abrading-surface. Here, the weight of the near-horizontal platen abrading-surface contacting the near-horizontal flat spindle-tops can help the alignment procedure where the pressurized air pressure is progressively diminished to allow the heavy platen abrading-surface to be in direct contact with the spindle-tops. After spindles are aligned to be precisely co-planar with each other they are fixtured in these aligned positions to the granite nominally-flat surface. Even though the flat surfaces of the spindle-tops are not precisely co-planar with the nominally-flat granite base surface, all of the spindle-top's flat surfaces are precisely co-planar with each other.

Three equally-spaced primary spindles are typically used to provide three-point support of the platen. However, auxiliary spindles can be mounted on the nominally-flat granite base between the primary spindles using the spherical rotor/base mounting devices. During alignment, the elevation of the auxiliary spindles are adjusted to allow the flat surfaces of the auxiliary spindle-tops to be aligned to be precisely co-planar with flat surfaces of the primary spindle-tops.

Co-Planar Spindle-Tops Surfaces are the Primary Abrading System Reference

The plane formed by the co-planar flat top surfaces of all the spindles is the primary reference plane for this abrading system. All alignments of the abrading system components are dependent on this precision spindle-top reference plane. Any changes of the abrading system components, such as spindle replacements, must have their critical alignments reestablished relative to this reference plane. Here, the granite base provides a stable mounting surface for all these spindles so they retain their co-planar alignment once it is established. However, the abrading system component alignment is not dependent on the precision flatness of the surface of the granite base.

Recondition Non-Precision-Flat Abrasive Surface of an Abrasive Disk

This abrading system can also be used to recondition the surface of the abrasive that is on the platen. This platen annular abrasive surface tends to experience uneven wear across the radial surface of the annular abrasive band after continued abrading contact with the spindle workpieces. When the non-even wear of the abrasive surface becomes excessive and the abrasive can no longer provide precision-flat workpiece surfaces it must be reconditioned to re-establish its planar flatness. Reconditioning the platen abrasive surface can be easily accomplished with this system by attaching equal-thickness abrasive disks to the flat surfaces of the spindles in place of the workpieces. Here, the abrasive surface reconditioning takes place by rotating the spindle abrasive disks while they are in flat-surfaced abrading contact with the rotating platen abrasive annular band.

Precision-flat abrasive disks have abrasive surfaces that have a flatness variation of less than 0.0001 inches. These precision-flat abrasive surfaces must also be precisely co-planar with the respective abrasive disk mounting surface within 0.0001 inches to be successfully used for high speed flat lapping. Non-precision-flat abrasive disks typically have a flatness variation that exceeds 0.0003 inches which makes them unsuitable for high speed flat lapping. Abrasive disks that have non-precision-co-planar opposed surfaces typically have a flatness variation that exceeds 0.0003 inches which typically makes them unsuitable for high speed flat lapping.

Flat Lapping 300 mm Semiconductor Wafers

This fixed-spindle-floating-platen system is particularly suited for precision flat-lapping large diameter semiconductor wafers. High-value large-sized workpieces such as 12 inch diameter (300 mm) semiconductor wafers can be attached to the ultra-precise flat-surfaced air bearing spindles for precision lapping. Ultra-precise 12 inch (300 mm) diameter air bearing spindles provide flat rotary mounting surfaces for the flat-surfaced 12 inch (300 mm) diameter semiconductor wafers. The 5 millionths of an inches flatness accuracy of the air bearing spindles provide support for the wafers to produce highly-desired extremely-flat surfaces on these wafers. Because the air bearing spindles are so stiff, there is little spindle-top distortion from abrading forces when the spindles are rotated, at all rotation speeds.

Use of time-stable nominally-flat lapper machine granite bases that are maintained in a dimensionally stable condition allows the use of the equal-height rigid rotatable workpiece air bearing spindles to provide spindle-top workpiece mounting surfaces that are in a common plane. The multiple workpieces are in abrading contact with a floating rotary platen that also has a precision-flat annular abrading surface. Mounting equal-thickness workpieces on the three spindles provides support for the platen where the platen abrading surface assumes a co-planar location with the common plane of the spindle surfaces. As all the workpieces are simultaneously abraded, they become thinner but retain an equal thickness.

This fixed-spindle-floating-platen system is uniquely capable of providing precision flat lapping of workpieces using rigid lapping machine components at high abrading speeds and high productivity. Because all of the machine components are rigid (including the floating platen), it is required that each abrading component has a precision-flat characteristic. Then, when all of these components are used together, they provide uniform abrading to the surfaces of spindle-mounted workpieces that are simultaneously contacted by a platen planar abrading surface. It is particularly important that all of the individual workpiece surfaces are individually and collectively co-planar with each other. Here, even the raised-island abrasive disks have a uniform precision-thickness over the full annular abrading surface of the disk. This results in both the abrasive surface of the disk and the opposite disk-backing mounting surface being precisely co-planar with each other.

Rigid Spindles and Rigid, but Flexible Raised-Island Abrasive Disks

In addition, the flexible raised-island abrasive disks having thin and flexible backings are rigid in a direction that is perpendicular to the disk flat abrading surface. An analogy here is a flexible piece of sheet metal that can be easily flexed out-of-plane but yet provides rigid and stiff load-carrying support for flat-surfaced components that are placed in flat-faced contact with the sheet metal flat surface. Vacuum-attached abrasive disks are flexible so they will conform to the flat surfaces of the platens. The raised-island abrasive disks are constructed from thin but structurally-stiff backing materials and the island structures are also constructed from structurally-stiff construction materials to assure that the abrasive coated island disks are not resilient. The abrasive disks do not distort locally due to abrading forces.

The abrasive disk backing materials are flexible to allow the abrasive disks to conform to the flat abrading surfaces of the platens where the disk can be firmly attached to the platen with vacuum. The disk backings have a continuous and smooth platen-attachment surface that provides an effective seal for the vacuum when the disk is attached to the smooth flat abrading surface of the platen. Abrasive disks can have a continuous backing surface over the full diameter of the disk where the abrasive is coated in an annular band on the disk backing. Also, the abrasive disks can have an annular shape where the disk backing has a open central area at the disk center and the abrasive is coated in an annular shape on the annular backing.

When very thin and flexible abrasive disk backings are sometimes used in the construction of large-diameter raised-island abrasive disks, it is possible that these large abrasive disks can be ripped or torn in the event when a sharp-edged workpiece is inadvertently forced at an angle into contact with this somewhat fragile abrasive disk. Abrasive disks that are constructed with thick and tough backing materials, including laminations of flexible sheets of metal and sheets of fiber materials tend to eliminate or reduce the possibility of disk tearing. These multiple backing layers can be laminated together and the precision-thickness of the composite disk backing are controlled by thickness-grinding the composite disk backing before the abrasive layer is applied to the disk backing.

If the vacuum attachment seal between the disk backing and the platen abrading surface is broken by this disk-cutting action, portions of the ripped disk can lift off the surface of the platen. Undesirable extra-thin abrasive disk backings can then crumple and become wedged between the workpieces and the moving platen surface on high-speed non-floating platen abrading systems. On these open-platen systems, where the platen has a high surface speed, the wedging action of the crumpled disk can quickly apply lifting forces on the workpieces and upon the individual workpiece holder devices that are positioned above the horizontal platen. Because the workpieces are free to travel in a direction that is perpendicular to the platen surface, a gap opening can develop between the workpiece and the platen. Leading-edge portions of the crumpled disk can then enter this gap and the resultant wedge-like event can even increase the workpiece lifting force. Here, the torn abrasive disk that is separated from the platen looses its vacuum attachment bond and the disk no longer rotates with the platen but assumes a stationary-position with the stationary-position workpieces. When that happens, the near-stationary non-abrasive disk backing simply tends to skid on the surface of the moving platen. The precision-flat platen abrading surface typically is not affected by these abrasive disk separation events because it is contacted by the non-abrasive-coated mounting side of the backing. Abrading system sensors are typically used to sense the disk separation event and to activate a platen braking system that quickly decelerates the platen to stop its rotation and also activate other abrading system components to minimize the effects of the torn abrasive disk.

When flexible abrasive disks are used with the three-point fixed-spindle floating-platen abrading system, the issue of cutting or tearing the disks is substantially less than with the abrading systems where the workpieces are held in abrading contact with an open-surfaced rotating platen. Any abrasive disk that looses its vacuum attachment with the bottom abrading surface of the platen will tend to fall into the very large open areas that exist between the adjacent three-point workpiece spindles. There is little opportunity for the disks to become wedged between the moving platen and the workpieces, in part, because the workpieces are not free to move vertically away from the platen surface when the workpieces are subjected to forces from a separated abrasive disk. The workpieces are attached to rigidly mounted spindles that do not move away from the surface of the platen when subjected to abrading-event forces. These flat-surfaced workpieces are trapped between the rigid spindle top surfaces and the rigid platen surface where they simply hold the loose abrasive disk at a stationary position while the platen is decelerated to a stop. Because the flat platen surface moves against the smooth non-abrasive surface of the abrasive disk, the precision-flat platen abrading surface, typically is not affected by these abrasive disk separation events. Abrading system sensors are used to sense the disk separation event and to activate a platen braking system that quickly decelerates the platen to stop its rotation. The sensors also are used to quickly reduce the abrading pressure between the platen and the workpieces.

Also, ripping or tearing of these fragile thin-backing abrasive disks can be easily avoided by simply using increased-thickness and/or tougher tear-resistant backing materials. These thick and tough backings are not vulnerable to tearing when they are subjected to sharp edges of workpieces that are mistakenly directed at angles into the body of the moving abrasive disks. Thick backings can be constructed of polymers or metals or even composite layers of different backing materials. The vacuum provides huge attachment forces that result in the abrasive disk becoming an integral part of the rigid platen structure. The raised-island structures that are attached to the thick and robust backings are ground to have a uniform thickness relative to the backside of the backing before the abrasive coating is applied to the top flat surfaces of the raised island structures. The precision-thickness of the non-coated raised island structures establishes the precision-thickness foundation of the abrasive disks that typically have thin and precision-thickness abrasive coatings. Here, it is as easy to provide thick-backing abrasive disks that have a precision-thickness over the full abrasive surface of the abrasive disks as it is to provide precision-thickness abrasive disks that have thin and fragile backings.

Flexible abrasive disks are attached to the bottom flat annular surfaces of the platens used in the fixed-spindle floating-platen abrading system with vacuum. The vacuum attached abrasive disks that become an integral part of the rigid platen provide rigid abrading surfaces. This system allows disks having different abrasive sizes to be quickly changed. Once an abrasive disk is conformably attached to the platen smooth and flat annular abrading-surface, it will tend to remain attached to, the flat platen surface even when the vacuum is interrupted. There is a cohesion-adhesion effect present between the lightweight abrasive disk smooth backing and the smooth platen surface. This abrasive disk cohesion-adhesion effect can be due to multiple sources. Typically there is a very thin water film present on the surface of the platen before a disk is conformable attached. Once the vacuum engages the disk and it becomes an integral part of the platen, the water film then acts as a suction-type disk retention system. This disk attachment effect is so strong that it can even be necessary to peel the disk off the platen surface when the disk is changed. This water-film suction-type attachment technique is often used to attach flat surfaced workpieces such as semiconductor wafers to flat-surfaced rotary spindles for abrading.

Another technique that can be used to separate the disk from the platen is to apply positive air pressure to the platen disk-attachment vacuum port holes. This air pressure will gently break the water-film seal that bonds the abrasive disk to the platen. Here, the loosened abrasive disk will tend to free-fall off the bottom horizontal surface of the platen.

Typically, the platen is allowed to rest on the top surfaces of the spindles when the disk attachment vacuum is turned off for an extended period of time. A stiff flat-plate member having a resilient pad surface can be positioned on top of the three-point spindles before the platen is brought to rest on the spindles. The stiff support plate will provide support of the abrasive disk across the full surface of the disk. Here, the disk will remain in full conformal contact with the platen when the abrading machine is in an at-rest mode with the vacuum shut off.

Also, clip-on abrasive disk support plates can be attached to the platen to retain the abrasive disk in place on the platen. When the abrasive system is restarted, the disk-attachment vacuum is reactivated to bond the disk back onto the platen surface in the same disk-position on the platen as it had before the vacuum was interrupted. Other techniques can be used to enhance the retention of the abrasive disks to the platen. For example, surface-tension enhancement fluids or other cohesion-adhesion agents can be applied to either the abrasive disk backings or the platen attachment surfaces prior to attachment of the disk to the platen. Water-mist sprays, low-tack adhesives sprays, or low-tack films can be applied to the disk backing surfaces. Electro-static charges can also be applied to the disk prior to attachment.

To assure that the flexible abrasive disks are in full conformal contact with the bottom side of large-diameter horizontal platens, the disk can be attached to the platen by "rolling" or progressively lifting it to contact the flat platen abrading surface. Here, one portion of a flexible disk is first brought in contact with the flat platen surface where vacuum engages this contact portion of the disk. Then the remaining portion of the flexible disk is progressively brought into contact with the platen. To concentrate the vacuum attachment capability at the progressive engaging portions of the disks, a thin flexible polymer slider-sheet can be first placed in contact with the platen flat annular surface to seal most of the vacuum attachment port holes that are located in the disk-mounting surface of the platen. As the abrasive disk is "rolled-on" to the platen, the slider-sheet is progressively moved back to expose more vacuum port-holes to the abrasive disk backing. Even very stiff, but flexible, abrasive disks can be installed using this technique. This is a simple and effective procedure of attaching large diameter flexible abrasive disks to the bottom flat annular surfaces of the platens used in the fixed-spindle floating-platen system.

The platen abrasive disks typically have annular bands of fixed-abrasive coated rigid raised-island structures. There is insignificant elastic distortion of the individual raised islands or of the whole thickness of the raised island abrasive disks when they are subjected to typical abrading pressures. These abrasive disks must also be precisely uniform in thickness across the full annular abrading surface of the disk to assure that full-surface abrading takes place over the full flat surface of the workpieces located on the tops of each of the three spindles. The term "precisely" as used herein refers to within ±5 wavelengths planarity and within ±0.01 degrees of perpendicular or parallel, and precisely coplanar means within ±0.01 degrees of parallel and with a standard deviation between planes that does not exceed ±20 microns.

With the fixed-spindle-floating-platen system, there are no resilient or complaint component members n this abrading system that would allow forgiveness of out-of-dimensional-tolerance variations of other of the system components. For example, there is no substantial structural compliance of the platen-mounted abrasive disks to compensate for spindle-to-spindle workpiece surface positional variations. The precision-flat platen abrasive surface must be precisely co-planar with the top exposed surfaces of all three of the rigid-spindle workpieces to provide workpieces that are abraded precisely flat when using these non-resilient abrasive disks. Further, the rigid granite base that the rigid spindles are mounted on does not deflect or elastically distort when the spindles are subjected to typical abrading forces. Likewise, the air bearing workpiece spindles are also extremely stiff and the spindle rotating tops do not experience significant deflection when subjected to the typical abrading forces. The whole fixed-spindle-floating platen system is extremely rigid, but also, has many component surfaces that are precisely co-planar with other of the system component surfaces.

Raised-Island Abrasive Disk Production

Production of a wide variety of precision-thickness raised island abrasive disks is very easy to accomplish with a very low capital investment. First, inexpensive abrasive disk backings are produced that have the desired annular patterns of raised-island flat-surfaced island-structures that are attached to a disk backing sheet. Then, these island-structure disks are attached to the flat surface of a precision-flat rotary spindle. All of the island-structures are then ground down when the spindle is rotating to produce island-structure equal heights where the island-structure heights are measured from the bottom mounting surface of disk backing. Next, a uniform thickness of a liquid abrasive slurry, that contains a selected size and type of abrasive particles and an adhesive binder, is transfer-coated on the top flat surfaces of the island structures. The uniform-thickness abrasive coating on the island-structures is then solidified in an oven or by other energy sources. The resultant high-performance precision-thick abrasive disk can be used for high speed flat lapping of workpieces.

Abrading System Workpiece Abrading Action

In the present system having flat workpiece surfaces positioned horizontally, there is no vertical movement of the workpiece wafer mounted on one spindle relative to the position of any wafer mounted on any of the other fixed-position rotary workpiece spindles. Here, it is critical that a precision-flat datum reference plane is established on the surfaces of the rotary spindle-tops. When a floating precision-flat platen is brought into abrading face contact with the three spindles, the flat abrading surface of the platen is precisely co-planar with the surfaces of the spindle-tops. Equal-thickness workpieces are attached in flat contact with the flat surfaces of the spindles where the flat abrading surface of the platen contacts the full flat surfaces of the workpieces that are attached to the spindle-tops. Here, the abraded flat surfaces of all three workpieces are also precisely co-planar with the co-planar flat surfaces of the spindle-tops.

During abrading action, both the workpieces and the abrasive platens are rotated simultaneously. Once a floating platen "assumes" a position as it rests conformably upon and is supported by the three spindles, the planar abrasive surface of the platen retains this platen alignment even as the floating platen is rotated. The three-point spindles are located with equal spacing between them circumferentially in alignment with the centerline of the platen annular abrasive. The controlled abrading pressure applied by the abrasive platen to the three individual same-sized and equal-thickness workpieces is evenly distributed to the three workpieces. All three equal-sized workpieces experience the same shared platen-imposed abrading forces and abrading pressures. Semiconductors wafer workpieces can then be lapped where precision-flat and smoothly polished wafer surfaces can be simultaneously produced at all three spindle stations by the fixed-spindle-floating platen abrading system.

Flat-lapped workpieces are typically abraded to a flatness that is 10 to 30, or more, times flatter than the abrading surfaces. This is a surface enhancement magnification process effect where "medium-flat" platen abrasive surfaces can produce "ultra-flat" workpiece surfaces. It is well established that the working surfaces of lapper machines are not provided with flatness equivalent to the flatness of the lapped workpieces. Furthermore, the active abrading lapper machine surfaces are not continuously maintained with the initial machine component flatness during extended abrading operations because they wear during the abrading processes. These platen abrasive surfaces are periodically re-flattened to re-establish their required flatness.

Because the floating-platen and fixed-spindle abrading process is single-sided, very thin workpieces can be attached to the rotatable spindles by vacuum or other attachment means. To provide abrading of the opposite side of the workpiece, it is removed from the spindle, flipped over and abraded with the floating platen. This is a simple two-step procedure. Here, the rotating spindles provide a workpiece surface that remains co-planar with the granite reference surface and the production of workpieces having two opposing non-planar surfaces is avoided. Non-planar workpiece surfaces are often produced by single-sided lapping operations that do not use fixed-position workpiece spindles.

The spindles and the platens can be rotated at very high speeds, particularly with the use of precision-thickness raised-island abrasive disks. These abrading speeds can exceed 10,000 surface feet per minute (SFM). The abrading pressures used are very low because of the extraordinary high material removal rates of superabrasives comprising diamond at high speeds. The abrading pressures are often much less than 1 psi which is a small fraction of the abrading pressures commonly used in abrading. Low abrading pressures result in highly desired low subsurface damage. In addition, low abrading pressures result in lapper machines that have considerably less weight and bulk than conventional abrading machines.

Use of a platen vacuum disk attachment system allows quick set-up changes where different sizes of abrasive particles and different types of abrasive material can be quickly attached to the flat platen surfaces. Also, the use of messy loose-abrasive slurries is avoided by using the fixed-abrasive disks.

A minimum of three evenly-spaced spindles are used to obtain the three-point support of the upper floating platen by contacting the spaced workpieces. However, many more spindles can be used where all of the spindle workpieces are in mutual flat abrading contact with the rotating platen abrasive.

Automated Abrading System

Semiconductor wafers can be easily processed with a fully automated easy-to-operate process that is very practical. Here, individual wafer carriers can be changed on all three spindles with a robotic arm extending through a convenient gap-opening between two adjacent stand-alone wafer spindles.

This three-point fixed-spindle-floating-platen abrading system can also be used for chemical mechanical planarization (CMP) abrading of semiconductor wafers using liquid abrasive slurry mixtures with resilient backed pads attached to the floating platen. These wafers are repetitively abraded on one surface after new semiconductor features are deposited on that surface. This polishing removes undesired surface protuberances from the wafer surface. The system can also be used with CMP-type fixed-abrasive shallow-island abrasive disks that are backed with resilient support pads. These shallow-island abrasives can either be mold-formed on the surface of flexible backings or the shallow-island abrasives can be coated on the backings using gravure-type coating techniques.

Robust and Durable Abrading System

The system has the capability to resist large mechanical abrading forces present with abrading processes with unprecedented flatness accuracies and minimum mechanical aberrations. Because the system is comprised of robust components it has a long lifetime with little maintenance even in the harsh abrading environment present with most abrading processes. Air bearing spindles are not prone to failure or degradation and provide a flexible system that is quickly adapted to different polishing processes.

BACKGROUND OF THE TECHNOLOGY

Flat lapping of workpiece surfaces to produce precision-flat and mirror smooth polished surfaces at high production rates where the opposing workpiece surfaces are co-planar is required for many high-value parts such as semiconductor wafer and rotary seals. The accuracy of the lapping or abrading process is constantly increased as the workpiece performance, or process requirements, become more demanding. The new workpiece feature tolerances for flatness accuracy, the amount of material removed, the absolute part-thickness and the smoothness of the polish become more progressively more difficult to achieve with existing abrading machines and abrading processes. In addition, it is necessary to reduce the processing costs without sacrificing performance. Also, it is highly desirable to eliminate the use of messy abrasive slurries. Changing the abrading process set-up of most of the present abrading systems to accommodate different sized abrasive particles, different abrasive materials or to match abrasive disk features or the size of the abrasive disks to the workpiece sizes is typically tedious and difficult.

This invention references commonly assigned U.S. Pat. Nos. 5,910,041; 5,967,882; 5,993,298; 6,048,254; 6,102,777; 6,120,352; 6,149,506; 6,607,157; 6,752,700; 6,769,969; 7,632,434 and 7,520,800 and commonly assigned U.S. patent application published numbers 20100003904; 20080299875 and 20050118939 and all contents of which are incorporated herein by reference.

There are many different types of abrading and lapping machines that have evolved over the years. Slurry lapping has been the primary method of providing precision-flat and smoothly polished flat-surfaced workpieces using a liquid mixture of loose abrasive particles that is applied to a flat surfaced rotary platen that is pressed into contact with the rotating workpieces. The platen surface continually wears due to abrading contact with the workpieces and conditioning rings are used periodically or continuously to re-establish the required planar flatness of the platen. Most slurry lapping is single-sided where only the exposed surface of a workpiece is abraded. Double-sided slurry lapping can be done by using two abrading platens that mutually contact both surfaces of the flat workpieces that are sandwiched between the two rotating abrading platens. The upper platen floats to allow conformal contact with the workpieces that are placed in flat contact with the flat surface of the lower platen. Workpieces are rotated with the use of gear-driven planetary workholders where it is required that the workholders geared-disks are thinner than the workpieces. Slurry lapping typically uses low abrading pressure and it is slow and messy. Changing the size of abrasive particles requires that the messy platens have to be thoroughly cleaned before smaller-sized particles are used because a few straggler-type large-sized particles can result in scratches of high-value workpiece surfaces. Abrading processes require that the abrasive sizes be sequentially changed (typically in three steps) to minimize the time required to flatten and polish the surfaces of workpieces.

Micro-grinding (flat-honing) is a double-sided abrading process that uses two abrading platens that mutually contact both surfaces of the flat workpieces that are sandwiched between the two rotating abrading platens. Both the upper and lower platen annular abrading surfaces have a thick layer of fixed-abrasive materials that are bonded to abrasive-wheels, where the abrasive wheels are bolted to the platen surfaces. The upper platen floats to allow conformal contact with the workpieces that are placed in flat contact with the flat surface of the lower platen. Workpieces are rotated with the use of gear-driven planetary workholders where it is required that the workholders geared-disks are thinner than the workpieces. Micro-grinding is slow and very high abrading pressures are typically used. Changing the abrasive wheels is a time-consuming and complex operation so the abrasive wheels are typically operated for long periods of time before changing. Changing the size of abrasive particles requires that the abrasive wheels have to be changed.

Chemical mechanical planarization (CMP) of workpieces typically use a resilient flat-surfaced pad that is coated with a continuous or periodic flow of liquid slurry that contains loose abrasive particles and specialty chemicals that enhance the abrading characteristics of select workpiece materials. Flat-surfaced workpieces are placed in flat contact with the rotating pads where the workpieces are also typically rotated. The pads often have fiber construction where it has been estimated that only 10% of the individual fiber strands are in abrading contact with the workpiece surface as the workpiece is forced into the surface-depth of the resilient pads. It also has been estimated that 30% of the expensive diamond or other abrasive particles are lost before being utilized for abrading contact with the workpieces. As in slurry lapping, this CMP polishing process is messy. Changing the size of the abrasive particles requires that a new or different pad is used with the new-sized particles. Because the workpieces float on the surface of the resilient pads, the CMP process is a polishing process only. Very small surface protuberances are removed from the flat surfaces of semiconductor wafers but the precision flatness of a wafer can not be established by the CMP process because of the floatation of the wafers on the pad surface.

More recently, fixed-abrasive web material is used for CMP polishing of wafers. The web has shallow-height islands that are attached to a web backing and the abrasive web is incrementally advanced between times of polishing individual wafers held in flat contact with the stationary web. Water containing chemicals is applied to the wafers during the polishing procedure. The abrasive web is typically supported by a semi-rigid polymer surface that is supported by a resilient pad. When the abrasive web is stationary, the wafer is rotated. However, the rotated wafer has a near-zero abrading speed at the rotated wafer center. Because the well-established function of the workpiece material removal rate being directly proportional to the abrading speed, the material removal rate is very high at the outer periphery of the rotating wafer but near-zero at the wafer center. This results in non-uniform abrading of the wafer surface. The fixed-abrasive provides a clean CMP abrading process compared to the messy slurry-pad CMP process.

U.S. Pat. No. 7,614,939 (Tolles et al) describes a CMP polishing machine that uses flexible pads where a conditioner device is used to maintain the abrading characteristic of the pad. Multiple CMP pad stations are used where each station has different sized abrasive particles. U.S. Pat. No. 4,593,495 (Kawakami et al) describes an abrading apparatus that uses planetary workholders. U.S. Pat. No. 4,918,870 (Torbert et al) describes a CMP wafer polishing apparatus where wafers are attached to wafer carriers using vacuum, wax and surface tension using wafer. U.S. Pat. No. 5,205,082 (Shendon et al) describes a CMP wafer polishing apparatus that uses a floating retainer ring. U.S. Pat. No. 6,506,105 (Kajiwara et al) describes a CMP wafer polishing apparatus that uses a CMP with a separate retaining ring and wafer pressure control to minimize over-polishing of wafer peripheral edges. U.S. Pat. No. 6,371,838 (Holzapfel) describes a CMP wafer polishing apparatus that has multiple wafer heads and pad conditioners where the wafers contact a pad attached to a rotating platen. U.S. Pat. No. 6,398,906 (Kobayashi et al) describes a wafer transfer and wafer polishing apparatus. U.S. Pat. No. 7,357,699 (Togawa et al) describes a wafer holding and polishing apparatus and where excessive rounding and polishing of the peripheral edge of wafers occurs. U.S. Pat. No. 7,276,446 (Robinson et al) describes a web-type fixed-abrasive CMP wafer polishing apparatus.

U.S. Pat. No. 6,786,810 (Muilenberg et al) describes a web-type fixed-abrasive CMP article. U.S. Pat. No. 5,014,486 (Ravipati et al) and U.S. Pat. No. 5,863,306 (Wei et al) describe a web-type fixed-abrasive article having shallow-islands of abrasive coated on a web backing using a rotogravure roll to deposit the abrasive islands on the web backing. U.S. Pat. No. 5,314,513 (Milleret al) describes the use of ceria for abrading.

Various abrading machines and abrading processes are described in U.S. Pat. Nos. 1,989,074 (Bullard), 2,410,752 (Sells et al), 2,696,067 (Leach), 2,973,605 (Carman et al), 2,979,868 (Emeis), 3,342,652 (Reisman et al), 3,475,867 (Walsh), 3,662,498 (Caspers), 4,104,099 (Scherrer), 4,165,584 (Scherrer), 4,256,535 (Banks), 4,315,383 (Day), 4,588,473 (Hisatomi et al), 4,720,938 (Gosis), 4,735,679 (Lasky), 4,910,155 (Cote et al), 5,032,544 (Ito et al), 5,137,542 (Buchanan et al), 5,191,738 (Nakazato et al), 5,274,960 (Karlsrud), 5,364,655 (Nakamura et al), 5,422,316 (Desai et al), 5,454,844 (Hibbard et al), 5,456,627 (Jackson et al), 5,538,460 (Onodera), 5,569,062 (Karlsrud), 5,643,067 (Katsuoka et al), 5,769,697 (Nisho), 5,800,254 (Motley et al), 5,833,519 (Moore), 5,840,629 (Carpio), 5,857,898 (Hiyama et al), 5,860,847 (Sakurai et al), 5,882,245 (Popovich et al), 5,916,009 (Izumi et al), 5,938,506 (Fruitman et al), 5,964,651 (Hose), 5,972,792 (Hudson), 5,975,997 (Minami), 5,981,454 (Small), 5,989,104 (Kim et al), 5,916,009 (Izumi et al), 6,007,407 (Rutherford et al), 6,022,266 (Bullard et al), 6,089,959 (Nagahashi), 6,139,428 (Drill et al), 6,165,056 (Hayashi et al), 6,168,506 (McJunken), 6,217,433 (Herrman et al), 6,273,786 (Chopra et al), 6,439,965 (Ichino), 6,520,833 (Saldana et al), 6,632,127 (Zimmer et al), 6,652,764 (Blalock), 6,702,866 (Kamboj), 6,893,332 (Castor), 6,896,584 (Perlov et al), 6,899,603 (Homma et al), 6,935,013 (Markevitch et al), 7,001,251 (Doan et al), 7,008,303 (White et al), 7,014,535 (Custer et al), 7,029,380 (Horiguchi et al), 7,033,251 (Elledge), 7,044,838 (Maloney et al), 7,125,313 (Zelenski et al), 7,144,304 (Moore), 7,147,541 (Nagayama et al), 7,166,016 (Chen), 7,214,125 (Sharples et al), 7,250,368 (Kida et al), 7,364,495 (Tominaga et al), 7,367,867 (Boller), 7,393,790 (Britt et al), 7,422,634 (Powell et al), 7,446,018 (Brogan et al), 7,449,124 (Webb et al), 7,456, 7,527,722 (Sharan), 7,582,221 (Netsu et al), 7,585,425 (Ward), 7,588,674 (Frodis et al), 7,635,291 (Muldowney), 7,648,409 (Horiguchi et al) and in U.S. Patent Application 2008/0182413 (Menk et al).

I. Types of Abrading Contact

The characteristic of workpieces abrasion is highly dependent on the type of contact that is made with an abrasive surface. In one case, the flat (or curved) surface of a rigid platen-type surface is precisely duplicated on a workpiece. This is done by coating the platen with abrasive particles and rubbing the workpiece against the platen. In another case, a rigid moving abrasive surface is guided along a fixed path to abrade the surface of a workpiece. The accuracy of the abrasive guide-rail (or a rotary spindle) determines the accuracy of the abraded workpiece surface. A further case is where workpieces are "floated" in conforming surface-contact with a moving rigid abrasive-coated flat platen. Here, only the high-spot areas of the moving platen contact the workpiece. It is helpful that the abraded surface of the workpiece is typically flatter than the abrading surface of the platen.

For those workpieces requiring ultra-flat surfaces where the amount of material removed in an abrading process is extremely small, it is difficult to provide fixed-path abrading machines having rigid abrasive surfaces that can accomplish this. Out-of-plane variations of the moving abrasive are directly dependent on the variations of the moving abrading machine components. Abrading machines typically are not capable of providing moving abrading surfaces that have variations less than the often-required 1 lightband (0.000011 inches or 11 millionths of an inch) of workpiece flatness. It is much more difficult to create precision-flat and mirror-smooth surfaces on large sized workpieces than small ones.

Most lapping-type of abrading is done on rotary-platen machines that provide smooth continuous abrading motion rather than oscillating-motion machines. However, rotary-motion machines have an inherent flaw in that the abrading speed is high at the outer periphery of the platen and low at the platen center. This change of abrading speed across the surface of the platen results in non-uniform abrading of a workpiece surface. Using annular bands of abrasive on large diameter platens minimizes this problem. However, it is necessary to rotate workpieces while in abrading contact with the platen abrasive to even-out the wear on a workpiece.

Wear-down of the platen abrasives during abrading creates non-flat abrasive surfaces which prevent abrading precision-flat workpiece surfaces. It is necessary to periodically re-flatten the platen abrading surfaces.

For removing small amounts of surface material for workpieces, floatation-type abrading systems are often used. Here, conformal abrading contact provides uniform material removal across the full flat surface of a workpiece. One common-use of floatation-abrading is slurry lapping. Here, a flat platen is surface-coated with a liquid slurry mixture of abrasive particles and a workpiece is held in flat conformal contact with the slurry coated platen. This slurry lapping system can provide workpieces having both precision-flatness across the full workpiece surface and a mirror-smooth polish.

Another abrading system that has "floatation" characteristics is double-sided abrading. Here, equal-thickness workpiece parts are position around the circumference of a lower flat-surfaced abrasive platen. Then another flat-surfaced abrasive platen is placed in conformal contact with the top surface of the distributed workpieces. This upper abrasive platen is allowed to "float" while both abrasive platens are moved relative to the workpieces sandwiched between them.

II. Single-Sided Abrading

Abrading ultra-flat and ultra-smooth workpiece parts requires a sequential series of different abrading techniques. First, rigid-grind techniques are used. Here the, rough-surfaced workpieces are given flat surfaces that are fairly smooth. Then, workpieces are lapped even flatter and smoother. Precision-flat rigid platens are coated with a slurry containing loose abrasive particles are used for lapping. This slurry lapping process can produce workpieces that are much flatter than the platen surfaces. This is a critical achievement because it is not possible to produce and maintain platens that have surfaces that are as desired flatness of the workpieces.

Likewise, it is not possible to provide and maintain lapping machines that rotating workholders that are perfectly perpendicular to a rotary abrasive platen surface. Because of the lack of machine capability, it is not practical to produce workpieces having precisely parallel surfaces using this type of single-sided abrading machines.

III. Double-Sided Abrading

To produce parallel-surfaced workpieces, a different machine technology is used. Here, a large-diameter rigid precision-flat rotating platen is provided. Multiple equal-thickness workpieces are positioned around the circumference of the platen. Then, another large diameter flat-surfaced abrading platen is placed in contact with the top surfaces of the multiple workpieces. Here, the upper platen is allowed to float spherically so its flat surface assumes parallelism with the surface of the bottom platen. Both the upper and bottom platens have equal-diameter abrading surfaces. With this technology, no attempt is made to rigidly position the surface of the upper moving abrasive platen surface precisely perpendicular to the surface of the bottom platen. This co-planar alignment of the two double-sided abrading platens is achieved with ease and simplicity by using the uniform-thickness workpieces as spacers between the two [platens.

Building of complex and expensive rigid-workholder style of machines to abrade precisely co-planar (parallel) workpiece surfaces is avoided by this technique of double-sided abrading. The simple, and less expensive, machines provide an upper platen that floats spherically while rotationally moving in abrading contact with the top surface of the workpieces. Because both workpieces are abraded simultaneously, the workpiece surfaces are precisely co-planar.

IV. CMP Slurry Abrading of Wafers

Floatation-type abrading machines are typically used for abrading workpieces requiring ultra-flat and ultra-smooth workpiece surfaces. For example, high-value semiconductor wafers are constructed from a combination of rigid silicon materials and soft metals. They are often very thin and fragile but have ultra-flat and smooth-polish requirements. Another type of flotation-abrading is used to abrade these wafers after each sequential depositions of material upon the wafer surfaces. This chemical mechanical planarization (CMP) system uses resilient pads that are coated with a liquid slurry mixture containing loose-abrasive particles. Rotating wafers are held in flat abrading contact with the flat moving pad surface. This is considered a "floating" abrading system. Here, the wafers are "plunged" into the surface-depths of the resilient pad where conformal full-surface contact of the wafer is made with the pad surface.

Fixed-abrasive CMP abrading of wafers is also done using thin flexible backings that are coated with shallow-height abrasive islands. These island-backing articles are supported by semi-rigid plates that "float" on a resilient foam pad. The abrasive island backing articles are held stationary while the wafers are rotated while in full-faced contact with the abrasive.

Sequential polishing of semiconductor wafers after each deposition of new materials on the wafer surface requires a completely different abrading technology. The material deposition layers are extremely thin and the wafers are very large in size. It is not possible to construct abrading machines having rigid workholder and rigid abrasive surfaces to remove protrusions (only) from the ultra-thin deposition layers. Instead, a completely different abrading approach is used. First, the wafers are ground or lapped precisely flat. Then, a material layer is deposited on the wafer. A chemical mechanical planarization (CMP) planarization process is used to remove only the unwanted protrusions of this deposited material. Here, the wafer is held face-down, under low pressure, against a non-rigid, abrasive slurry coated resilient foam disk pad. The resilient foam pad provides conformal contact of the pad surface with the flat wafer surface. The pad disk rotates and the workpiece is also rotated to provide abrading speed across the whole surface wafer surface. Loose-abrasive soft ceria particles are mixed in the liquid slurry applied to the pad surface. The pH of the slurry liquid is elevated to soften the surface of the applied wafer deposition material. Abrading the undesired softened protrusions is a very gentile action compared with conventional hard abrasive particle abrading action.

No planarization attempt is made to correct any global non-flat regions of the whole wafer surfaces. Only localized planarization is provided where only individual protrusions are removed.

V. Fixed-Abrasive CMP Wafer Abrading

Fixed-abrasive media is now being used for CMP abrading of wafers. Here, there is no liquid abrasive slurry mess because the abrasive particles are bonded in shallow-height islands on a flexible backing sheet. This fixed abrasive media is in a web-roll form. Sections of the abrasive web are stretched over a semi-rigid flat-surfaced polymer platen. The rigid platen is supported by a resilient foam-type pad. Abrading speed is provided by rotating the wafer while it is in full-face contact with the stationary raised-island abrasive. The abrasive is not moved relative to the wafer. This fixed-abrasive system is different than the abrasive slurry CMP system where relative abrading speed is provided by a moving slurry pad. Water having elevated pH is applied to the abrasive surface.

VI. Raised-Island High Speed Flat Lapping

All of the present precision-flat abrading processes have very slow abrading speeds of about 5 mph. The high speed flat lapping system operates at about 100 mph. Increasing abrading speeds increase the material removal rates. This results in high workpiece production and large cost savings. In addition, those abrading processes that use liquid abrasive slurries are very messy. The fixed-abrasive used in high speed flat lapping eliminates the slurry mess. Another advantage is the quick-change features of the high speed lapper system where abrasive disks can be quickly changed with use of the disk vacuum attachment system. Changing the sized of the abrasive particles on all of the other abrading systems is slow and troublesome. The precision-thickness raised island abrasive disks that are used in high speed flat lapping can also be used for CMP-type abrading, but at lower speeds. These disks can be provided with thick semi-rigid backings that are supported with resilient foam backings.

VII Abrading Platens

A. Rotary Platens

Rotary platens are used for lapping because it is easy to establish and maintain their moving precision-flat surfaces that support abrasive coatings. The flat abrasive surfaces are replicated on workpieces where non-flat abrasive surfaces result in non-flat workpiece surfaces. Rotary platens also provide the required continuous smooth abrading motion during the lapping operation because they don't reverse direction as does an oscillating system. However, the circular rotary platen annular abrasive bands are curved which means the outer periphery travels faster than the inner periphery. As a result, the material cut-rate is higher at the outside portion of the annular band than the inside. To minimize this radial position cut rate disparity, very large diameter platens are used to accommodate large workpieces.

B. Maintain Abrasive Surface Flatness

To provide precision-flat workpiece surfaces, it is important to maintain the required flatness of annular band of fixed-abrasive coated raised islands during the full abrading life of an abrasive disk. The techniques developed to maintain the abrasive surface flatness are very effective. The primary technique is to use the abraded workpieces themselves to keep the abrasive flat during the lapping process. Here large workpieces (or small workpieces grouped together) are also rotated as they span the radial width of the rotating abrasive band. Another technique uses driven planetary workholders that move workpieces in constant orbital spiral path motions across the abrasive band width. Other techniques include the use of annular abrasive coated conditioning rings. The conditioning rings can be used periodically to maintain the flatness of the rotating platen or to maintain the flatness of the abrasive that is coated on the abrasive disks. These rings can rotate in stationary positions or be transported by planetary circulation mechanisms. Conditioning rings have been used for years to maintain the flatness of slurry platens that utilize loose abrasive particles. These same types of conditioning rings are also used to periodically re-flatten the fixed-abrasive continuous coated platens used in micro-grinding.

C. No Platen Wear

Unlike slurry lapping, there is no abrasive wear of raised island abrasive disk platens because only the non-abrasive flexible disk backing surface contacts the platen surface. There is no motion of the abrasive disk relative to the platen because the disk is attached to the platen. During lapping, only the top surface of the disk raised island fixed-abrasive has to be kept flat, not the platen surface itself. Here, the precision flatness of the high speed flat lapper system can be completely re-established by simply and quickly changing the abrasive disk. Changing the non-flat fixed abrasive surface of a micro-grinder can not be done quickly because it is a bolted-on integral part of the rotating platen that supports it.

D. Quick-Change Capability

Vacuum is used to quickly attach flexible abrasive disks, having different sized particles, different abrasive materials and different array patterns and styles of raised islands. Each flexible disk conforms to the precision-flat platen surface provide precision-flat planar abrading surfaces. Quick lapping process set-up changes can be made to process a wide variety of workpieces having different materials and shapes with application-selected raised island abrasive disks that are optimized for them individually. Small and medium diameter disks can be stored or shipped flat in layers. Large and very large disks can be rolled and stored or shipped in polymer protective tubes. The abrasive disk quick change capability is especially desirable for laboratory lapping machines but they are also great for prototype lapping and full-scale production lapping machines. This abrasive disk quick-change capability also provides a large advantage over micro-grinding where it is necessary to change-out a worn heavy rigid platen or to replace it with one having different sized particles.

VIII. Hydroplaning of Workpieces

Hydroplaning of workpieces occurs when smooth surfaces (continuous thin-coated abrasive) are in fast-moving contact with a flat surface in the presence of surface water. However, it does not occur when interrupted-surfaces (raised islands) contact a flat wetted workpiece surface. An analogy is the tread lugs on auto tires which are used on rain slicked roads. Tires with lugs grip the road at high speeds while bald smooth-surfaced tires hydroplane.

IX. Maintaining Abrasive Disk Flat Surface

Care is taken during the lapping procedures to maintain the precision flatness of the abrasive surface. This is done by selecting abrasive disks where the full surface of the abrasive is contacted by the workpiece surface. This results in uniform wear-down of the abrasive. Other techniques can also be used to accomplish this. First, a workpiece that is smaller than the radial width of the annular band of abrasive islands can be oscillated radially during the abrading procedure to overlap both the inner and outer edges of the annular abrasive band. This prevents the formation of tangential raised ribs of abrasive inboard and outboard of the wear-track of the workpiece.

Also, stationary-position conditioning rings can be used in flat contact with the moving abrasive disk abrasive surfaces. Here, abrasive-surfaced conditioning rings can be attached to the rotary spindles and the moving abrasive surface of the abrasive disks that are attached to the rotary platens can be held in controlled abrading force contact with the conditioning rings to recondition or reestablish the precision planar flatness of non-precision-flat abrasive disk abrasive surfaces.

These conditioning rings have diameters that are larger than the radial width of the abrasive island annular band. They preferentially remove the undesirable raised abrasive high spot areas or even raised rib-walls of abrasive that extend around the circumference of the annular band of abrasive. The conditioning rings are similar to those used in slurry lapping to continually maintain the flatness of the rotating slurry platen.

Many of the different techniques used here to maintain the flatness of annular band of fixed-abrasive coated raised islands during the abrading life of an abrasive disk are highly developed and in common use in slurry lapping. In slurry lapping, a liquid mixture that contains loose abrasive particles continuously wears recessed circumferential tracks in the rigid metal platen surface. However, unlike slurry lapping, there is no abrasive wear of the high speed flat lapper platens because only the flexible disk backing contacts the platen surface. Here, the precision flatness of the high speed flat lapper system is re-established by simply changing the abrasive disk.

Another method of maintaining the planar flatness of both the upper and lower abrasive platens used in double-sided lapping is to translate the upper platen radially relative to the lower platen during the recondition process. Instead of the upper and lower platens being held in a concentric position during the flatness reconditioning process, the upper platen is moved to where they are not concentric. The amount of radial motion required is limited because the radial width of the annular band of abrasive is small relative to the platen diameters. Radial off-setting of the platens takes place but the floating upper platen is still allowed to maintain its flat conformal contact with the lower platen surface. Abrading mutually takes place on both abrasive platen surfaces as both the platens are rotated. This platen surface abrading action allows abrasive from one platen to travel cross-width relative to the abrasive on the opposing platen.

Off-set abrading action prevents tangential out-of-plane faults on one platen abrasive surface being transferred to the abrading surface of the opposite platen when the two platen surfaces are reconditioned while they are concentric. The upper platen off-set can be stationary or the upper platen can be oscillated relative to the lower platen during the reconditioning event.

Because the upper platen uses a spherical bearing that allows the platen to float, the platen holding mechanism can be a simple pivot arm device. The platen spherical-action bearing provides radial support for the platen during rotation so the platen retains its balance even when it is operated at great speeds. Conformal flat contact of the two platens prevents wobble of the upper platen as it is rotated. It is not necessary that the pivot arm position the upper platen in a precision concentric alignment with the lower platen during a double-sided lapping operation.

X. Raised Island Disks

The reason that this lapping system can be operated at such high speeds is due to the use of precision-thickness abrasive coated raised island disks. Moving abrasive disks are surface cooled with water to prevent overheating of both the workpiece and the abrasive particles. Raised islands prevent hydroplaning of the stationary workpieces that are in flat conformal contact with water wetted abrasive that moves at very high speeds. Abrading speeds are often in excess of 100 mph. Hydroplaning occurs with conventional non-island continuous-coated lapping film disks where a high pressure water film is developed in the gap between the flat workpiece and the flat abrasive surfaces.

During hydroplaning, the workpiece is pushed up away from the abrasive by the high pressure water and also, the workpiece is tilted. These cause undesirable non-flat workpiece surfaces. The non-flat workpieces are typically polished smooth because of the small size of the abrasive particles. However, flat-lapped workpieces require surfaces that are both precision-flat and smoothly polished.

The islands have an analogy in the tread lugs on auto tires which are used on rain slicked roads. Tires with lugs grip the road at high speeds while bald tires hydroplane. Conventional continuous-coated lapping film disks are analogous to the bald tires.

Raised islands also reduce "stiction" forces that tend to bond a flat surfaced workpiece to a water wetted flat-surfaced abrasive surface. High stiction forces require that large forces are applied to a workpiece when the contacting abrasive moves at great speeds relative to the stationary workpiece. These stiction forces tend to tilt the workpiece, resulting in non-flat workpiece surfaces. A direct analogy is the large attachment forces that exist between two water-wetted flat plates that are in conformal contact with each other. It is difficult to slide one plate relative to the other. Also, it is difficult to "pry" one plate away from the other. Raised island have recessed channel passageways between the island structures. The continuous film of coolant water that is attached to the workpiece is broken up by these island passageways. Breaking up the continuous water film substantially reduces the stiction.

XI. Precision Thickness Disks

Another reason that this lapping system can be operated at such high speeds is due to the use of precision-thickness abrasive coated raised island disks. These disks have an array of raised islands arranged in an annular band on a disk backing. To be successfully used for high speed lapping, the overall thickness of the abrasive disks, measured from the top surface of the exposed abrasive to the bottom mounting surface of the disk backing must be uniform across the full disk-abrasive surface with a standard deviation in thickness of less than 0.0001 inches. The top flat surfaces of the islands are coated with a very thin coating of abrasive. The abrasive coating consists of a monolayer of 0.002 inch beads that typically contain very small 3 micron (0.0001 inch) or sub-micron diamond abrasive particles. Raised island abrasive disks are attached with vacuum to ultra-flat platens that rotate at very high abrading surface speeds, often in excess of 100 mph.

The abrasive disks have to be of a uniform thickness over the full abrading surface of the disk for three primary reasons. The first reason is to present all of the disk abrasive in flat abrading contact with the flat workpiece surface. This is necessary to provide uniform abrading action over the full surface of the workpiece. If only localized "high spots" abrasive surfaces contact a workpiece, undesirable tracks or gouges will be abraded into the workpiece surface. The second reason is to allow all of the expensive diamond abrasive particles contained in the beads to be fully utilized. Again if only localized "high spots" abrasive surfaces contact a workpiece, those abrasive particles located in "low spots" will not contact the workpiece surface. Those abrasive beads that do not have abrading contact with a workpiece will not be utilized. Because the typical flatness of a lapped workpiece are measured in millionths of an inch, the allowable thickness variation of an raised island abrasive disk to provide uniform abrasive contact must also have extra-ordinary accuracy.

The third reason is to prevent fast moving uneven "high spot" abrasive surfaces from providing vibration excitation of the workpiece that "bump" the workpiece up and away from contact with the flat abrasive surface. Because the abrasive disks rotate at such high speeds and the workpieces are lightweight, these moving bumps tend to repetitively drive the workpiece up after which it falls down again with only occasional contact with the moving abrasive. The result is uneven wear of the workpiece surface.

All three of these reasons are unique to high speed flat lapping. The abrading problems, and solutions described here were progressively originated while developing this total lapping system. They were not known or addressed by others who had developed raised island abrasive disks. Because of that, their disks can not be used for high speed flat lapping.

XII. Abrading Pressure

Abrading pressures used are typically a small fraction of that used in traditional abrading processes. This is because of the extraordinary cutting rates of the diamond abrasive at the very high abrading speeds. Often abrading pressures of less than 0.2 psi can be used in high speed flat lapping. These low pressures have a very beneficial effect as they result in very small amounts of subsurface damage of workpiece materials that is typically caused by the abrasive material.

XIII. Annular Band of Abrasive

The raised abrasive islands are located only in an annular band that is positioned at the outer periphery of the disk. Problems associated with the uneven wear-down of abrasives located at the inner radius of a disk are minimized. Also, the uneven cutting rates of abrasives across the abrasive surface due to low abrading speeds at the innermost disk are minimized. Equalized cutting rates across the radial width of the annular band occur because the localized abrading speeds at the inner and outer radii of the annular abrasive band are equalized.

The abrasive islands are constructed in annular bands on a flexible backing. The disks are not produced from continuous abrasive coated webs is not used because the presence of abrasive material at the innermost locations on a disk are harmful to high speed flat lapping. In addition, there are no economic losses associated with the lack of utilization of expensive diamond particles located at the undesirable innermost radii of an abrasive disk.

XIV. Initial Platen Flatness

The best flatness that is practical to achieve for a new (or reconditioned) slurry platen having a medium platen diameter is about 0.0001 inches. It is even more difficult to achieve this flatness for large diameter platens. These are platen flatness accuracies that are achieved immediately after a platen is initially flattened. This process is usually done with great care and requires great skill and effort. To better appreciate the small size of this 0.0001 inch allowable platen variation, a human hair has a diameter of about 0.004 inches and a sheet of copier paper is also about 0.004 inches thick. Attaining a flatness variation of 0.0001 inches is difficult for a medium 12 inch diameter platen, more difficult for a large 6 foot platen and extremely difficult for huge platens that exceed 30 feet in diameter.

The vertical distance that a typical outer periphery deviates from the platen planar surface far exceeds the size of a sub-micron abrasive particle. To appreciate the relative difference between platen flatness deviation dimensions and the abrasive particle sizes, a comparison is made here. Typically a new (or reconditioned) platen is flattened to within 0.0001 inches total variation of the platen plane. This is roughly equivalent to the size of a 3 micron abrasive particle. It is also approximately equal to 10 helium lightbands of flatness. These dimensions are so small that optical refraction devices are used to measure flatness variations in lightbands. It is difficult to accurately make these small measurements using conventional mechanical measuring devices. The out-of-plane platen flatness is even worse when compared to sub-micron sized abrasive particles. For instance, a typical 0.3 micron particle is only one tenth the size of a 3 micron particle. Even the typical non-worn platen flatness variations are grossly larger than the size of the sub-micron particles that are required to produce mirror-smooth polishes.

XV. Continual Wear of Platen Surface

Even though a platen can initially have a precision-flat planar surface, this surface is constantly subjected to uneven wear. The platen uneven wear is caused primarily by the variation of the abrading speeds across the radial surface of the rotating platen. Abrading speeds are higher at the outer periphery of a circular rotating platen than they are at the inner radial location due to the greater circumference at the outer periphery. Higher abrading speeds mean higher wear. This results in continual higher wear of the platen at the outer periphery. The worn outer periphery area then develops an annular band that is lower than the plane of the overall platen surface. This out-of-plane platen wear is caused primarily by the loose abrasive particles, not the imbedded particles.

XVI. Platen Wear Effect on Workpiece

As a platen is subjected to uneven wear only the high-spot areas of a rotating platen are in abrading contact with a flat workpiece surface. More uneven platen wear means that uneven workpiece material removal becomes more pronounced.

XVII. Conditioning Rings

Conditioning rings can be used to maintain the precision flatness of the platen annular surface. In addition, a conditioning ring can make flat abrading contact with the annular abrasive band of an abrasive disk to periodically dress the full radial and tangential surface of the abrasive band into a precision plane. These conditioning rings are the same as used for slurry lapping. For slurry lapping, they prevent abrading an annular groove in the rotating platen surface. For high speed raised island disks, they prevent abrading an annular groove in the planar abrasive surface.

XVIII. Raised Island Disk Features

A. Precision Thickness Abrasive Disks

The abrasive disks that are used to produce a flat lapped workpiece generally are used in sets of three. The first disk uses a coarse abrasive to initially flatten a rough surfaced workpiece. The second disk uses a medium abrasive to develop a smooth surface while retaining the flatness. The third disk has very small abrasive particles to generate the polished surface, again while retaining the surface flatness. The abrasive disks are used sequentially on the lapper machine and the sequence is repeated until the abrasive disks are worn out. Typical disks have very long lives because of the long life of the abrasive beads that are filled with diamond particles.

Because the flatness of a workpiece is directly related to the flatness of the abrasive disk, it is critical that new disks have a precision thickness across the full surface of the disk. Each disk must be manufactured with a uniform thickness across the surface of the abrasive islands that typically has a thickness variation that is less than 0.0001 inches to assure that the disk can be used satisfactorily to produce flat lapped workpiece parts. This disk thickness accuracy is required for the high speed abrasive disks used in this operation and is not available with traditional raised island abrasive disks.

One simple method to manufacture raised island abrasive disks that have the required disk thickness is to produce polymer disk backings that have annular bands patterns of raised island structures attached to the backing. Then the island top surfaces are ground to have the same precision height from the backside of the backing. A mixture of abrasive beads, a solvent and an adhesive provides a mixture that has a uniform distribution of the beads in the adhesive mixture. This mixture is applied to the top flat surface of the islands to form a monolayer of abrasive beads. After partial drying of the adhesive which tends to "skin-over", the tops of the individual beads can be pressed into a common plane that is parallel to the backside of the disk backing. This assures that all the individual abrasive beads are utilized in the abrading procedures. Also, the abrasive disk now has a precision thickness across the whole abrasive surface of the abrasive. The nominal thickness of the abrasive disk is relatively unimportant as a workpiece is simply lowered to contact the abrasive. It is primarily the precision thickness control of the disk that is important.

It is desirable that the inner diameter of the annular abrasive band is greater than approximately 50% of the outer diameter of the annular band to equalize the abrading surface speeds across the radial width of the band. Each high speed abrasive disk has an annular band of abrasive coated raised islands to provide abrading speeds that are approximately constant across the radial width of the annular abrasive. Typically, the width of the workpiece is approximately equal to the radial width of the annular abrasive band to assure that the abrasive is worn down evenly during the abrading process. When large workpieces are abraded, then the annular width of the abrasive disk has to be equally large.

The abrasive disks are flexible to conform to the flat surface of a rotary platen. The disk backing is typically made from a polymer sheet having a thickness of less than 0.005 inches. The bottom mounting surface of the backing is smooth and continuous to provide a vacuum seal when the disk is mounted to a flat platen. It is preferred that the disks are used on flat surfaced rotary platens.

B. Thickness Related To Disk Diameter

Small diameter abrasive disks having low-height raised islands can be moderately thin and use polymer backings. Large diameter disks require thicker backings for abrading durability and for handling and storage. Thick, but flexible disks are easier to attach to large diameter platens than are thin disks.

C. Thickness Related to Island Heights

Thicker backings are required for disks having raised island structures that protrude substantially from the top surface of the backing but have small footprints. Abrading forces apply tipping torques to these tall islands. Thick backings are useful in resisting these torque forces. Also, composite laminated backings are used to provide structural support to these small-surface area (but tall) islands. Increasing the backing thickness and the island height both increase the overall abrasive disk thickness.

D. Heavy-Duty Abrasive Disks

The laminated heavy-duty disks that have raised islands coated with thick layers of abrasive material are typically thicker than the abrasive disks that only have monolayers of abrasive beads. The laminated backings can be constructed of multiple layers of different materials including polymers, metal and fiber mats. These backings can be quite thick. Also, the individual abrasive coated island structures can be substantial in height. The thickness of the disks measured from the island top surfaces to the bottom of the backing is precisely controlled over the whole annular abrasive band.

Durable and tough abrasive disks that are highly-resistant to impact-type abrading forces can be constructed from layers of metal, polymer, fiber, paper that are bonded together to form an integral abrasive disk composite backing and annular bands of raised island structures can be attached to the composite backing. These raised island structures can be ground-down to where each island structure has precisely the same height measured from the back, mounting surface of the disks. Abrasive slurry coating mixtures of abrasive particles or abrasive-particle filled abrasive beads and an adhesive can be coated on the top flat surfaces of the raised island structures to produce a raised island abrasive disk that has a precisely uniform disk thickness across the full abrading surface of the abrasive disk.

Very large diameter abrasive disks can be produced that have annular bands of abrasive coated raised islands. Arc-segments of different backing materials can be used to produce very-large diameter abrasive disks having disk diameters that range from 4 to 30 feet in diameter. Each layer of disk backing materials can be constructed from these arc segments where the arc segments cut-lines are radially staggered from each other to minimize the effects of arc segment cut-line of one material layer from affecting the structural strength of the laminated abrasive disk. Here, the staggered arc segments of a first material are bonded together with other-material arc segments that are off-set radially from the first arc segments in a disk lamination process.

These very large abrasive disks can be rolled-up and placed in hollow tubes for storage or shipping. Because of the construction features of these large abrasive disks, they are relatively light in weight and are easy to manually handle, install on abrading machines and remove them from the machines and place them in storage.

E. Abrasive Disk Uniform Wear-Down

It is also critical that the abrasive disk is worn-down uniformly across the abrasive surface to maintain the flatness of the disk over its full abrading life. When an abrasive disk wears down uniformly across that full annular area the precision thickness of the disk is maintained. This uniform wear-down of the abrasive is accomplished by matching the width of the disk annular radial width to the flat cross sectional size of the workpiece. Here the full annular width of the abrasive disk is contacted by the workpiece during an abrading operation to assure that abrasive experiences uniform wear.

XIX. Size of Island Disks

A. Typical Disk Size

The disks typically have a 12 inch diameter when small sized workpieces are lapped. The raised island abrasive is located in an annular band where the radial width of the annular band is approximately equal to the diameter (or size) of a workpiece. Large diameter abrasive disks are required for large diameter workpieces. For example, a 300 mm (12 inch) diameter semiconductor workpiece requires an abrasive disk that exceeds 48 inches or 4 feet to provide an annular abrasive band that is 12 inches wide. Having the abrasive disk central 24 inch diameter free of abrasive assures that the abrading surface speed of the abrasive at the inner diameter of the annular band is not substantially different than the abrading surface speed at the outer diameter. The closer the outer and inner diameters of the annular band are to each other, the rotational speed of the workpiece required to even-out the abrading speed across the abrasive annular band is reduced. It is desired to minimize the rotational speed of the workpieces to minimize balancing problems. Un-balanced workpieces rotating at great seeds can cause wobbling which results in non-flat lapped surfaces. It is practical to balance the workpieces which allows them to be rotated at high speeds without wobbling.

Some abrasive disks can be huge. For instance 144 inch (12 feet) diameter disks are the size of a small room. These disks can be used to flat lap 300 mm (12 inch) diameter semiconductors with a minimum rotational abrading speed differential from the inner to outer diameters of a rotating abrasive platen.

XX. Heavy Duty Raised Island Disks

A. Disks Replace Micro-Grinding Wheels

Abrasive systems using heavy-duty versions of flexible raised-island abrasive disks can be used to replace the micro-grinding (flat-honing) systems that use rigid metal abrasive-wheels. These heavy-duty flexible abrasive disks are used for aggressive workpiece material removal and for long-life abrading usage. The flexible disks have flat-surfaced raised-islands. Each island has thick layers of abrasive-bead material which allows long term usage of the disk before the disk abrasive wears out. Flexible heavy-duty disks can also have abrasive pellet islands that are attached to durable disk backings. The abrasive coated raised-islands are positioned in array patterns that form annular bands of abrasive around the circumference of the disks.

Quick changing of these heavy-duty disks allows fast set-up changes to be made to the abrading system. Vacuum is used to quickly attach these flexible raised-island disks to rigid flat-surfaced platens. Here, utilization of a wide range of abrasive particle sizes and abrasive particle materials (including diamond, CBN and aluminum oxide) can be made with ease. Rigid micro-grinding abrasive-wheels can not be quickly changed without great difficulty. In addition, the flexible heavy-duty disks are lightweight and easy to handle compared to the massive flat-surfaced heavy metal abrasive-wheels used in micro-grinding.

When changing a micro-grinder abrasive-wheel, localized abrasive surface distortions can occur when the abrasive-wheels are bolted on to platens. These surface distortions originate at the individual mounting-bolt areas and are caused by tightening the mounting bolts. Undesired planar-flatness distortions of only 0.0001 inches can affect the performance of an abrading surface when flat-lapping workpieces. The vacuum hold-down forces of the flexible heavy-duty raised-island disks are spread uniformly across the whole flat surface of the platen and these forces do not distort the platen surface.

Advantages of using these flexible heavy-duty disks include quick-change set-ups, high abrading speeds, low abrading pressures, high productivity, low workpiece polishing costs, great water cooling action, precision-flat and mirror-smooth workpieces (due to the very small particles in the abrasive beads). Because high abrading speeds are used with these heavy-duty raised island disks, the abrading contact forces are just a fraction of those used in micro-grinding. Instead of having "brute-force" workpiece material removal by slow-speed micro-grinding, the high-speed disks provide "delicate-force" abrading contact but also, high material removal rates. These lesser abrading forces result in smaller forces on the island structures. These smaller abrading forces allows flexible (but durable) backings to be used in place of the rigid metal abrasive-wheels used in the micro-grinding. Also, smaller abrading forces result in less subsurface damage of brittle workpieces.

B. Thick Abrasive Layers on Islands

The thick abrasive layers on the island flat top surfaces can be produced by a number of different methods. First, small diameter beads can be mixed with an adhesive and coated on the island tops where many layers of the small beads are stacked on top of each other. Second, very large sized abrasive beads can be coated in monolayers on the island tops. Third, vitrified abrasive island pellets can be adhesively bonded o to a flexible backing. The erodibility of these stacked ceramic abrasive beads is similar to the erodibility of the thick layers of abrasive particles contained in the vitrified abrasive pellets.

C. Abrasive Pellets Attached to Backings

Fused or vitrified flat-surfaced composite abrasive island pellets can be strongly bonded with adhesive to a flexible backing to produce flexible heavy-duty abrasive raised island disks. Open recessed-passageways are provided between each of the pellet island structures. These passageways provide channels for excess coolant water which prevents hydroplaning of the workpieces when the disks are rotated at high abrading speeds. Even though the individual vitrified abrasive pellets are rigid, the backing material located in the recessed areas between the individual island structures is flexible. Because the inter-island backing is flexible, the overall abrasive disk is flexible. Here, the flexible island disks will conform to the flat planar surface of rotary platens, which allows the disks to be robustly attached to the platens with vacuum.

To provide heavy-duty abrasive raised-island pellet disks having a planar abrasive surface that is precisely co-planar with the bottom mounting surface of the backing, special and simple production steps can be taken. First, if the top abrasive surfaces of the pellets are not sealed adequately to hold a vacuum, an adhesive tape can be applied to the top flat surface of each of the individual pellets. Second, the tape-covered pellet islands can be temporarily attached to the flat surface of a first precision-flat platen by vacuum. Individual pellet islands are positioned to have gaps between adjacent islands. They are also arranged to form annular abrasive bands on the platen. Third, a flexible backing can be attached to another precision-flat platen with vacuum. Fourth, an adhesive is applied to the bottom of the exposed surface of the individual pellet bases. Fifth, the first platen holding the pellets is positioned with gap spacers that provide a precision fixed distance from the first platen to the platen holding the backing. As the first pellet platen is lowered to rest on the spacers, the pellet-base adhesive contacts the backing surface. When, the adhesive solidifies, the first platen is then separated from the pellets by interrupting the vacuum, leaving the abrasive pellets attached to the backing with adhesive.

The top flat surface of all of the individual abrasive pellets is now precisely co-planar to the bottom mounting surface of the abrasive disk backing. The adhesive tape (if used) is removed from the pellet island surfaces to expose the pellet abrasive particles. The pellet-type heavy-duty raised-island abrasive disks produced here can be used interchangeably for high speed flat lapping. This is because the disk abrasive surfaces are precisely co-planar with the disk-backing platen-mounting surface. These heavy-duty raised-island abrasive disks have precision thicknesses with very small thickness variations across the whole annular abrading surface of the disk. The absolute thickness of the disks does not have to be constant as just the thickness uniformity is important for high-speed abrading.

D. Vitrified Abrasive Pellet Manufacturing

Both abrasive beads and vitrified pellets provide a porous erodible ceramic support for individual abrasive particles. The abrasive particles are mixed with metal oxide (ceramic precursor) particles and formed into abrasive shapes. Abrasive beads have spherical shapes. Abrasive pellets have flat surfaces with a variety of cross-sectional body shapes. Both the abrasive beads and the abrasive pellets are erodible. When the ceramic matrix material supporting the individual abrasive particles erodes away, worn particles are released and new sharp abrasive particles become exposed to continue the abrading action.

Both the abrasive beads and the vitrified abrasive pellets are processed in high temperature furnaces to convert the metal oxide into a ceramic. Other materials such as metals can also be used along with the metal oxides to produce the abrasive pellets. Modest furnace temperatures are used with the beads to provide a porous erodible ceramic matrix that rigidly supports individual abrasive particles. For vitrified pellet shapes, high furnace temperatures are used to melt the ceramic to form it into a solid glassy state (vitrified) upon cooling. In the pellets, individual abrasive particles are bonded together with strings of the melted and glassy ceramic material. The combination of the ceramic and abrasive particles form the vitrified abrasive pellets.

Because diamond particles break down thermally at high furnace temperatures in the presence of oxygen, the bead furnace temperatures are kept below 500° C. It is necessary to far exceed 500° C. to vitrify (melt or fuse) the ceramic when forming the abrasive pellets. To protect the diamond (pure carbon) particles from reacting with the oxygen and thermally degrading it at these high temperatures, special steps have to be taken. One alternative is to operate the furnace with an inert (non-oxygen) atmosphere, typically with the use of an enclosed retort furnace. This adds to the production expense and increases the complexity of the furnace operation. Another alternative is to plate a thin metal coating layer on the exterior surface of the individual diamond abrasive particles. This metal plating acts as a barrier that prevents high temperature ambient oxygen in the furnace from reacting with the diamond material. This step also adds to the complexity and expense of producing abrasive pellets.

The pellets can be constructed with thick layers of fused or vitrified abrasive particles that are attached to inert ceramic island-base materials. These composite abrasive pellets are bonded to the thick and strong but flexible disk backings.

E. Abrasive Disks Less Expensive than Abrasive Wheels

Flexible heavy-duty abrasive disks are much less expensive to produce than heavy micro-grinding flat surfaced rigid metal abrasive coated wheels.

A wide variety of these heavy-duty disks can be stocked by those performing lapping instead of having a large investment in single expensive abrasive-wheels that often are not changed for months of operation. Having the economic freedom to quickly change the type of abrasive or abrasive particles sizes is a huge advantage for those companies that provide lapping services to a wide range of customers.

F. Quick-Change Heavy-Duty Disks

The heavy-duty flexible disks are light weight and easy to handle for quick attachment to the flat platens. Even though the disks have high raised islands and thick backings, the disks are flexible. They also have a continuous and smooth surfaced backing. The flexible and smooth-backside abrasive disks can be quickly attached to flat-surfaced platens with the use of vacuum. The vacuum provides huge attachment forces that "structurally" bond the flexible abrasive disks to the rigid metal platens. These vacuum disk hold-down forces allow the flexible heavy-duty abrasive disks to become an integral part of the rigid platens. Because the disk backings are relatively thin and the islands are rigid, there is very little compressibility of the raised island abrasive disks. The top flat-abrasive surface of the precision-thickness disks automatically becomes co-planar with the precision flat rigid platen surface. Each time an abrasive disk is mounted on the platen, a precision-flat abrading surface is provided for contact with flat-surfaced workpieces.

Because the flexible abrasive disks protect the platen flat disk mounting surface from wear, the precision flat platen surfaces remain flat over long periods of time, even as the abrasive disk surfaces experience wear. The abrasive surface flatness of a disk abrading surface can be quickly reestablished simply by removing a defective disk and replacing it with a new (or previously used) flat-surfaced abrasive disk.

To assure that disks "remember" their abrasive surface planar flatness relative to a given platen, the disks can be marked on the outer periphery. This alignment disk-mark can be registered (aligned) with a corresponding permanent registration mark located on the outer periphery of the platen. The abrasive disk registration marks can be added at the initial installation of the disk on a platen or the disk marks can be incorporated as a feature on new disks. Positioning disks concentric with a platen is easy to accomplish visually because both the disks and the platens typically have the same diameters. Alignment of the disk and platen marks is also easy to accomplish by rotating the disk tangentially by hand prior to application of the disk hold-down vacuum. In this way, any out-of-plane defects of the platen surface are automatically compensated for, after a given disk is dressed-flat on that specific platen surface.

G. Avoid Platen Distortions

It is necessary to attach the heavy and rigid micro-grinding abrasive wheels to platens with threaded fastener bolts. When these bolts are tightened, distortion of the abrasive-wheel is unavoidable in the bolt-hole locations. These rigid-wheel bolt-hole distortions can spread structurally to the planar surface of the wheel abrasive. For high speed abrading, it is critical that the surface of the abrasive have a radial flatness variation of less than 0.0005 inches and a circumferential flatness variation of approximately 0.0005 inches, depending on the diameter of the platen and the platen rotational speed. Otherwise, the non-flat abrasive traveling at more than 10,000 SFM (100 mph) will only contact the workpieces at the abrasive "high-spot" areas. This non-flat abrading contact is highly undesirable. A reverse-analogy here is an auto traveling at high speeds over a washboard road (high-spot abrasive areas). The auto will be "floated-upward" by the continual excitation of the periodic bumps of the washboard road surface. Controlled stability of the auto is lost until the auto reaches a smooth road surface. It is preferred that the platen has a radial flatness of standard deviation of less than 0.0002 inches and a circumferential flatness variation standard deviation of slightly greater than 0.0002 inches. It is more preferred that both the radial and circumferential flatness standard deviation is less than 0.0001 inches The micro-grinding non-flat abrasive surfaces have to be abrasively conditioned after an abrasive-wheel is changed. This conditioning removes the high spots from the wheel abrasive surface. When the abrasive wheels are changed on a micro-grinding system, it is a long and laborious procedure. The rigid wheels are heavy and difficult to handle manually. Great care has to be exercised in tightening the wheel hold-down bolts so that the whole wheel body is joined to the platen body without distortion to the wheel body. This procedure is analogous to the careful bolt-tightening pattern procedures required for attaching the valve-head to the block of an automotive engine without distorting the head.

Part of the motivation to provide such thick abrasive layers on the abrasive wheels is the great difficulties present in changing the rigid abrasive wheels. None of these abrasive surface distortion concerns are present when a new flexible heavy-duty abrasive disk is attached to the surface of a flat platen. Here, the lightweight disk is simply laid by hand on the surface of the platen and vacuum is applied. The disk-attachment hold-down vacuum immediately bonds the disk to the rigid and precision-flat platen surface. The flexible disk becomes an integral part of the rigid and strong platen.

Because the vacuum attachment forces act uniformly across the full surface of the disk there are no localized distortion applied either to the platen or to the disks. This allows the heavy-duty flexible abrasive disks to be mounted repetitively on the platens. Each time a flexible disk is re-mounted on a platen, the abrasive regains its original precision planar abrasive surface that was already established with earlier use on the same platen. First-time conditioning-use of a raised island disk compensates for any out-of-plane flatness variations on the platen surface. These re-mounted disks can be used immediately to successfully abrade workpieces at the desired high abrading speeds.

H. Heavy-Duty Disk Construction

Very large diameter annular raised island disks can be ground in tangential segments by incrementally advancing the disk in tangential increments and grinding one disk arc segment at a time. After advancement, the raised island disk motion is paused to grind flat that advanced segment. The increment grinding process is repeated until the whole annular band of raised islands has been ground. Cylindrical wheel grinders or cup wheel grinders operating flat or with forward or backward tilt can be used to flat grind these tangential disk segments.

Air bearing or roller bearing platens and slides can provide sufficient accuracy to produce the required raised island structure disk thickness accuracy.

I. Reduced Subsurface Damage

The small abrading forces used in high-speed abrading with the heavy-duty flexible disks results in less subsurface damage of brittle workpieces than occurs with the high abrading force micro-grinding systems.

J. Heavy-Duty Disk Platens

The platens used with these heavy-duty raised island abrasive disks have a structurally and dimensionally stable construction so they remain precisely flat over long periods of time.

XXI. Workpiece Cooling with Islands

A. Coolant Used to Avoid Thermal Cracks

Sufficient water is applied to the workpiece and abrasive to provide surface cooling under the whole flat surface of the lapped workpiece. This water is used to remove the friction heat that was generated by the abrading action of the moving island abrasive. This friction heat can damage both the workpiece and the individual diamond abrasive particles. It is desirable to quickly remove the heat from a localized workpiece abraded area before it has a chance to "soak" into the depths of the workpiece. If a localized area of a workpiece is heated, the thermal expansion of the heated area tends to cause thermal stresses in the workpiece material. Ceramic materials are particularly susceptible to the thermal stress which can cause undesirable localized stress cracks.

B. Islands Carry and Spread Coolant Water

Water that is applied to the leading edge of a workpiece minimizes the coolant water velocity as it travels along with the high speed abrasive. This "stationary" water tends not to be driven into the wedge areas of the leading edge of the workpiece. Water that is applied to a continuous-coated abrasive surface upstream of the leading edge and moves at high speeds is driven into these wedges and causes hydroplaning or lifting of the workpiece.

Raised islands that contact the "stationary" bead of coolant water at the workpiece leading edge tends to "chew-off" a portion of water and push this portion along the flat workpiece abraded surface. The water clings to the flat abraded side of the workpiece rather than falling away from the surface. This clinging is due to surface tension and other liquid adhesion forces. Also, the curved or angled leading edge of the island "snowplows" the water portion off to the island-travel pathway sides as the island travels under the workpiece. The snowplowed water wakes wet the surface of the workpiece that had been abraded by a previous island that had preceded it on an adjacent travel-pathway. In this way, the coolant water is constantly spread or washed across the surface of the abraded workpiece surface by the island structures. Because the islands travel at such high speeds, the water coolant effects take place immediately after the friction heat was generated on the workpiece surface by a preceding abrasive island.

In addition, the coolant water has special heat transfer characteristics for cooling the cutting tips of diamond abrasive particles that can be heated to very temperatures by this friction heating. When the diamond cutting edges are heated to more than 212 F, the diamond edge-contacting coolant water vaporizes and provides huge cooling to the diamond due to the localized vaporization of the water. The high associated coefficients of heat transfer with this water-boiling effect maintains the diamond edge temperatures to much less than that which will degrade the sharp cutting edges of the individual diamond particles. Any steam produced is routed to the recessed channels between the raised islands which prevents the steam from lifting the workpiece away from the flat abrasive surface.

Double-Sided Floating Platen Systems

Double-sided slurry or micro-grinding (flat-honing) systems also use the approach where the upper floating platens contact equal-thickness workpieces. However, the workpieces are not independently supported by multiple rigid fixed-position spindle surfaces that are co-planar. Rather, both the floating double-sided upper platen and the rigid-supported lower abrasive platen are independently rotated with equal-thickness workpieces sandwiched between the two platens. Multiple flat-surfaced workpieces are spaced around the annular circumference of the lower platen and they are held in abrading contact with the lower platen abrading by the upper abrasive platen. Both opposed surfaces of the workpieces are simultaneously abraded by the concentric rotation of both the upper and lower platens. Workpieces are rotated during the abrading action to provide uniform wear on the workpiece surfaces even though the abrading speeds, and the corresponding workpiece material removal rates, are different at the inner and outer radii of the platen annular abrasive bands.

Both the upper and lower platen abrasive surfaces are continuously worn into non-planar conditions by abrading contact with the abraded workpieces sandwiched between them. In double-sided floating-platen abrading, the workpieces are held by gear-driven planetary workholder carrier disks that rotate the workpieces during the abrading action. These carrier disks must be thinner than the workpiece to avoid abrading contact of the carriers with the abrasive on both platens. Abrading forces are applied to these thin carriers by the rotating platen abrasive surfaces and portions of these abrading forces are also applied to the planetary carrier drive gears. These thin and fragile workpiece carriers, that are also sandwiched between the platens, can not be driven at high speeds by the carrier disk drive gears. Because of limitations of the workpiece carrier system, both double-sided slurry lapping and micro-grinding (flat-honing) systems operate at low abrading speeds. Double-sided slurry lapping typically has low abrading pressures but double-sided micro-grinding (flat honing) utilizes very high abrading pressures. The workpiece abrading pressures are applied by the upper platen. Because the workpiece abrading pressures of the double-sided micro-grinding (flat honing) system utilizes very high abrading pressures, the upper and lower platens must be strong enough to resists these pressures without distorting the platen planar abrading surfaces. As a result, these platens are typically very heavy in order to provide the required structurally stiff platen abrasive surfaces. Use of very heavy upper platens results in difficulty in accurately controlling the low workpiece abrading pressures desired for high speed flat-lapping.

CMP-Type Floating Spindle Systems

Some CMP abrading systems use multiple workpiece spindles that are attached to a common frame that is suspended above a flat-surfaced rotating platen. The platen is covered with a resilient abrasive pad. Wafers are attached to the individual spindles and then the frame is lowered to bring all of the individual spindle-rotated wafers into abrading contact with the pad as the pad is rotated by the platen. The dimensional amount that each wafer is plunged into the surface of the thin liquid abrasive slurry-coated resilient pad is not precisely controlled. Instead, the abrading force that the individual wafers are pressed into the pad is typically controlled by the mechanisms that apply forces to the individual spindles. Penetration of the flat-surfaced wafer body into the pad surfaces also varies by the localized stiffness of the resilient pad. This pad stiffness changes during the CMP process as the abrasive slurry builds up a crusty solidified deposit coating on the pad. This crusty surface is broken up periodically by use of an abrasive-particle coated conditioning ring that is held in force contact with the moving pad.

There is no critical precision static or dynamic machine component co-planar surface requirement present for these CMP platens because the floating individual wafers are forced into the surface-depths of the resilient abrasive pad as the pad is rotated. Likewise, there is no critical requirement for the alignment of the flat abraded-surfaces of each of the individual spindle-mounted wafer to be located precisely in a common plane. This lack of co-planar alignment criteria occurs partially because of the wide positional tolerance of the wafer spindles allowed by penetration of the wafer surface into the surface-depth of the pad. Further, there is no requirement that the surfaces of the individual wafers be precisely co-planar with the flat surface of the rotating platen, again partially because of the wide wafer surface positional tolerance allowed by penetration of the wafer surface into the surface-depth of the pad. These co-planar spindle surface alignments are not necessary because each of the spindles is independently moved along its rotation axis. By simply controlling the applied abrading pressure at each workpiece spindle, the spindles are allowed to move freely along their rotation axes to provide the desired abrading pressure, independent of the movement of the other adjacent workpiece spindles.

There is a distinct difference in the technologies used by the floating-spindle CMP abrading system and the fixed-spindle floating-platen abrading system. The CMP abrading system is a distributed-spindle pressure-controlled axial-motion workpiece spindle system. It is not a rigid non-movement workpiece spindle system like the fixed-spindle-floating platen abrading system. This CMP abrading system can not perform the precision workpiece abrading functions that the fixed-spindle-floating platen abrading system can because the CMP system does not have the precision fixed-position rigid planar surface abrading system. CMP abrading consists only of removing a layer of material from an already-flat workpiece surface by polishing action. It does not establish a planar flat surface on a workpiece. Rather, it just provides a surface-polishing action. However, the fixed-spindle-floating platen abrading system can establish a planar flat surface on a workpiece even if the workpiece has a non-flat surface when the abrading action is initiated. Both systems use rigid platens. The CMP platen is rigid but the flat abrasive pad that is attached to the rigid platen is resilient. The CMP workpieces are not in abrading contact with a rigid abrasive surface; the workpieces are in abrading contact with a resilient pad abrasive surface.

Slurry Lapping

Conventional liquid abrasive slurry can also be used with this fixed-spindle floating-platen abrading system by attaching a disposable flat-surfaced metal, or non-metal, plate to the rigid platen surface and applying a coating of a liquid loose-abrasive slurry to the exposed flat surface of the plate. The platen slurry plate can be periodically re-conditioned by attaching equal-thickness abrasive disks to the rotating workpiece spindles and holding the rotating platen in abrading contact with the spindle abrasive disks. Here again, the primary planar reference surface even for the platen is the granite surface planar surface.

There are still many improvements in this area of technology that can be made according to practices and enabling apparatus, systems and methods described herein. All references cited in this specification are incorporated by reference in their entirety.

SUMMARY OF THE INVENTION

The presently disclosed technology includes a fixed-spindle, floating-platen system which is a new configuration of a single-sided lapping machine system. High-precision, large-diameter air bearing flat-surfaced rotary spindles are mounted on two-piece spherical spindle mounts that are attached to a dimensionally-stable machine base. These machine bases are typically granite or epoxy-granite. Three of the spindles are used to provide three-point support of flat-surfaced rotary platens that have attached raised-island abrasive disks. The two-piece spherical spindle mounts allow the top flat surfaces of the three spindle-tops to be aligned co-planar to each other where all of the spindle-tops lie in a precision-flat plane that supports the platen that floats in contact with workpieces that are attached to the flat surface s of the spindle-tops. Both the spindles and the platen are rotated to flat-lap abrade the flat surfaces of the workpieces. Because of the spherical-pivot capability of the two-piece spindle mounts, it is not necessary to use expensive granite bases that have precision-flat spindle-mounting surfaces. After the spindle-tops are precisely aligned to be co-planar with each other, the two-pieced spindle mount devices are locked together to maintain this co-planar spindle-top alignment for long periods of time due to the structural rigidity and dimensional-stability of the granite base.

This system is capable of producing ultra-flat thin semiconductor wafer workpieces at high abrading speeds. This can be done by providing a dimensionally-stable, rigid (e.g., synthetic, composite or granite) machine base that the three-point rigid fixed-position workpiece spindles are mounted on. Flexible abrasive disks having annular bands of abrasive-coated raised islands may be attached to a rigid flat-surfaced rotary platen that floats in three-point abrading contact with the three equal-spaced flat-surfaced rotatable workpiece spindles. Use of a platen vacuum disk attachment system allows quick set-up changes where different sizes of abrasive particles and different types of abrasive material can be quickly attached to the flat platen surfaces.

Water coolant is preferably used with these raised island abrasive disks, which allows them to be used at very high abrading speeds, often in excess of 10,000 SFM. The coolant water can be applied directly to the top surfaces of the workpieces or the coolant water can be applied through aperture holes at the center of the abrasive disk or through aperture holes at other locations on the abrasive disk. The applied coolant water results in abrading debris being continually flushed from the abraded surface of the workpieces. Here, when the water-carried debris falls off the spindle top surfaces it is not carried along by the platen to contaminate and scratch the adjacent high-value workpieces, a process condition that occurs in double-sided abrading.

The fixed-spindle-floating-platen system is easy to use, is flexible for abrasive selection set-ups, handles a wide range of types of abrading, is a clean process, produces ultra-flat and ultra-smooth finishes, handles thin workpieces, can be fully automated for changing workpieces and can be fully automated for changing abrasive disks to provide quick-changes of types and sizes of abrasive particles. The different types of abrading range from high-speed water-cooled flat-lapping to liquid slurry lapping, CMP polishing with liquid slurries and resilient pads, fixed-abrasive CMP polishing, and abrading with thick layers of abrasive pellets attached to thick disk backings. This system provides new wide range of abrading capabilities that can not be achieved by other conventional abrading systems.

This fixed-spindle, floating-platen system is particularly suited for precision flat-lapping or surface polishing large diameter semiconductor wafers. High-value large-sized workpieces such as 12 inch diameter (300 mm) semiconductor wafers can be attached to ultra-precise flat-surfaced 12 inch diameter air bearing spindles for precision lapping.

In these systems, the lower platen of a double-sided platen abrading system having workpieces sandwiched between a floating upper platen and a lower rigidly mounted platen is replaced with a three-point fixed-spindle upper floating platen support system. Instead of the upper floating platen being conformably supported by equal-thickness flat workpieces that are supported by flat-surfaced contact with the flat surface of the lower platen, the upper floating platen is supported by contacting equal-thickness flat workpieces that are supported by flat-surfaced contact with the flat surfaces of the three rigidly mounted rotatable spindles. The equally-spaced workpiece spindles provide stable support for the floating upper platen.

This new floating platen abrading system is a single-sided abrading system as compared to the double-sided floating platen abrading system. Only the top surfaces of the workpieces are abraded as compared to both sides of workpieces being abraded simultaneously with the double-sided abrading system. The single-sided fixed-spindle-floating-platen system can abrade thin workpieces and produce ultra-flat abraded surfaces that are superior in flatness produced by conventional double-sided abrading. This flatness performance advantage occurs because the individual workpieces are supported by the precision-flat surfaces of the air bearing spindles rather than by the worn-down abrading surfaces of the bottom platen in a double-sided abrading system.

The systems of supporting the floating upper platen with the three-point rigid mounted precision-flat air bearing spindles provide a floating platen support system that is has a planar flatness that is equivalent to or flatter than that provided by a conventional rigid mounted lower platen. The air bearing spindles used here have precision flat surfaces that provide surface variations that are often more than one order of magnitude flatter than conventional abrading platen surfaces, even when the spindles are rotated at large speeds. Most conventional platen abrasive surfaces have original-condition flatness tolerances of 0.0001 inches (100 millionths) that typically wear down into a non-flat condition during abrading operations to approximately 0.0006 inch variation across the radial width of an annular abrasive band before they are reconditioned to re-establish the original flatness variation of 0.0001 inches. By comparison, the typical flatness of a precision air bearing spindle is less than 5 millionths of an inch. The air bearing spindles have large 12 inch diameter flat surfaces and are able to support 12 inch (300 mm) diameter workpieces such as semiconductor wafers with little spindle-top deflections due to abrading forces. The spindle stiffness of air bearings often exceeds the stiffness of mechanical roller bearing spindles. Workpieces are typically attached to or with equal-thickness carrier plates that are lapped precisely flat where both of the carrier plate flat surfaces are precisely parallel to each other. These precision carriers provide assurance that the independent workpieces that are mounted on the three spindles have workpiece surfaces that are precisely co-planar with each other.

The top flat surfaces of the equal-height spindles must be co-planar with each other. Each of the three rigid spindles is positioned with equal spacing between them to form a triangle of platen spindle-support locations. The rotational-centers of each of the spindles are positioned on the granite so that they are located at the radial center of the annular width of the precision-flat abrading platen surface. Equal-thickness flat-surfaced workpieces are attached to the flat-surfaced tops of each of the spindles. The rigid rotating floating-platen abrasive surface contacts the workpieces attached to all three rotating spindle-tops to perform single-sided abrading on the exposed surfaces of the workpieces. The fixed-spindle-floating platen system can be used at high abrading speeds to produce precision-flat and mirror-smooth workpieces at very high production rates. There is no abrasive wear of the platen surface because it is protected by the attached flexible abrasive disks.

The multiple workpieces are in abrading contact with the abrasive disk that is attached to a floating rotary platen precision-flat annular abrading-surface. Mounting equal-thickness workpieces on the three spindles provides support for the platen where the platen abrading surface assumes a co-planar location with the common plane of the spindle surfaces. As all the workpieces are simultaneously abraded, they become thinner but retain an equal thickness.

This fixed-spindle-floating-platen system is uniquely capable of providing precision flat lapping of workpieces using rigid lapping machine components at high abrading speeds and high productivity. Because all of the machine components are rigid (including the floating platen), it is required that each abrading machine component that is directly active in the abrading process has a precision-flat characteristic. Then, when all of these components are used together, they provide uniform abrading to the surfaces of spindle-mounted workpieces that are simultaneously contacted by a platen planar abrading surface. It is particularly important that all of the individual workpiece surfaces active in the abrading operation are individually and collectively co-planar with each other. Here, even the raised-island abrasive disks have a uniform precision-thickness over the full annular abrading surface of the disk. This results in both the abrasive surface of the disk and the opposite disk-backing mounting surface being precisely co-planar with each other.

In addition, the flexible raised-island abrasive disks having thin and flexible backings are rigid in a direction that is perpendicular to the disk flat abrading surface. An analogy here is a flexible piece of sheet metal that can be easily flexed out-of-plane but yet provides rigid and stiff load-carrying support for flat-surfaced components that are placed in flat-faced contact with the sheet metal flat surface. Vacuum-attached abrasive disks are flexible so they will conform to the flat surfaces of the platens. The raised-island abrasive disks are constructed from thin but structurally-stiff backing materials and the island structures are also constructed from structurally-stiff construction materials to assure that the abrasive coated island disks are not resilient. The abrasive disks do not experience harmful distortions due to the controlled abrading forces that are applied to the disks.

The platen abrasive disks typically have annular bands of fixed-abrasive coated rigid raised-island structures. There is insignificant elastic distortion of the individual raised islands or of the whole thickness of the raised island abrasive disks when they are subjected to typical abrading pressures. These abrasive disks must also be precisely uniform in thickness across the full annular abrading surface of the disk to assure that full-surface abrading takes place over the full flat surface of the workpieces located on the tops of each of the three spindles.

There are no resilient or complaint component members n this abrading system that would allow forgiveness of out-of-dimensional-tolerance variations of other of the system components. For example, there is no substantial structural compliance of the platen-mounted abrasive disks to compensate for spindle-to-spindle workpiece surface positional variations. The precision-flat platen abrasive surface must be precisely co-planar with the top exposed surfaces of all three of the rigid-spindle workpieces to provide workpieces that are abraded precisely flat when using these non-resilient abrasive disks. Further, the rigid granite base that the rigid spindles are mounted on does not deflect or elastically distort when the spindles are subjected to typical abrading forces. Likewise, the air bearing workpiece spindles are also extremely stiff and the spindle rotating spindle-tops do not experience significant deflection when subjected to the typical abrading forces. The whole fixed-spindle-floating platen system is extremely rigid, but also, has many component surfaces that are precisely co-planar with other of the system component surfaces.

In the present system having flat workpiece surfaces positioned horizontally, there is no vertical movement of the workpiece wafer mounted on one rigid spindle relative to the position of any wafer mounted on any of the other fixed-position rotary workpiece rigid spindles. During abrading action, both the workpieces and the abrasive platens are rotated simultaneously. Once a floating platen "assumes" a position as it rests conformably upon and is supported by the three spindles, the planar abrasive surface of the platen retains this platen alignment even as the floating platen is rotated. The three-point spindles are located with equal spacing between them circumferentially in alignment with the centerline of the platen annular abrasive.

The controlled abrading pressure applied by the abrasive platen to three individual same-sized and equal-thickness workpieces that are attached to the three spindle-tops is evenly distributed to the three workpieces because the controlled applied abrading force is equally distributed to the three-point platen supporting spindles. All three equal-sized workpieces experience the same shared platen-imposed abrading forces and abrading pressures. Semiconductors wafer workpieces can then be lapped where precision-flat and smoothly polished wafer surfaces can be simultaneously produced at all three spindle stations by the fixed-spindle-floating platen abrading system.

Very thin workpieces can be attached to the rotatable spindles by vacuum or other attachment means. These workpieces can be very much thinner than the workpieces that are held by planetary workholders in a double-sided flat-honing (micro-grinding) dual-platen abrading system. To provide abrading of the opposite side of the workpiece, it is removed from the spindle, flipped over and abraded with the floating platen. This is a simple two-step procedure. Here, the rotating spindles provide a workpiece surface that remains co-planar with the co-planar spindle-top reference surface and the two-step production of workpieces having two opposing non-planar surfaces is avoided. Non-planar workpiece surfaces are often produced by single-sided lapping operations that do not use fixed-position rigid-mounted rotary workpiece spindles that have spindle-top flat surfaces that are precisely co-planar with each other.

A minimum of three evenly-spaced spindles are used to obtain the three-point support of the upper floating platen by contacting the spaced workpieces. However, many more spindles can be used where all of the spindle workpieces are in mutual flat abrading contact with the rotating platen abrasive.

This three-point fixed-spindle-floating-platen abrading system can also be used for chemical mechanical planarization (CMP) abrading of semiconductor wafers using liquid abrasive slurry mixtures with resilient backed pads attached to the floating platen. These wafers are repetitively abraded on one surface after new semiconductor features are deposited on that surface. This polishing removes undesired surface protuberances from the wafer surface. The system can also be used with CMP-type fixed-abrasive shallow-island abrasive disks that are backed with resilient support pads. These shallow-island abrasives can either be mold-formed on the surface of flexible backings or the shallow-island abrasive disks can be coated or printed on disk backings using gravure printers, off-set printers, flexo-graphic printers that use flexible polymer printing plates having raised-island printing features, or other printing or coating techniques. The abrasive material typically used for the CMP disks often includes ceria which can be applied as a slurry mixture of ceria particles mixed with a liquid. Also, spherical beads of ceria that are deposited to form abrasive-island features on a backing can be used. In addition, ceria abrasive-like material can consist of deposited island features of ceria abrasive beads in a slurry mixture of adhesive.

This system can also provide slurry lapping by attaching a disposable flat-surfaced metal, or non-metal, plate to the rigid platen abrading-surface and applying a coating of liquid loose-abrasive particle slurry to the exposed flat surface of the plate. The platen slurry plate can be periodically re-conditioned by attaching equal-thickness abrasive disks to the rotating workpiece spindles and holding the rotating platen in abrading contact with the spindle abrasive disks. Here again, the primary planar reference surface even for the system is the co-planar flat surfaces of the three spindle-tops.

The system can also be used to recondition the surface of the abrasive on the abrasive disk that us attached to the platen abrading surface. This abrasive surface of the abrasive disk tends to experience uneven wear across the radial surface of the annular abrasive band after continued abrading contact with the workpieces that are attached to the three spindle-tops. When the non-even wear of the abrasive surface becomes excessive and the abrasive can no longer provide precision-flat workpiece surfaces it must be reconditioned to re-establish its planar flatness. Reconditioning the platen-mounted abrasive disk abrasive surface can be easily accomplished with this system by attaching equal-thickness abrasive disks to the flat surfaces of the spindle-tops in place of the workpieces. Here, the abrasive disk abrasive surface reconditioning takes place by rotating the spindle-top abrasive disks while they are in flat-surfaced abrading contact with the rotating abrasive surface of the abrasive disks that are attached to the platen abrading-surface annular band.

Workpieces comprising semiconductor wafers can be easily processed with a fully automated easy-to-operate process that is very practical. Here, individual wafer carriers can be changed on all three spindles with a robotic arm extending through a convenient gap-opening between two adjacent stand-alone rotary workpiece spindles.

Also, an automated robotic loader device can be used to change abrasive disks on a rotary platen.

The system has the capability to resist large mechanical abrading forces present with abrading processes with unprecedented flatness accuracies and minimum mechanical aberrations. Because the system is comprised of robust components it has a long lifetime with little maintenance even in the harsh abrading environment present with most abrading processes. Air bearing spindles are not prone to failure or degradation and provide a flexible system that is quickly adapted to different polishing processes.

There is no wear of the platen surface because the abrasive is not in abrading contact with the platen. Each time an abrasive disk is attached to a platen, the non-worn platen provides the same precision-flat planar abrading-surface for the new or changed precision-thickness abrasive disk.

BRIEF DESCRIPTION OF THE DRAWINGS

FIG. 41 is an isometric view of fixed-abrasive raised islands on an annular abrasive disk.

FIG. 42 is an isometric view of a fixed-abrasive coated raised island annular abrasive disk.

FIG. 43 is an isometric view of a solid-layer fixed-abrasive annular disk.

DETAILED DESCRIPTION OF THE INVENTION

Figure 1:
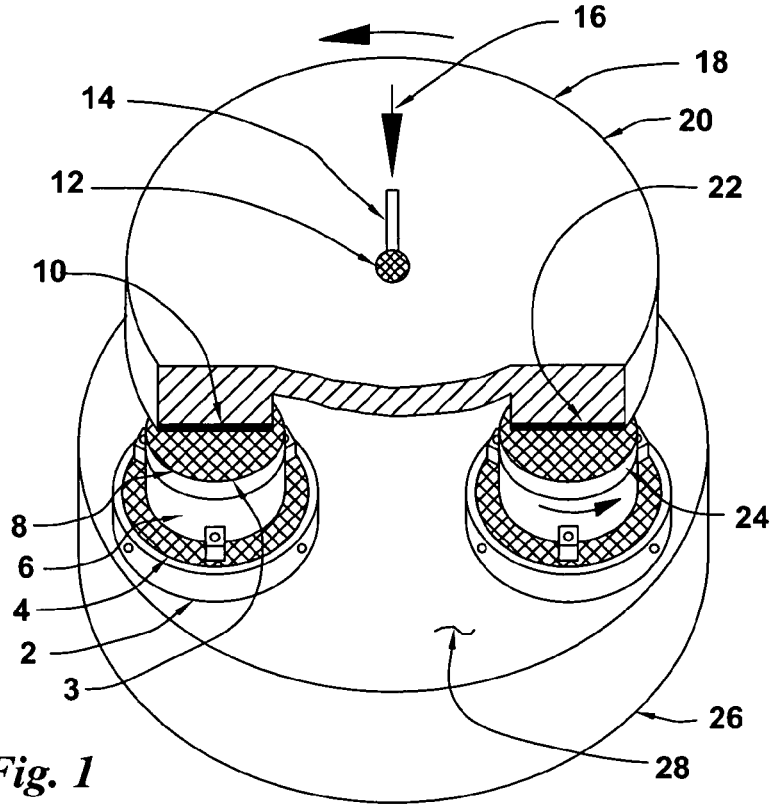
FIG. 1 is an isometric view of three-point spindles supporting a floating abrasive platen.

FIG. 1 is an isometric view of an abrading system 20 having three-point fixed-position rotating workpiece spindles supporting a floating rotating abrasive platen. Three evenly-spaced rotatable spherical-base mounted spindles 6 (one not shown) having rotating tops 24 that have attached workpieces 8 support a floating abrasive platen 18. The rotary spindles 6 are attached to spherical base rotors 4 that are mounted in spherical bases 2 where the spherical rotors 4 can have spherical rotation action when mounted in the spherical bases 2. The spindles 6 spherical bases 2 are attached to the nominally-flat surface 28 of the granite or epoxy-granite machine base 26. The platen 18 has a vacuum, or other, abrasive disk attachment device (not shown) that is used to attach an annular abrasive disk 22 to the precision-flat platen 18 abrasive-disk mounting surface 10. The abrasive disk 22 is in flat abrasive surface contact with all three of the workpieces 8. The rotating floating platen 18 is driven through a spherical-action universal joint type of device 12 having a platen drive shaft 14 to which is applied an abrasive contact force 16 to control the abrading pressure applied to the workpieces 8. The three workpiece rotary spindles 6 have approximate-equal-heights which allows alignment of the flat top surfaces 3 of the three spindles 6 spindle-tops 24 to be co-planar and results in the co-planar surfaces of all of the flat-surfaced rotary workpiece spindles 6 spindle-tops 24 to be approximately co-planar with the nominally-flat surface 28 of the granite base 26. Here, the equal-thickness workpieces 8 are in the same plane and are abraded uniformly across each workpiece 8 surface by the platen 18 precision-flat planar abrasive disk 22 abrading surface. The planar abrading surface 10 of the floating platen 18 is approximately co-planar with the nominally-flat surface 28 of the granite base 26.

The spindles 6 rotating spindle-tops 24 can driven by different techniques comprising spindle 6 internal spindle shafts (not shown), external spindle 6 flexible drive belts (not shown), drive-wires (not shown) and spindle 6 internal drive motors (not shown). The spindle 6 spindle-tops 24 can be driven independently in both rotation directions and at a wide range of rotation speeds including very high speeds. Typically the spindles 6 are air bearing spindles that provide precision flat surfaces, near-equal heights, are very stiff to maintain high rigidity against abrading forces, have very low friction and can operate at very high rotational speeds. The spindles 6 can also use precision roller bearings that allow the spindle-tops 24 to rotate.

Abrasive disks (not shown) or other abrasive deices (not shown) can be attached to the spindle 6 spindle-tops 24 to abrade the platen 18 flat surface 10 by rotating the spindle-tops 24 while the platen 18 flat surface 10 is positioned in abrading contact with the spindle abrasive disks or other spindle-top 24 disk abrasive devices that are rotated in selected directions and at selected rotational speeds when the platen 18 is rotated at selected speeds and selected rotation directions when applying a controlled abrading force 16. The top flat surfaces 3 of the individual three-point spindle 6 rotating spindle-tops 24 can also be abraded by the platen 18 planar abrasive disk 22 by placing the platen 18 and the abrasive disk 22 in flat conformal contact with the spindle-tops 24 flat surfaces 3 of the rotary workpiece spindles 6 as both the platen 18 and the spindle-tops 24 are rotated in selected directions when a controlled abrading pressure force 16 is applied. The abrading force 16 is evenly distributed to the three spindles 6 spindle-tops 24 because of the three point support of the platen 18 by the three spindles 6 that are evenly spaced from each other around the circumference of the platen 18. The top surfaces 3 of the spindles 6 spindle-tops 24 are abraded by the abrasive disk 22 that is attached to the platen 18 results in all of the spindles 6 spindle-tops 24 top surfaces 3 being in a common plane.

The granite base 26 provides a time-stable nominally-flat surface 28 to which the precision-flat three-point spindles 6 can be mounted by use of the spherical base 2. The unique capability provided by this abrading system 20 is that the primary datum-reference is the fixed-position co-planar spindle-tops 24 flat surfaces 3. The spindles 6 spindle-tops 24 can be aligned to be mutually co-planar with each other without adjusting the heights of the individual spindles 6 because all the spindles 6 can rotate by spherical motion of the spherical rotors 4, after which the spherical rotors 4 can be attached to the spherical bases 2 with fasteners (not shown). The spindles 6 spindle-tops 24 co-planar alignment can be done with alignment devices (not shown) or even the planar flat abrading-surface 10 of the platen 18 can be placed in contact with the spindle-tops 24 to establish the co-planar alignment of the spindle-tops 24.

The abrading system can provide extremely flat rotary spindle 6 spindle-top 24 workpiece mounting surfaces 3 and extremely flat platen 18 abrading surfaces 10. The extreme flatness accuracy of the abrading system 20 provides the capability of abrading ultra-thin and large-diameter and high-value workpieces 8, such as semiconductor wafers, at very high abrading speeds. Also, the workpieces 8 and the abrasive disks 22 can be loaded and unloaded into the abrading system 20 by using fully automated robotic devices (not shown).

In addition, the system 20 can provide unprecedented system 20 machine component flatness and workpiece abrading accuracy by using the abrading system 20 to "abrasively dress" other of these same abrading machine system 20 critical components such as the spindle tops 24 and the platen 18 planar-surface 10. These precision-abraded spindle top 24 and the platen 18 planar surface 10 components can be assembled into a new abrading system 20 and it can be used to progressively bring other abrading system 20 critical components comprising the spindle tops 24 and the platen 18 planar abrading-surface 10 into a higher state of operational flatness perfection than existed when the initial abrading system 20 was initially assembled. This abrading system 20 self-dressing process is simple, easy to do and can be done as often as desired to reestablish ultra-precision flatness of the abrading system 20 critical components or to improve their flatness for specific high-precision abrading operations.

This single-sided abrading system 20 self-enhancement surface-flattening process is unique among conventional floating-platen abrasive systems. Other abrading systems use floating platens but these systems are double-sided abrading systems. These other systems comprise slurry lapping and micro-grinding (flat-honing) that have rigid bearing-supported rotated lower abrasive coated platens that have equal-thickness flat-surfaced workpieces in flat contact with the annular abrasive surfaces of the lower platens. The floating upper platen annular abrasive surface is in abrading contact with these multiple workpieces where these multiple workpieces support the upper floating platen as it is rotated. The result is that the floating platens of these other floating platen systems are supported by a single-item moving-reference device, the rotating lower platen.

Large diameter rotating lower platens that are typically used for double-sided slurry lapping and micro-grinding (flat-honing) typically have substantial abrasive-surface out-of-plane variations. These undesired abrading surface variations are due to many causes comprising: relatively compliant (non-stiff) platen support bearings that transmit or magnify bearing dimension variations to the outboard tangential abrading surfaces of the lower platen abrasive surface; radial and tangential out-of-plane variations in the large platen surface; time-dependent platen material creep distortions; abrading machine operating-temperature variations that result in expansion or shrinkage distortion of the lower platen surface; and the constant wear-down of the lower platen abrading surface by abrading contact with the workpieces that are in moving abrading contact with the lower platen abrasive surface. The single-sided abrading system 20 described here is completely different than the other double-sided system (not-shown).

The fixed-spindle, floating platen 18 abrading system 20 performance is based on supporting a floating abrasive platen 18 on the top surfaces 3 of three-point spaced fixed-position rotary workpiece spindles 6 that are mounted on a stable machine base 26 flat surface 28 where the top surfaces 3 of the spindles 6 spindle-tops 24 are precisely located in a common plane. Also, the top surfaces 3 of the spindles 6 are typically approximately co-planar with the nominally-flat surface 28 of a rigid fixed-position granite, epoxy-granite or other material, base 26. The three-point support is required to provide a stable support for the floating platen 18 as rigid components, in general, only contact each other at three points.

This three-point workpiece spindle abrading system 20 can also be used for abrasive slurry lapping (not shown), for micro-grinding (flat-honing) (not shown) and also for chemical mechanical planarization (CMP) (not shown) abrading to provide ultra-flat abraded workpieces 8.

Figure 2:
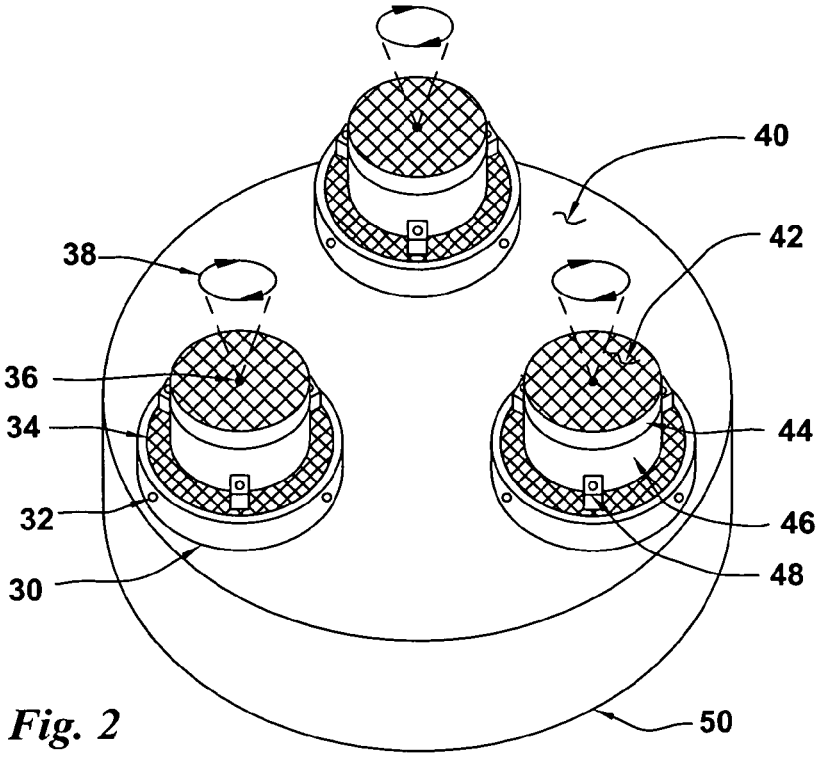
FIG. 2 is an isometric view of three-point fixed-position spindles mounted on a granite base.

FIG. 2 is an isometric view of three-point fixed-position spindles mounted on a granite base. A granite base 50 has a nominally-flat top surface 40 that supports three attached workpiece spindles 46 that have rotatable driven spindle-tops 44 where flat-surfaced workpieces 42 are attached to the flat-surfaced spindle-tops 44. The spindles 46 have attached spindle legs 48 that allow the spindles 46 to be attached to spherical rotors 34 that are mounted in spherical-action bases 30 having matching spherical diameters to the respective spherical rotors 34 where the spherical rotors 34 can be attached to the spherical-action bases 30 with fasteners 32 after co-planar alignment of the flat surfaces of the spindle-tops 44. The spindle-tops 44 have a center of rotation 36 and the spherical rotor 34 allows the spindle 46 to have spherical rotation as shown by 38. The spherical bases 30 are attached to the nominally-flat surface 40 of the machine base 50.

Figure 3:
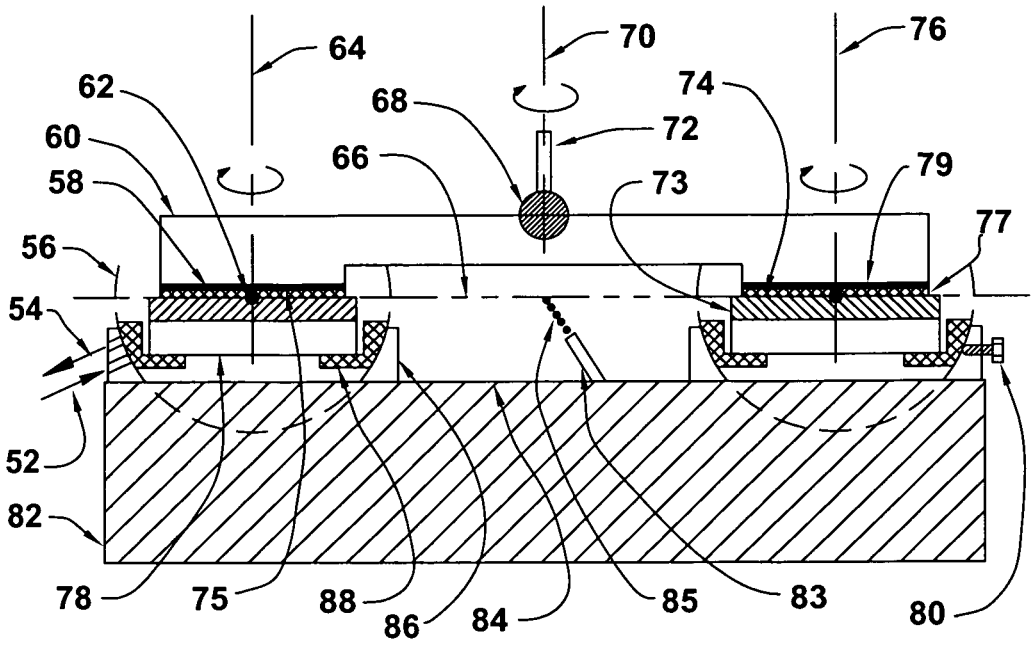
FIG. 3 is a cross section view of three-point spindles supporting a floating abrasive platen.

FIG. 3 is a cross section view of three-point fixed-position spindles supporting a rotating floating abrasive platen. A floating circular platen 60 has a spherical-action rotating drive mechanism 68 having a drive shaft 72 where the platen 60 rotates about an axis 70. Three workpiece spindles 78 (one not shown) having rotatable spindle-tops 73 that have flat top surfaces 74 are mounted to the top nominally-flat surface 84 of a machine base 82 that is constructed from granite, epoxy-granite, metal or composite or other materials. The flat top surfaces of the spindle-tops 73 are all in a common plane 66 where the spindle plane 66 is approximately co-planar with the top flat surface 84 of the nominally-flat machine base 82. Equal-thickness flat-surfaced workpieces 77 are attached to the spindle-top 73 flat surfaces 74 by a vacuum, or other, disk attachment device where the top surfaces of the three workpieces 77 are mutually contacted by the abrading surface 75 of an annular abrasive disk 79 that is attached to the platen 60. The platen 60 disk attachment abrading-surface 58 is precisely flat and the precision-thickness abrasive disk 79 annular abrasive surface 75 is precisely co-planar with the platen 60 disk attachment abrading surface 58. The annular abrasive surface 75 is precisely co-planar with the flat top surfaces of each of the three independent spindle-top 73 flat surfaces 74 and also, co-planar with the spindle plane 66. The floating platen 60 is supported by the three equally-spaced spindles 78 where the flat disk attachment abrading surface 58 of the platen 60 is approximately co-planar with the top surface 84 of the nominally-flat machine base 82.

The three equally-spaced spindles 78 of the three-point set of spindles 78 provide stable support to the floating platen 60. The spherical platen 60 drive mechanism 68 restrains the platen 60 in a circular platen 60 radial direction. The spindle-tops 73 are driven (not shown) in either clockwise or counterclockwise directions with rotation axes 64 and 76 that are at the spindle-tops 73 rotation centers 62 while the rotating platen 60 is also driven. Typically, the spindle-tops 73 are driven in the same rotation direction as the platen 60. The workpiece spindle 78 tops 73 can be rotationally driven by motors (not shown) that are an integral part of the spindles 78 or the tops 73 can be driven by internal spindle shafts (not shown) that extend through the bottom mounting surface of the spindles 78 and into or through the granite machine base 82 or the spindles 78 can be driven by external drive belts (not shown).

The spindles 78 are attached to spherical rotors 88 that are mounted in a spherical base 86 where pressurized air or a liquid 62 can allow the spherical rotor 88 to float in the spherical base 86 when the spindle-tops 73 are aligned to be co-planar in a common plane 66 after which vacuum 54 can be applied to lock the spherical rotor 88 to the spherical base 86 and fasteners 80 can be used to attach the spherical rotor 88 to the spherical base 86. The spherical rotor 88 and the spherical base 86 have a common spherical diameter 56. A water jet device 83 applies coolant water 85 to the abrading surface 75 of an annular abrasive disk 79 that is attached to the platen 60.

Figure 4:
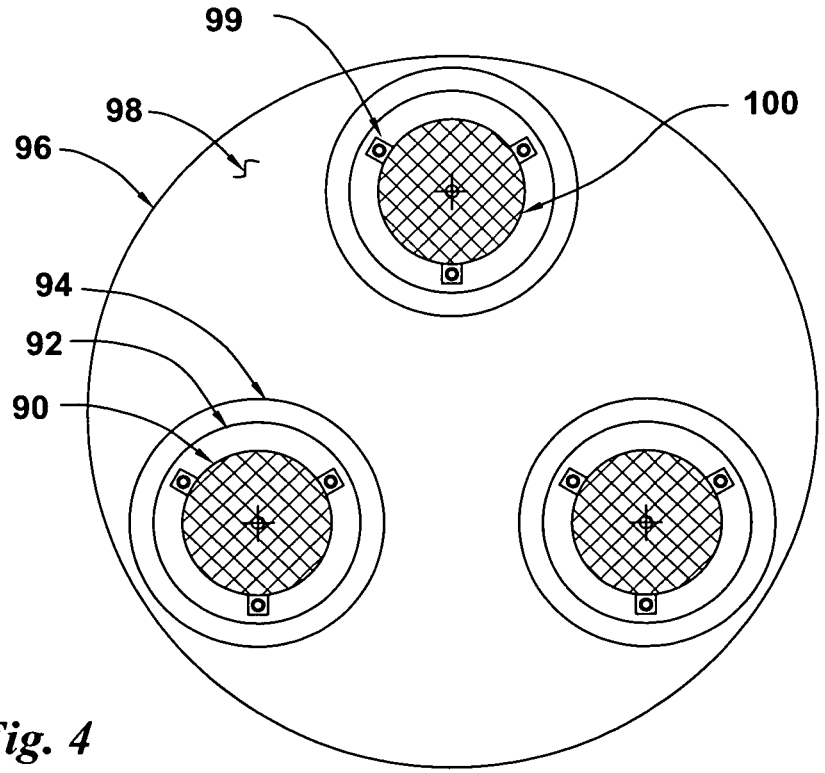
FIG. 4 is a top view of three-point spindles mounted on a machine base.

FIG. 4 is a top view of three-point spindles mounted on a machine base. Rotary spindles 90 having flat surfaced spindle-tops 100 are attached to spherical rotors 92 that are mounted in spherical spindle bases 94 that are attached to the top nominally-flat surface 98 of a granite or epoxy-granite base 96. Each spindle 90 has three spindle legs 99 that allow attachment of the spindles 90 to the spherical spindle rotors 92 that can be locked to the spherical spindle bases 96.

Figure 5:
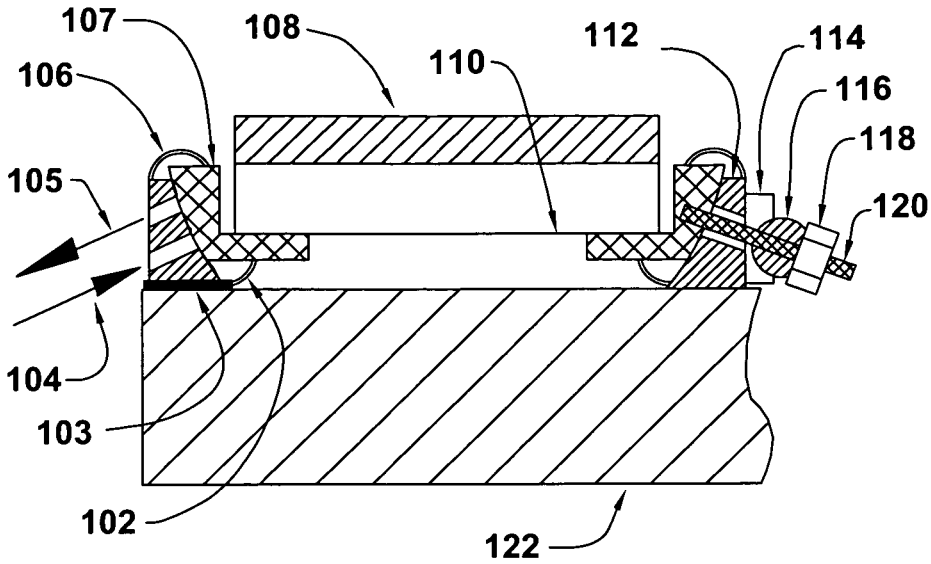
FIG. 5 is a cross-section view of a spindle mounted on a spherical-pivot mount.

FIG. 5 is a cross-section view of a spindle mounted on a spherical-pivot mount that is attached to a granite base. A rotary spindle 108 having a flat bottom surface 110 is mounted on a swivel rotor 107 that is mounted in a spherical spindle base 112 where pressurized air or a liquid 104 can allow the spherical rotor 107 to float in the spherical base 112 when the spindle 108 spindle-top is aligned to be co-planar in a common plane with other spindles 108 (not shown) spindle-tops after which vacuum 105 can be applied to lock the spherical rotor 107 to the spherical base 112 and fasteners 120 can be used to attach the spherical rotor 107 to the spherical base 112. The spherical rotor 107 and the spherical base 112 have a mutually-common spherical diameter. The threaded fasteners 120 positioned around the circumference of the spherical base 112 have a tightening nut 118 that presses against a spherical-shaped washer 116 that is seated in a spherical block 114 that presses against the spherical base 112 which prevents nut 118 tightening forces from tilting the spherical rotor where the fastener 120 is attached to the spherical rotor 107. A shim 103 can be positioned between the spherical base 112 and the granite machine base 122 to height-adjust the spherical base 112 relative to the surface of the machine base 122. An upper flexible abrading debris or water guard 106 and a lower upper flexible abrading debris or water guard 102 prevents debris or water from entering the circumferential upper and lower spherical joint between the spherical rotor 107 and the spherical base 112.

Figure 6:
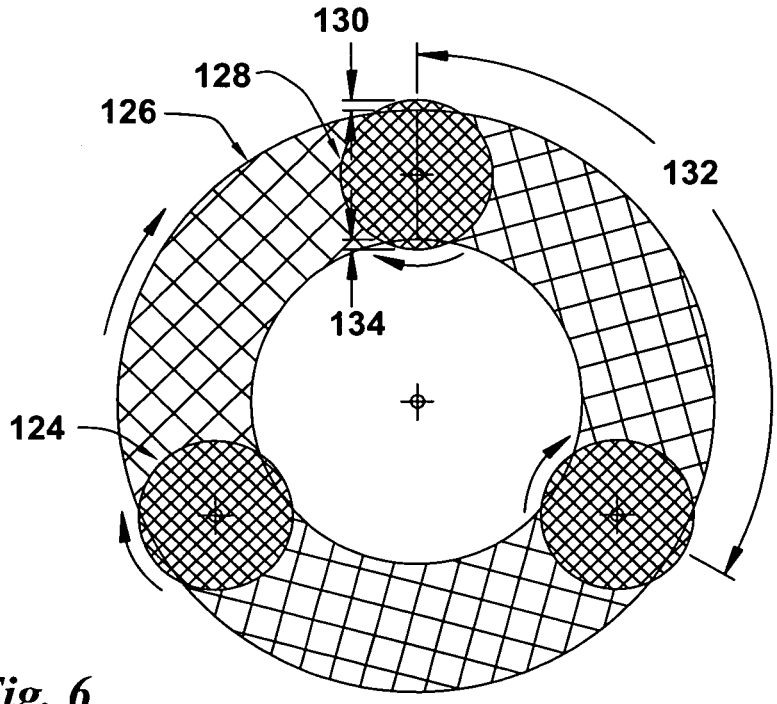
FIG. 6 is a top view of three-point spindles workpieces contacting annular band of abrasive.

FIG. 6 is a cross section view of workpieces in three-point spindles in abrading contact with an annular band of abrasive. Workpieces 128 are attached to three rotatable spindles 124 where the workpieces 128 are in abrading contact with an annular band of abrasive 126 where the workpieces 128 overhang the outer periphery of the abrasive 126 by a distance 130 and overhang the inner periphery of the abrasive 126 by a distance 134. Each of the near-equal spaced three spindles 124 are shown separated by an angle 132 of approximately 120 degrees to provide three-point support of the rotating platen (not shown) having an annular band of abrasive 126.

Figure 7:
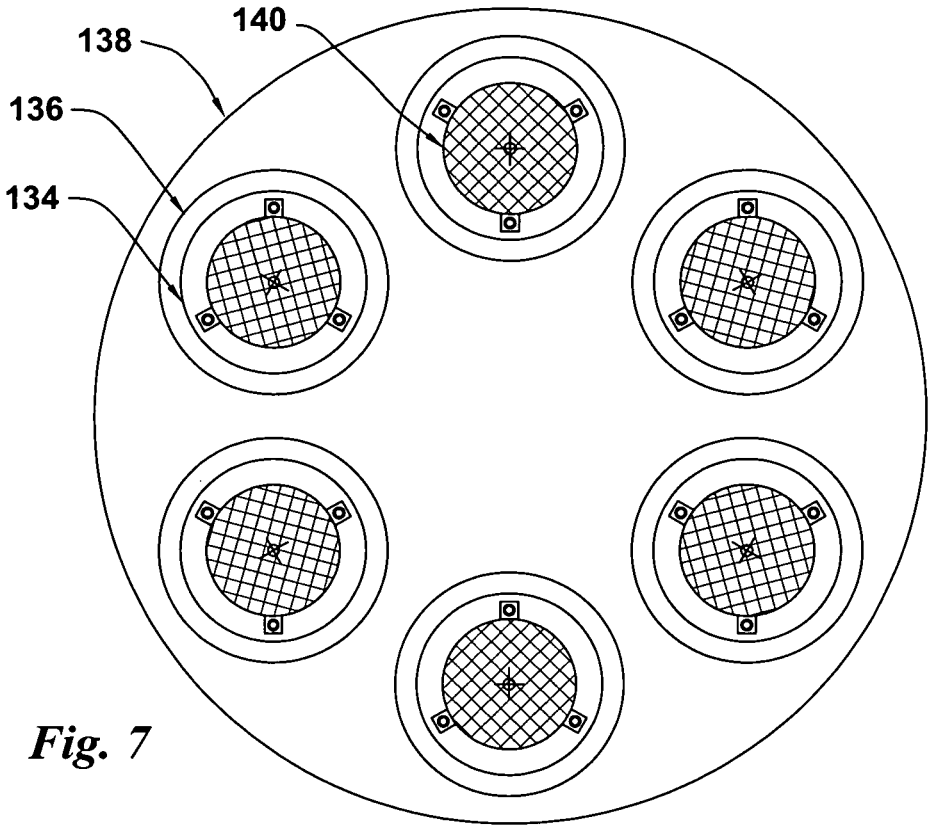
FIG. 7 is a top view of multiple rotary spindles mounted on a machine base.

FIG. 7 is a top view of multiple rotary spindles mounted on a machine base. Six rotary spindles 140 are shown attached to a spherical rotor 134 that is mounted in a spherical base 136 that is attached to the flat surface of a machine base 138.

Figure 8:
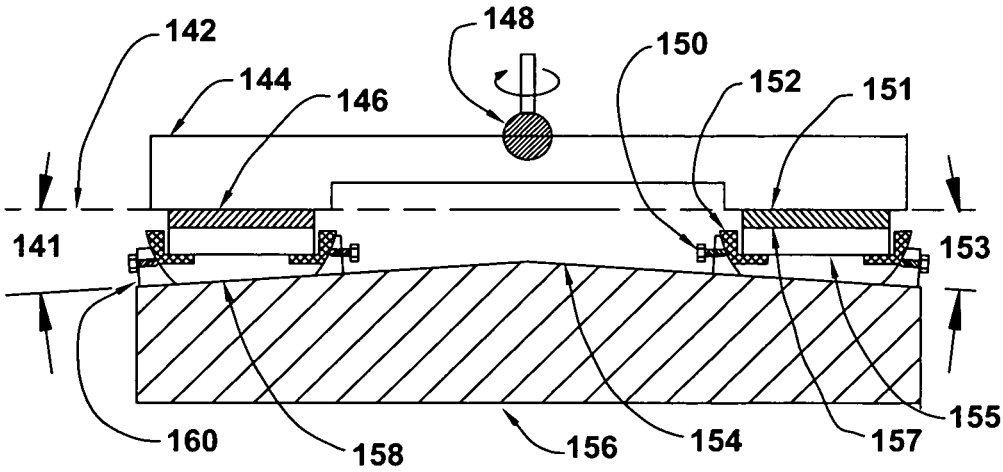
FIG. 8 is a cross section view of spherical-base mounted spindles supporting a floating abrasive platen.

FIG. 8 is a cross section view of spherical-base mounted spindles supporting a floating abrasive platen. Two rotary spindles 155 having rotary spindle-tops 157 are shown supporting a rotary platen 144 having a platen 144 flat abrading-surface 146 where the spindle-tops 157 abrading surfaces 146 are precisely co-planar with each other. Another spindle 155 (not shown) and the two shown spindles 155 form a three-point support of the platen 144 where all three spindles 155 have near-equal spaces between them. The rotating floating platen 144 is driven through a spherical-action universal-joint type of device 148.

The rotary spindles 155 are attached to spherical base rotors 152 that are mounted in spherical bases 160 where the spherical rotors 152 can have spherical rotation action when mounted in the spherical bases 160. The spherical rotors 152 are attached to the spherical bases 160 with fasteners 150. The spindles 155 spherical bases 160 are attached to the angled surfaces 154 and 158 of the granite or epoxy-granite machine base 156. The three workpiece rotary spindles 155 have approximate-equal-heights which allows alignment of the flat top surfaces 146 of the three spindles 155 spindle-tops 157 to be precisely co-planar and results in the co-planar surfaces 146 of all of the flat-surfaced rotary workpiece spindles 155 spindle-tops 157 to be approximately co-planar with the angled surfaces 154 and 158 of the granite base 156. The abrading surface 151 of the floating platen 144 shares a common plane 142 with the co-planar surfaces 146 of the spindle-tops 157 and the abrading surface 151 of the floating platen 144 and the abrading surface 151 of the floating platen 144 is approximately co-planar with the nominally-flat or angled surfaces 154 and 158 of the granite base 156. Here the angled surface 154 of the machine base 156 has an angle 153 with the common plane 142 where the angle 153 is a shallow angle and the angle 141 of the angled surface 158 is also a shallow angle where the overall machine base 156 has a nominally-flat surface. The machine base 156 surface angles 141 and 153 are shown as large angles here to illustrate the difference between a standard-flat and a precision-flat surface of machine bases 156.

Figure 9:
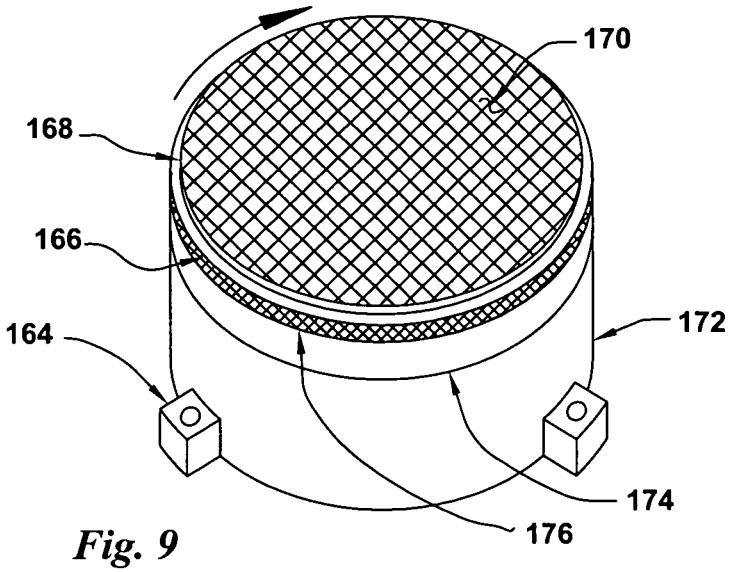
FIG. 9 is an isometric view of a workpiece spindle having three-point mounting legs.

FIG. 9 is an isometric view of a workpiece spindle having three-point mounting legs. The workpiece rotary spindle 172 has a rotary top 174 that has a precision-flat surface 176 to which is attached a precision-flat vacuum chuck device 166 that has co-planar opposed flat surfaces. A flat-surfaced workpiece 168 has an exposed flat surface 170 that is abraded by an abrasive coated platen (not shown). The workpiece spindle 172 is three-point supported by spindle legs 164. The workpiece 168 shown here has a diameter of 12 inches (300 mm) and is supported by a spindle 172 having a 12 inch (300 mm) diameter and a rotary top 174 top flat surface 176 that has a diameter of 12 inches (300 mm).

Figure 10:
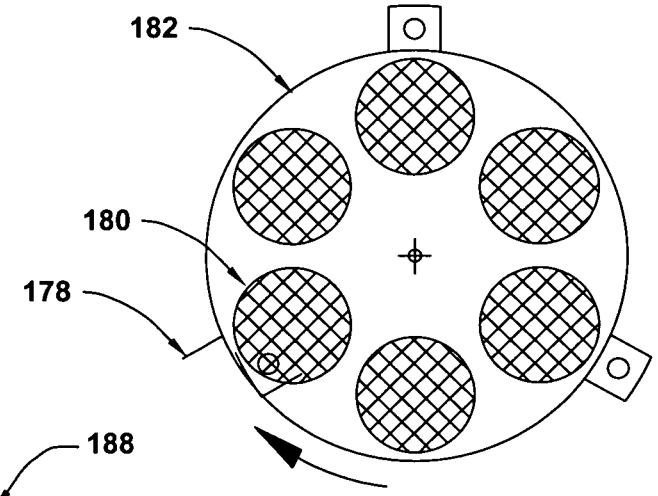
FIG. 10 is a top view of a workpiece spindle having multiple circular workpieces.

FIG. 10 is a top view of a workpiece spindle having multiple circular workpieces. A workpiece rotary spindle 182 having three-point support legs 178 where the spindle 182 supports small circular flat-surfaced workpieces 180 that are abraded by an abrasive coated platen (not shown).

Figure 11:
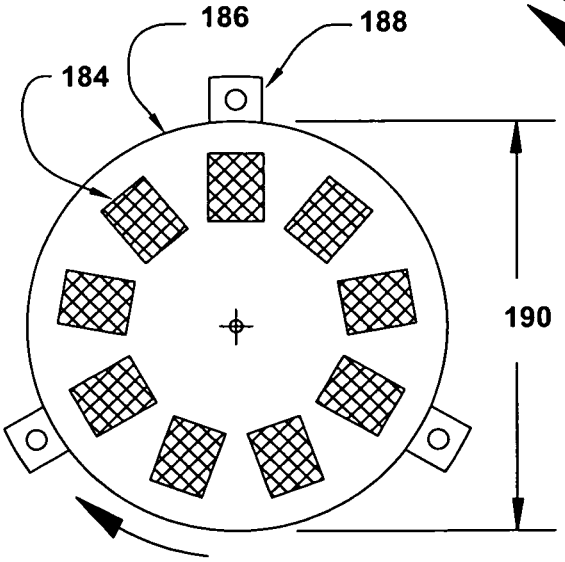
FIG. 11 is a top view of a workpiece spindle having multiple rectangular workpieces.

FIG. 11 is a top view of a workpiece spindle having multiple rectangular workpieces. A workpiece rotary spindle 186 having three-point support legs 188 where the spindle 186 supports small circular flat-surfaced workpieces 184 that are abraded by an abrasive coated platen (not shown). The spindle 186 has a spindle diameter 190.

Figure 12:
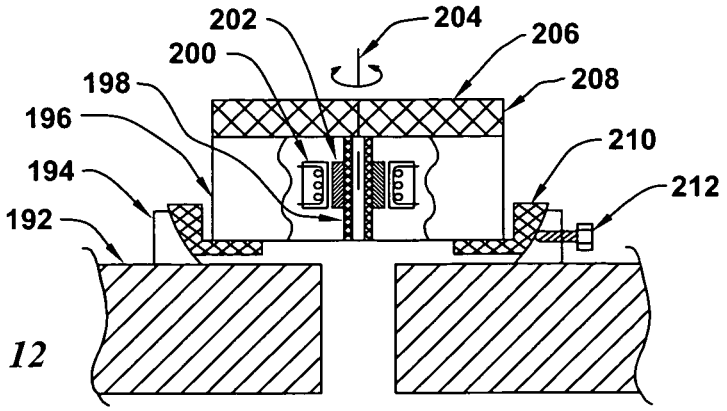
FIG. 12 is a cross section view of a workpiece spindle driven by an internal motor.

FIG. 12 is a cross section view of a workpiece spindle driven by an internal motor. A rotary spindle 196 having a spindle-top 208 has a flat surface 206 where the spindle-top 208 is rotated about a spindle axis 204. The spindle 196 is attached to a spherical rotor 210 that is mounted in a spherical base 194 that is attached to the machine base 192. A fastener 212 locks the spherical rotor 210 to the spherical base 194. The spindle-top 208 is driven by a hollow shaft 198 that is driven by a motor armature 202 that is driven by an internal motor electrical winding 200.

Figure 13:
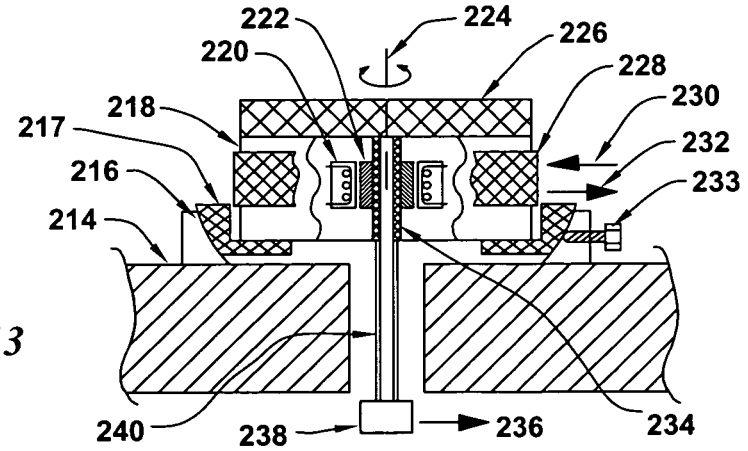
FIG. 13 is a cross section view of a workpiece spindle driven by a cooled internal motor.

FIG. 13 is a cross section view of a workpiece spindle driven by a cooled internal motor. A spindle 218 has a flat-surfaced rotary spindle-top 226 where the spindle-top 226 is rotated about a spindle axis 224. The spindle 218 is attached to a spherical rotor 217 that is mounted in a spherical base 216 that is attached to the machine base 214. A fastener 233 locks the spherical rotor 217 to the spherical base 216. The spindle-top 226 is driven by a hollow shaft 234 that is driven by a motor armature 222 that is driven by an internal motor electrical winding 220. The spindle-top 226 hollow drive shaft 234 has an attached hollow shaft 240 that has an attached to a stationary rotary union 238 that is coupled to a vacuum source 236 that supplies vacuum to the spindle-top 226. A water jacket 228 is shown wrapped around the spindle 218 body where the water jacket 228 has temperature-controlled coolant inlet water 230 that enters the water jacket 228 and exits the water jacket 228 as exit water 232 where the inlet water 230 cools the spindle 218 to remove the heat generated by the motor electrical windings 220 to prevent thermal distortion of the spindle 218 and thermal displacement of the spindle-top 226.

Figure 14:
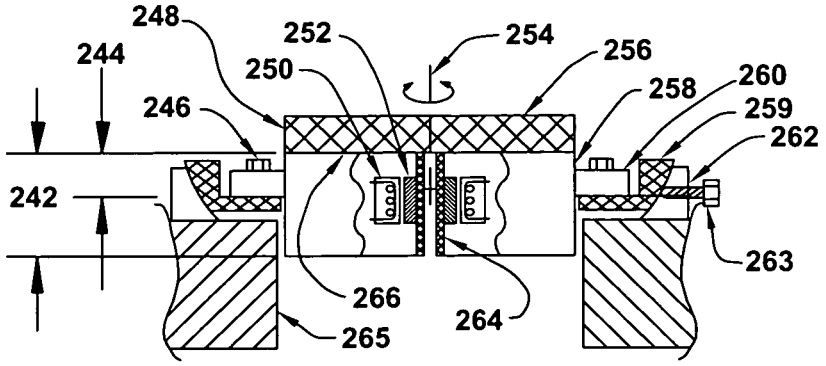
FIG. 14 is a cross section view of a recessed workpiece spindle driven by an internal motor.

FIG. 14 is a cross section view of a recessed workpiece spindle driven by an internal motor. A rotary workpiece air bearing spindle 258 is mounted on a machine base 265 with spindle legs 260 that are attached to the spindle 258 body. The spindle 258 has a flat-surfaced spindle-top 248 that rotates about a spindle axis 254 where the spindle-top 248 has a flat top surface 256. The spindle-top 248 has a hollow spindle shaft 264 that is driven by an internal motor armature 252 that is driven by an electrical motor winding 250. The spindle 258 is recessed into the machine base 265 because the spindle 258 support legs 260 are attached to the spindle 258 body near the top of the spindle 258.

The spindle 258 is attached to a spherical rotor 259 that is mounted in a spherical base 262 that is attached to the machine base 265.

Here, the separation-line 266 between the spindle-top 248 and the spindle 258 body is a close distance 244 from the spindle 258 mounting surface of the machine base 265. Because the distance 244 is short, heat from the motor electrical winding 250 that tends to thermally expand the length of the spindle 258 is minimized and the there is little thermally-induced vertical movement of the spindle-top 248 due to the motor heat. Also, the pressurized air that is supplied to the air bearing spindle 258 expands as it travels through the spindle 258 which lowers the temperature of the spindle air. This cool spindle air exits the spindle body at the separation line 266 where it cools the spindle 258 internally and at the interface between the spindle-top 248 and the spindle 258 which reduces the thermal-expansion effects from the heat generated by the electrical internal motor windings 250. Thermal growth in the length 242 of the spindles 258 tends to be equal for all three spindles 258 used in the fixed-spindle floating platen abrading systems (not shown). Any spindle 258 thermal distortion effects are uniform across all of the system spindles 258 and there is little affect on the abrading process because the floating abrasive platen simply contacts all of these same-expanded spindles 258 in a three-point contact stance. When the spindles 258 are mounted where the bottom of the spindle 258 extends below the surface of the machine base 265 the effect of the thermal growth of the spindles 258 along the spindle length is diminished.

This uniform thermal expansion and contraction of air bearing spindles occurs on all of the air bearing spindles mounted on all of the granite machine bases when each of individual spindles are mounted with the same methods on the bases. The spindles can be mounted on spindle legs attached to the bottom of the spindles or the spindles can be mounted to legs that are attached to the upper portion of the spindle bodies and the length expansion or shrinkage of all of the spindles will be the same. This insures that precision abrading can be achieved with these fixed-spindle floating-platen abrading systems.

Figure 15:
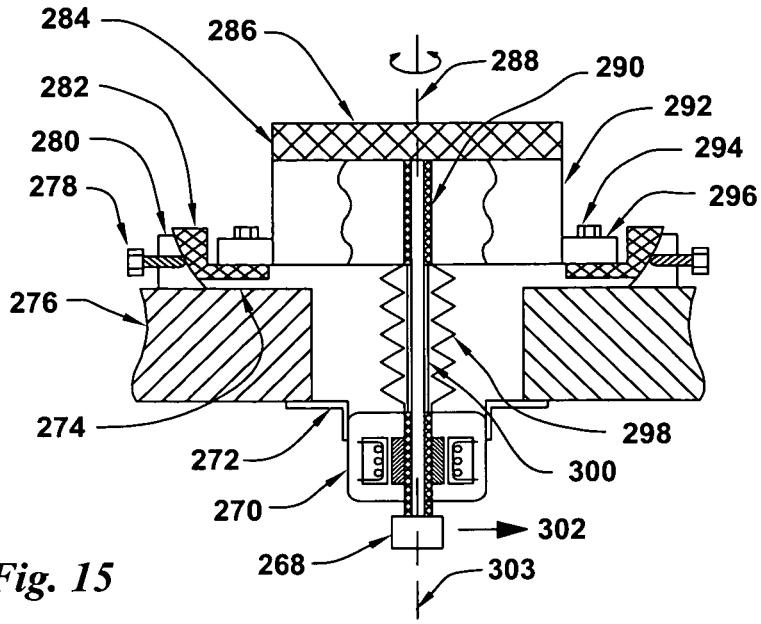
FIG. 15 is a cross section view of a workpiece spindle driven by an external motor.

FIG. 15 is a cross section view of a workpiece rotary spindle driven by an external motor. A spindle 292 having a spindle-top 284, having a flat top surface 286, that rotates about a spindle axis 288 is attached to a spherical rotor 282 by fasteners 294 that attach the spindle 292 spindle legs 296 to the spherical rotor 282 that is mounted in a spherical base 280 that is attached to the machine base 276. Fasteners 278 lock the spherical rotor 282 to the spherical base 280. An external motor 270 drives the spindle-top 284 with a bellows-type drive coupler 298 that allows slight misalignments between the motor 270 rotation axis 303 and the spindle-top 284 axis of rotation 288. The bellows-type coupler 298 provides stiff torsional load capabilities for accelerating or decelerating the rotary spindle-top 284. A stationary rotary union device 268 supplies vacuum 302 to the spindle-top 284 flat top surface 286 through a flexible tube 300 and a spindle-top 284 hollow drive shaft 290. The motor 270 is attached to the machine base 276 with motor brackets 272.

Figure 16:
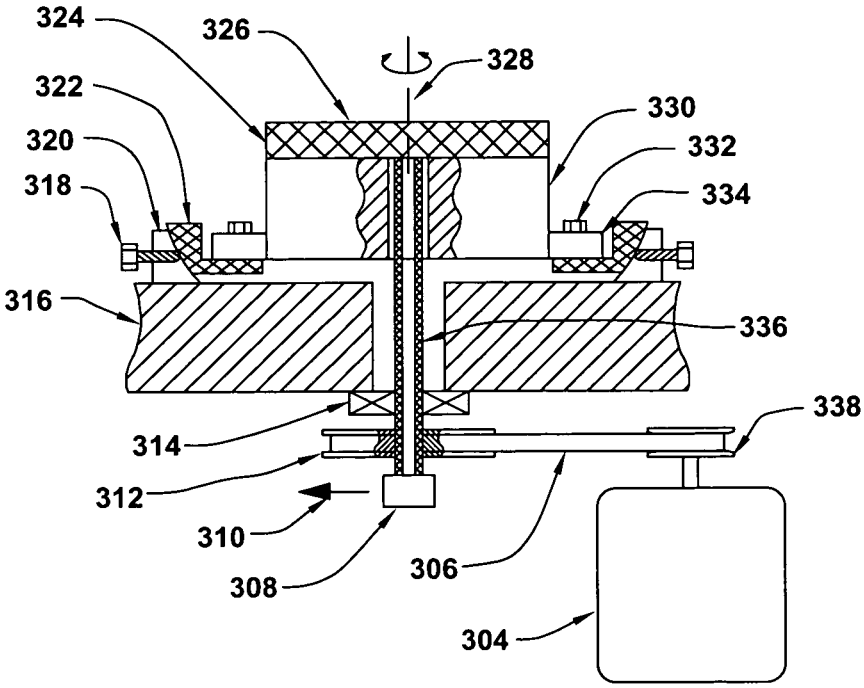
FIG. 16 is a cross section view of a workpiece spindle belt-driven by an external motor.

FIG. 16 is a cross section view of a workpiece spindle belt-driven by an external motor. A spindle 330 having a spindle-top 324, having a flat top surface 326, that rotates about a spindle axis 328 is attached to a spherical rotor 322 by fasteners 332 that attach the spindle 330 spindle legs 334 to the spherical rotor 322 that is mounted in a spherical base 320 that is attached to the machine base 316. Fasteners 318 lock the spherical rotor 322 to the spherical base 320. An external motor 304 drives the spindle-top 324 with a hollow drive shaft 336 that is supported by a bearing 314 that is attached to the machine base 316. The drive shaft 336 has a drive pulley 312 that is driven by a drive-belt 306 that is driven by a motor 304 drive pulley 338 that is attached to the drive motor 304. A stationary rotary union device 308 supplies vacuum 310 to the spindle-top 324 through the hollow drive shaft 336.

Figure 17:
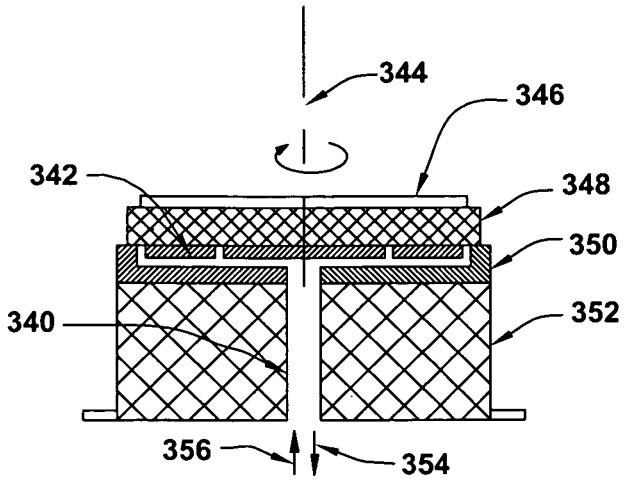
FIG. 17 is a cross section view of a workpiece spindle with vacuum carrier attachment.

FIG. 17 is a cross section view of a workpiece spindle with vacuum carrier attachment. A workpiece rotary spindle 352 has a flat-surfaced rotary spindle-top 350 that rotates about an axis 344. A workpiece flat-surfaced carrier 348 is precisely uniform in thickness and both surfaces of the lapped carrier 348 are precisely co-planar to assure that workpieces 346 that are attached to the carrier 348 rotate with the top surface of the workpiece 346 precisely co-planar with the workpiece rotary spindle 352 spindle-top 350 surface. Vacuum 354 is applied to the spindle 352 spindle-top 350 through a spindle 352 center passageway 340 connected to spindle-top 350 passageways 342 to attach the workpiece carrier 348 to the rotating spindle 352 spindle-top 350. Air pressure 356 can also be applied to the spindle 352 spindle-top 350 through the spindle 352 center passageway 340 connected to spindle-top 350 passageways 342 to aid in separating the workpiece carrier 348 from the rotating spindle 352 spindle-top 350. The vacuum 354 and the air pressure 356 are supplied through a rotary union (not shown) that is attached to the spindle 352 hollow drive shaft (not shown). Likewise vacuum and air pressure can be supplied through a multi-port rotary union (not shown) to the workpiece carrier 348 to attach and detach the workpieces 346 to and from the workpiece carrier 348.

Figure 18:
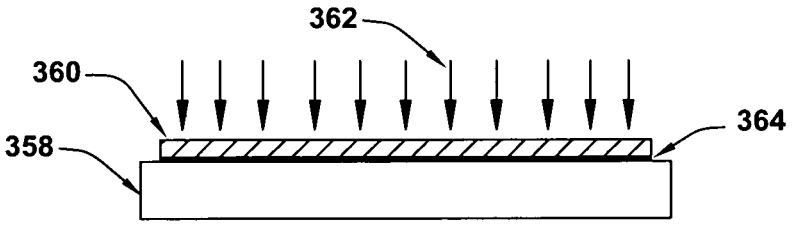
Fig. 18 Prior Art
FIG. 18 is a cross section view of a workpiece attached to a workpiece carrier.

FIG. 18 is a cross section view of a workpiece attached to a workpiece carrier. A flat-surfaced workpiece 360 carrier plate 358 is coated with a film 364 comprising a liquid water or polymer or air and a uniform pressure 362 is applied to the upper flat surface of the workpiece 360 to force the workpiece 360 conformably against the flat surface of the carrier plate 358 to adhesively-bond or suction-bond the workpiece 360 temporarily to the workpiece 360 carrier plate 358.

Figure 19:
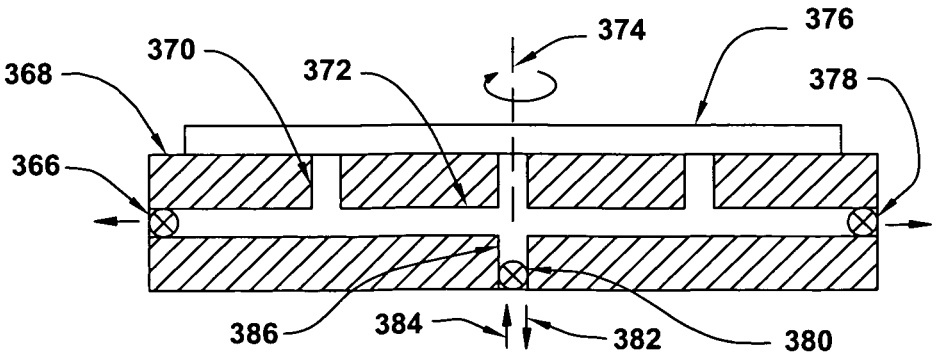
FIG. 19 is a cross section view of a workpiece vacuum-pressure workpiece carrier.

FIG. 19 is a cross section view of a workpiece vacuum-pressure workpiece carrier. A workpiece flat-surfaced carrier plate 368 is precisely uniform in thickness and both surfaces of the lapped carrier plate 368 are precisely co-planar to assure that workpieces 376 that are attached to the rotating carrier plate 368 rotate with the top surface of the workpiece precisely co-planar with the workpiece spindle top surface (not shown). Vacuum 382 is supplied through a valve 380 controlled passageway 386 connected to passageways 370 and 372 to attach the workpiece 376 in flat surface contact with the carrier plate 368. The carrier plate 368 rotates about an axis 374. Air pressure 384 can also be applied to the carrier plate 368 through the passageways 372, 370 and 386 to aid in separating the workpieces 376 from the carrier plate 368. Air pressure 384 or vacuum 382 can be supplied to the carrier plate 368 through valves 380, 378 or 366.

Figure 20:
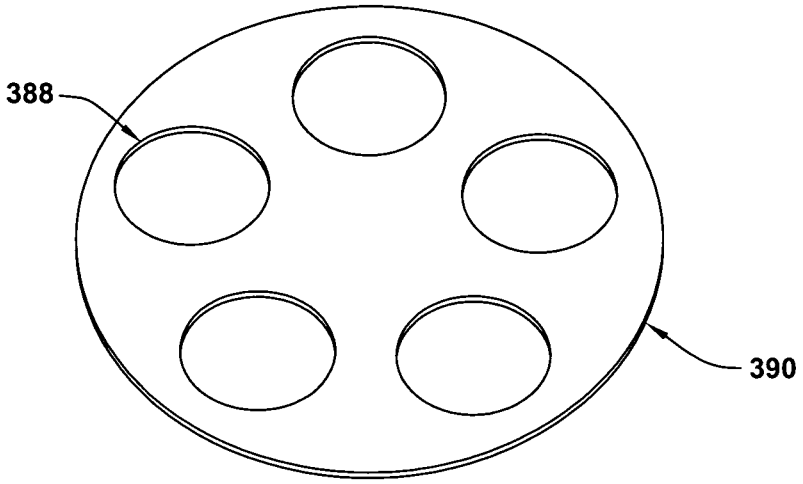
FIG. 20 is a top view of multiple workpieces workholder for an air bearing spindle.

FIG. 20 is a top view of multiple workpieces workholder for an air bearing spindle. A multiple workpiece workholder plate 390 is shown with multiple workpiece pockets 388.

Figure 21:
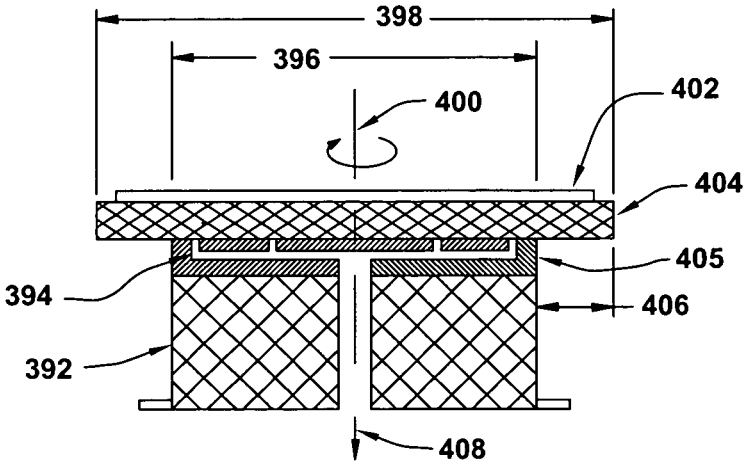
FIG. 21 is a cross section view of a spindle with an overhung workpiece carrier.

FIG. 21 is a cross section view of a spindle with an overhung workpiece carrier. A workpiece spindle 392 that has a flat-surfaced top 405 that rotates around an axis 400 has an attached workpiece carrier 404 that supports an attached flat-surfaced workpiece 402. The workpiece carrier 404 has a diameter 398 that exceeds the spindle-top 405 diameter 396 where the workpiece carrier 404 overhangs the spindle-top 405 by the distance 406. Vacuum 408 is routed through passageways 394 to attach the workpiece carrier 404 to the spindle top 405 where the workpiece carrier 404 and the workpiece 402 are both concentric with the spindle-top 405.

Figure 22:
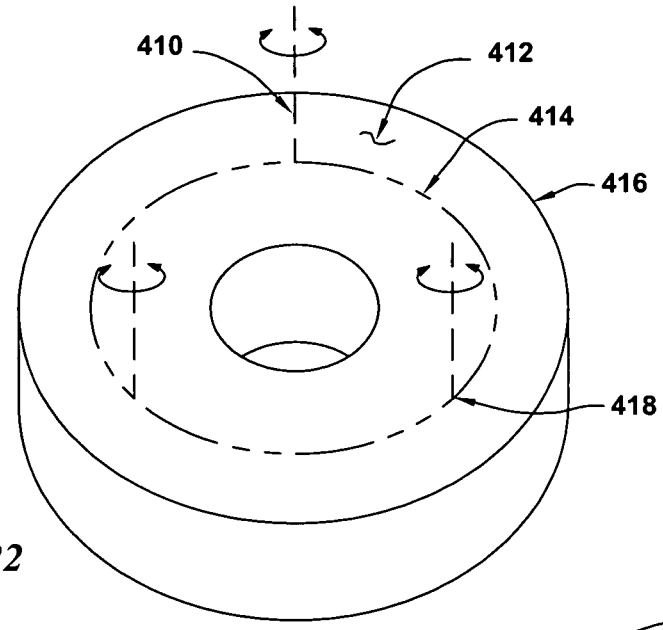
FIG. 22 is an isometric view of spindle rotation axes intersecting a spindle-circle.

FIG. 22 is an isometric view of spindle rotation axes intersecting a spindle-circle. A granite machine base 416 has a spindle-circle 414 that is coincident with the machine base 416 surface 412. Three equally-spaced spindles (not shown) have axes of rotation 410 that intersect the spindle-circle 414 at intersection points 418.

Figure 23:
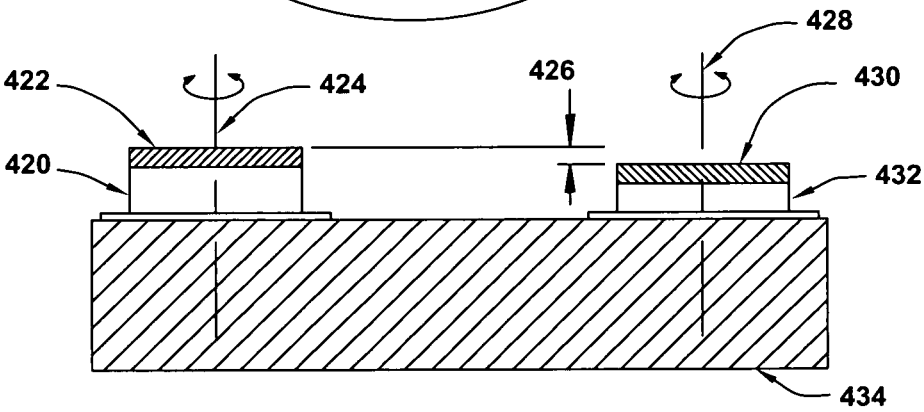
FIG. 23 is a cross section view of non-planar spindles on a machine base.

FIG. 23 is a cross section view of non-planar spindles mounted directly on a machine base. Two rotary spindles 420 and 432 are attached to a machine base 434 where the spindle 420 has a rotary spindle-top 422 that has an axis of rotation 424 and the spindle 432 has a flat surfaced spindle-top 430 that has an axis of rotation 428. The spindle 420 spindle-top 422 has elevation difference of 426 with the spindle 432 spindle-top 430. A planar abrasive surface of an abrasive platen (not shown) would not be in flat contact with the two spindle-tops 422 and 430 because of the elevation difference 426.

Figure 24:
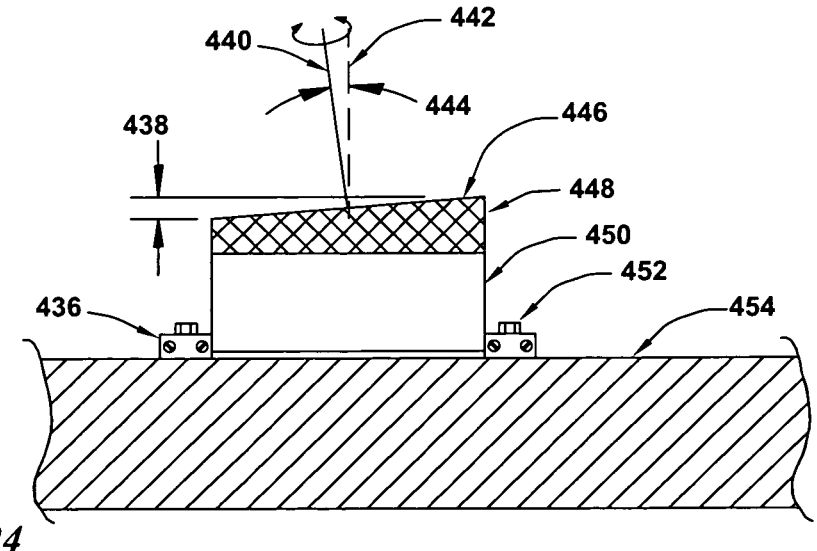
FIG. 24 is a cross section view of an angled spindle-top spindle on a machine base.

FIG. 24 is a cross section view of an angled spindle-top spindle that is mounted directly on a machine base. A workpiece spindle 450 that has a rotary spindle-top 448 that has a rotary axis 440 that has an angle 444 with a vertical axis 442 results in a angled spindle-top 448 surface 446 that has a elevation error distance 438 across the width of the spindle-top 448 surface 446 that would prevent flat-surfaced abrading with a flat-surfaced platen (not shown) that is in three-point contact with a set of three spindles 450 (two not shown). The spindle 450 is attached at spindle 450 spindle legs 436 to the machine base 454 with fasteners 452.

Figure 25:
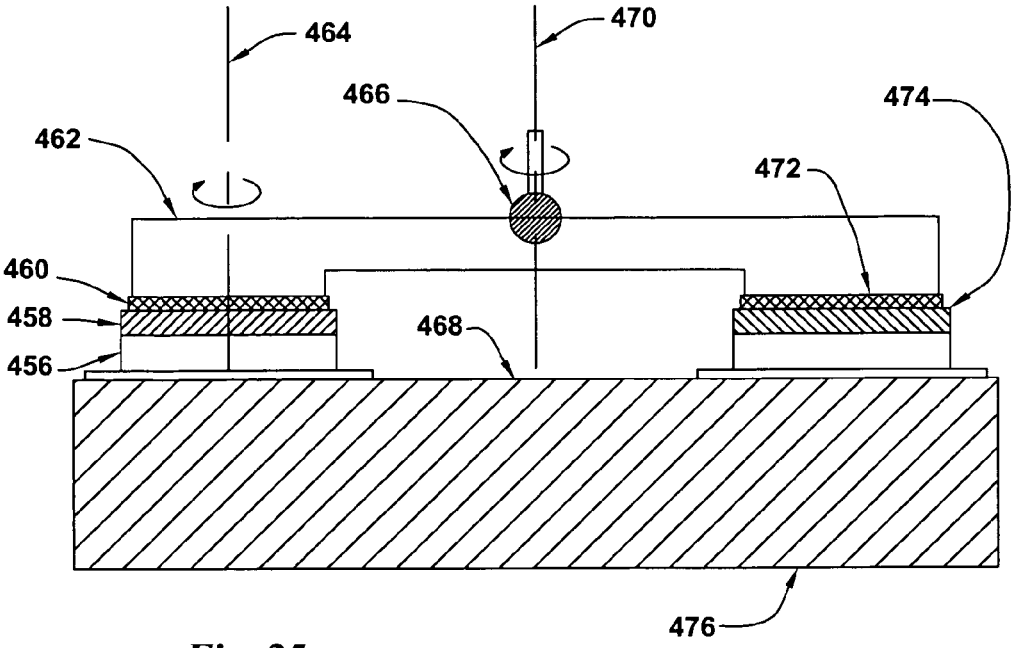
FIG. 25 is a cross section view of spindle abrasion of a platen abrading surface.

FIG. 25 is a cross section view of spindle abrasion of a platen abrading-surface where the rotary spindles are directly attached to a machine base. A rotary platen 462 that rotates about a platen axis 470 is supported at the platen axis 470 by a spherical action device 466 that allows the free-floating platen 462 to have spherical pivot action while the spherical action device 466 restrains the platen 462 in a platen annular abrading-surface 472 radial direction. The spherical action device 466 can be moved in a direction along the platen axis 470 to raise or lower the platen 462 where the platen abrading-surface 472 is nominally-horizontal. The spherical action device 466 also provides rotation of the platen 462 about the platen 462 rotation axis 470. The platen rotation axis 470 is centered between three fixed-position rotary spindles (one not shown) 456 that have rotary tops 458 where the three spindles 456 have equal spaces between them and the spindles 456 have spindle rotation axes 464. The spindles 456 are mounted on a granite machine base 476 and the spindle axes of rotation 464 are approximately perpendicular to the flat top surface 468 of the granite base 476. The platen 462 has an annular flat abrading-surface 472 that is abraded by equal-thickness abrasive disks 460 that are attached to the top flat surfaces 474 of all three of the three-point fixed-position spindle 456 spindle-tops 458 where the spindle-tops 458 rotate in selected directions and at selected rotational speeds while the abrading-surface 472 of the platen 462 is rotated in selected directions and at selected rotational speeds during the abrading action. The abrading pressure between the abrading-surface 472 of the platen 462 and the spindle-top 458 abrasive disks 460 is controlled throughout the platen surface 472 abrading action. The abrading disks 460 are selected to have an abrasive disk 460 diameter that is larger than the radial width of the annular abrading-surface 472 of the platen 462 to assure that the rotating abrasive disk 460 extends over both the inner and outer peripheries of the platen 462 annular abrading-surface 472. The annular abrading-surface 472 of the platen 462 is a bare non-abrasive surface.

In other applications, this bare-surfaced annular abrading-surface 472 of the platen 462 can also be coated with an abrasive slurry mixture (not shown) to perform abrasive slurry abrading on workpieces (not shown) that are attached to the spindle-tops 458 or abrasive disk articles (not shown) can be attached to this platen 462 abrading-surface 472.

Figure 26:
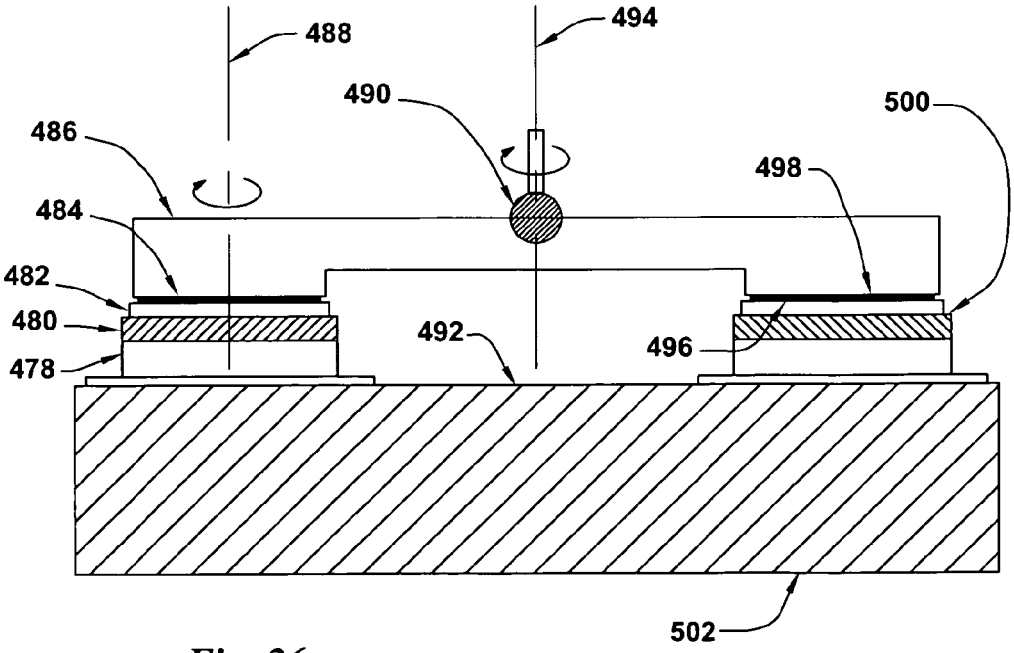
FIG. 26 is a cross section view of spindle abrasion of an abrasive disk attached to a platen.

FIG. 26 is a cross section view of spindle abrasion of an abrasive disk attached to a platen where rotary spindles are directly attached to a machine base. A rotary platen 486 that rotates about a platen axis 494 is supported at the platen axis 494 by a spherical action device 490 that allows the free-floating platen 486 to have spherical pivot action while the spherical action device 490 restrains the platen 486 in a platen annular abrading-surface 498 radial direction. The spherical action device 490 can be moved in a direction along the platen axis 494 to raise or lower the platen 486 where the platen abrading-surface 498 is nominally-horizontal. The spherical action device 490 also provides rotation of the platen 486 about the platen 486 rotation axis 494. The platen rotation axis 494 is centered between three fixed-position rotary spindles 478 that have rotary tops 480 where the three spindles (one not shown) 478 have equal spaces between them and the spindles 478 have spindle rotation axes 488. The spindles 478 are shown here mounted directly on a granite machine base 502 top surface 492 and the spindle axes of rotation 488 are approximately perpendicular to the nominally-flat top surface 492 of the granite base 502. The platen 486 has an annular flat abrading-surface 498 to which is attached the abrasive disk 484 having an annular abrading surface 496 that is abraded by equal-thickness abrasive disks 482 that are attached to the top flat surfaces 500 of all three of the three-point fixed-position spindle 478 spindle-tops 480 where the spindle-tops 480 rotate in selected directions and at selected rotational speeds while the abrading-surface 498 of the platen 486 is rotated in selected directions and at selected rotational speeds during the abrasive disk 484 abrading surface 496 abrading action. The abrading pressure between the abrasive disk 484 abrading surface 496 and the spindle-top 480 abrasive disks 482 is controlled throughout the abrasive disk 484 abrading surface 496 abrading action. The spindle-top 480 abrading disks 482 are selected to have an abrasive spindle disk 482 diameter that is larger than the radial width of the platen 486 abrasive disk 484 annular abrading surface 496 to assure that the rotating abrasive spindle disks 482 extend over both the inner and outer peripheries of the platen 486 abrasive disk 484 annular abrading surface 496.

Figure 27:
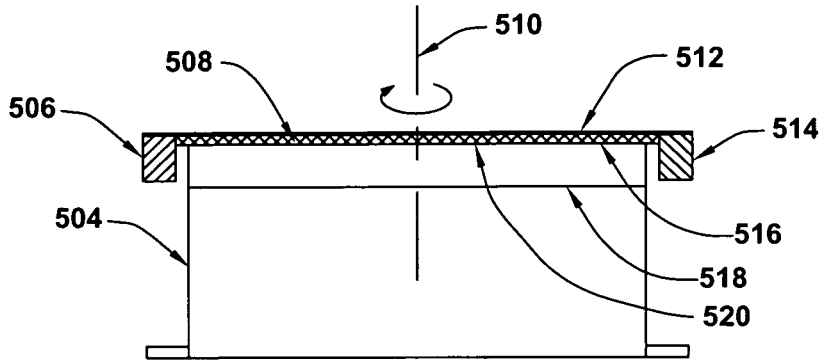
FIG. 27 is a cross section view of a workpiece spindle with an annular conditioning ring.

FIG. 27 is a cross section view of a workpiece spindle with an annular conditioning ring. A rotary workpiece spindle 504 has a rotary spindle-top 518 that rotates about a spindle axis 510 and the spindle-top 518 has a flat top surface 516. A conditioning ring 506 has an annular ring 514 that is attached to a flat-surfaced conditioning ring support plate 520 that is in flat contact with the flat top surface 516 of the spindle-top 518. The annular ring 514 has a top ring surface 512 that is coated with abrasive 508 where the abrasive 508 can be in abrading contact with a platen (not shown) abrading surface or can be in abrading contact with an abrasive disk (not shown) that is attached to a flat platen abrading surface where the abrasive disk abrading surface contacts the conditioning ring 514 ring surface 512 abrasive surface 508. The conditioning ring 506 is rotated in a selected rotation direction while the platen is rotated in a selected direction to abrade the flat annular abrading surface of the platen or the flat annular abrasive surface of the abrasive disk.

Figure 28:
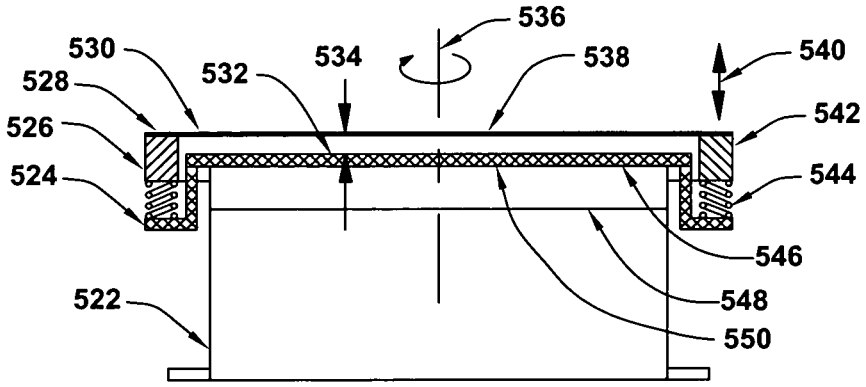
FIG. 28 is a cross section view of a spindle with a spring-type annular conditioning ring.

FIG. 28 is a cross section view of a spindle with a spring-type annular conditioning ring. A rotary workpiece spindle 522 has a rotary spindle-top 548 that rotates about a spindle axis 536 and the spindle-top 548 has a flat top surface 546. A conditioning ring 526 has an annular ring 542 that is attached to compression springs 544 that are supported by a annular ledge 524 that is attached to a flat-surfaced conditioning ring support plate 550 that is in flat contact with the flat top surface 546 of the spindle-top 548. The conditioning ring 526 annular portion 542 has a top ring surface 538 that is coated with abrasive 530 where the abrasive 530 can be in abrading contact with a platen (not shown) abrading surface or can be in abrading contact with an abrasive disk (not shown) that is attached to a flat platen abrading surface where the abrasive disk abrading surface contacts the conditioning ring 526 ring surface 538 abrasive surface 530. The conditioning ring 526 is rotated in a selected rotation direction while the platen is rotated in a selected direction to abrade the flat annular abrading surface of the platen or the flat annular abrasive surface of the abrasive disk. A gap 534 is maintained between the top surface 532 of the support plate 550 and the conditioning ring 526 abrasive surface 530 to allow the conditioning ring 526 to travel friction-free in a vertical direction 540 and to float freely to conform to the abrading-surface of the platen or to the abrasive surface of the abrasive disk that is attached to the platen. The abrading pressure applied by the conditioning ring 526 to the platen abrading surface or platen abrasive disk is controlled by the deflection of the condition ring 526 supporting springs 544.

Figure 29:
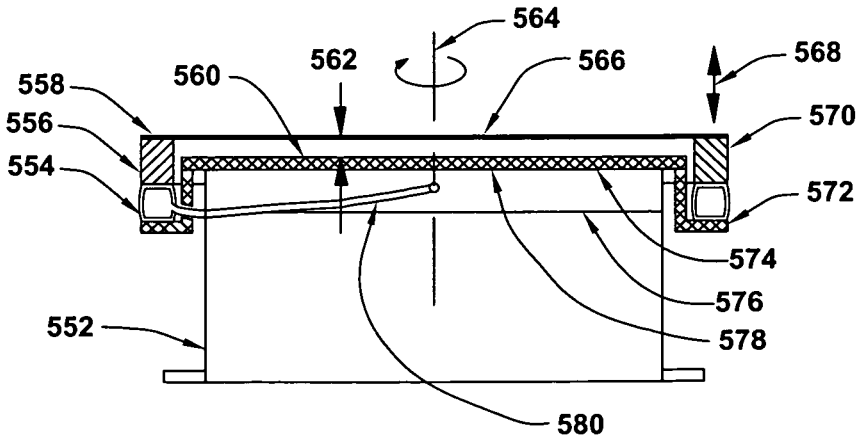
FIG. 29 is a cross section view of a spindle with a bladder-type annular conditioning ring.

FIG. 29 is a cross section view of a spindle with a bladder-type annular conditioning ring. A rotary workpiece spindle 552 has a rotary spindle-top 576 that rotates about a spindle axis 564 and the spindle-top 576 has a flat top surface 574. A conditioning ring 556 has an annular ring 570 that is attached to an annular-shaped air bladder 554 that is supported by a annular ledge 572 that is attached to a flat-surfaced conditioning ring support plate 578 that is in flat contact with the flat top surface 574 of the spindle-top 576. The conditioning ring 556 annular portion 570 has a top ring surface 566 that is coated with abrasive 558 where the abrasive 558 can be in abrading contact with a platen (not shown) abrading surface or can be in abrading contact with an abrasive disk (not shown) that is attached to a flat platen abrading surface where the abrasive disk abrading surface contacts the conditioning ring 556 abrasive surface 558. The conditioning ring 556 is rotated in a selected rotation direction while the platen is rotated in a selected direction to abrade the flat annular abrading surface of the platen or the flat annular abrasive surface of the abrasive disk. A gap 562 is maintained between the top surface 560 of the support plate 578 and the conditioning ring 556 abrasive surface 558 to allow the conditioning ring 556 to travel friction-free in a vertical direction 568 and to float freely to conform to the abrading-surface of the platen or to the abrasive surface of the abrasive disk that is attached to the platen. The abrading pressure applied by the conditioning ring 556 to the platen abrading surface or platen abrasive disk is controlled by the air pressure supplied to the annular air bladder 554 that supports the conditioning ring 556. A flexible air line 580 supplies pressurized air to the bladder 554 from the rotary spindle 552 spindle-top 576 where the pressurized air is supplied by a rotary union (not shown) that is attached to the spindle-top 576 hollow rotary drive shaft (not shown).

Figure 30:
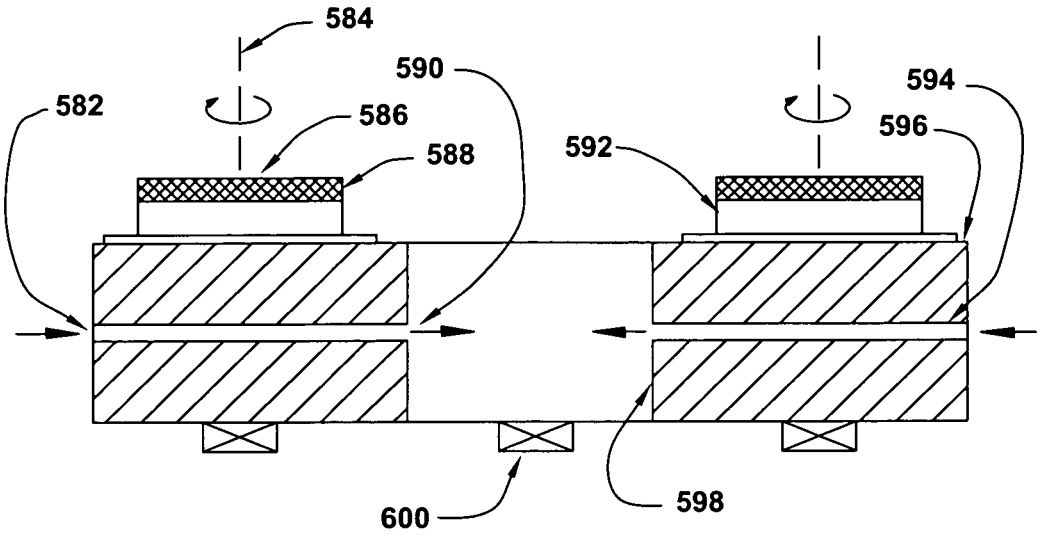
FIG. 30 is a cross section view of three-point spindles on a fluid passageway granite base.

FIG. 30 is a cross section view of three-point spindles that are mounted directly on a fluid-passageway granite base. Rotary spindles 592 are mounted directly to the top flat surface of a granite, or other material, machine base 598 that is supported at three points by base supports 600. Only two of the set of three spindles 592 are shown. Each of the spindles 592 has rotary tops 588. The flatness of the base 598 top surface 596 is established when the base 598 is manufactured with the same three-point base supports 600 which allows the flatness of the surface 596 of the base 598 to be retained when the base 598 is later mounted in an abrading machine (not shown) frame using these same base supports 600. Equal height spindles 592 have rotary tops 588 that have flat surfaces 586 where the flat surfaces 586 are in a common plane that is approximately co-planar with the machine base 598 nominally-flat or non-precision-flat top surface 596. The spindles 592 have axes of rotation 584. The granite base 598 has internal fluid passageways 594 that have a fluid entrance 582 and a fluid exit 590. The granite base 598 fluid passageways 594 maintain the temperature of the granite base 598 at a uniform temperature which prevents localized thermal expansions or thermal contractions of portions of the granite bas 598 from distorting the flatness of the granite base 598 mounting surface 596 due to ambient temperature changes or abrading machine components heating or cooling or machine operation induced granite base 598 temperature changes.

Figure 31:
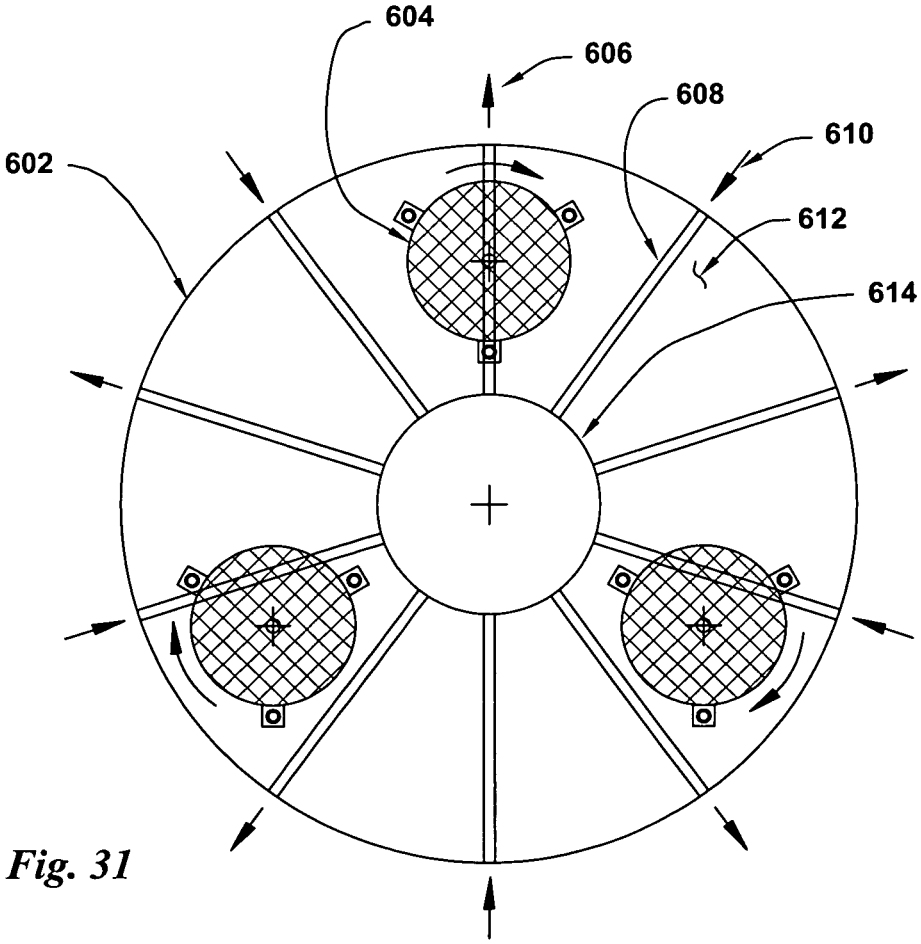
FIG. 31 is a top view of three-point spindles on a fluid passageway granite base.

FIG. 31 is a top view of equally-spaced three-point fixed-position spindles that are mounted directly on a granite machine base that has internal fluid passageways. Rotary spindles 604 are mounted directly on a granite machine base 602 having a nominally-flat surface 612. Each of the three equally-spaced spindles 604 has equally-spaced three-point mounting legs that are attached with mechanical fasteners (not shown) to the machine base 602 surface 602. The annular shaped granite base 602 has an inner periphery 614 that provides a circular open area that allows interconnection of internal fluid passageways 608 that have fluid entrances 610 and fluid exits 606. The granite base 602 fluid passageways 608 maintain the temperature of the granite base 602 at a uniform temperature which prevents localized thermal expansions or thermal contractions of portions of the granite bas 602 from distorting the flatness of the granite base 602 mounting surface 612 due to ambient temperature changes or abrading machine components heating or cooling or machine operation induced granite base 602 temperature changes.

Figure 32:
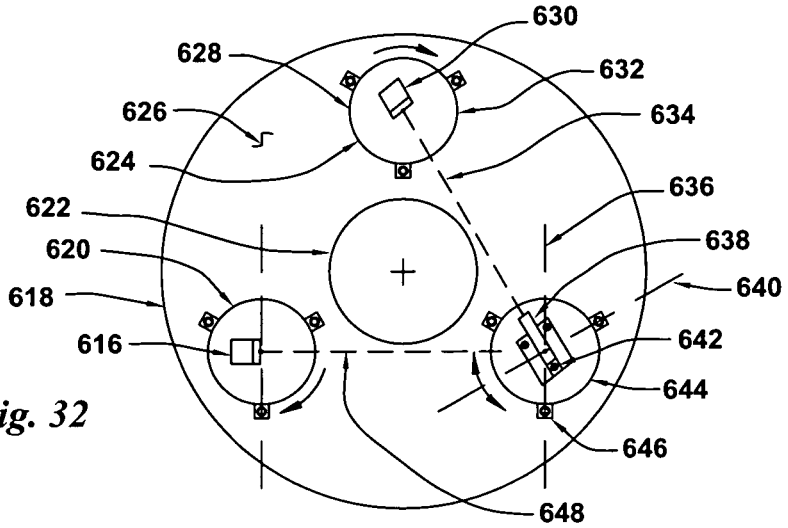
FIG. 32 is a top view of a laser and a laser target and spindles on a machine base.

FIG. 32 is a top view of a laser and a laser target and spindles on a machine base. In a laser alignment step, three rotary spindles 620, 628 and 644 having rotary spindle-tops 632 are attached to a machine base 618 where the spindles 620, 628 and 644 have adjustable spindle legs 646 that allow the spindles 620, 628 and 644 to be mounted to the base 618 surface 626. A laser device 638 having three point supports 642 is mounted on a spindle 644 spindle-top 632 and emits a laser beam 648 that is impinged on an array sensor target 616 that is mounted on another spindle 620 spindle-top 632. The laser device 638 can also be rotated on the spindle-top 644 and emit a laser beam 634 that is impinged on an array sensor target 630 that is mounted on another spindle 628 spindle-top 632. The machine base 618 is shown with a cut-out center hole 622. The laser 638 and the laser targets 616 and 630 are used to co-planar align the spindles 620, 628 and 644 spindle-tops 632. The spindle 644 can be tilt-adjusted about a tilt axis 636 that is perpendicular to the laser beam 648 and the spindle 644 can be tilt-adjusted about a tilt axis 640 that is perpendicular to the laser beam 634.

Figure 33:
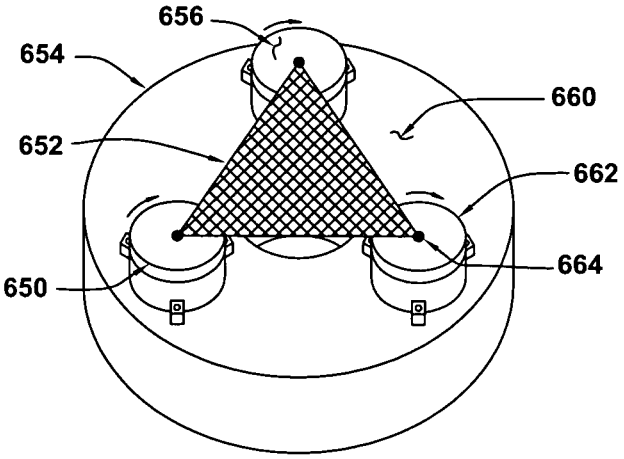
FIG. 33 is an isometric view of three-point spindles that have a spindle-common plane where the spindles are mounted on a machine base.

FIG. 33 is an isometric view of three-point spindles that have a spindle-common plane where the spindles are mounted on a machine base. Three spindles 662 having rotary spindle-tops 650 that have spindle-top 650 rotational center points 664 where all of the spindle-tops 650 flat surfaces 656 are co-planar as represented by a planar surface 652. The spindles 662 are mounted on the flat surface 660 of a machine base 654.

Figure 34:
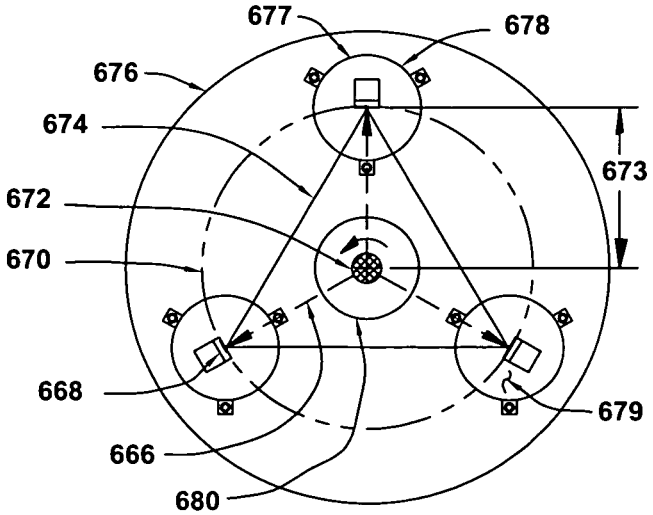
FIG. 34 is a top view of three-point spindles co-planar aligned by a planar-beam laser device.

FIG. 34 is a top view of three-point spindles co-planar aligned by a planar-beam laser device. Three-point spindles 678 are mounted on a machine base 676 where a rotary laser device 680 having a rotary laser head 672 that sweeps a laser beam 666 in a laser plane circle 670. The rotary laser 680 is mounted on the machine base 676 at a central position between the three spindles 678 to minimize the laser beam 666 distance 673 between the rotary laser head 672 and the laser targets 668 that are mounted on the spindles 678 spindle-top 677 flat surfaces 679. The spindle 678 spindle-top 677 flat surfaces 679 are aligned to be co-planar with the use of the rotary-beam laser device 680 to form a spindle 678 spindle-top 677 flat-surface 679 alignment plane 674.

Figure 35:
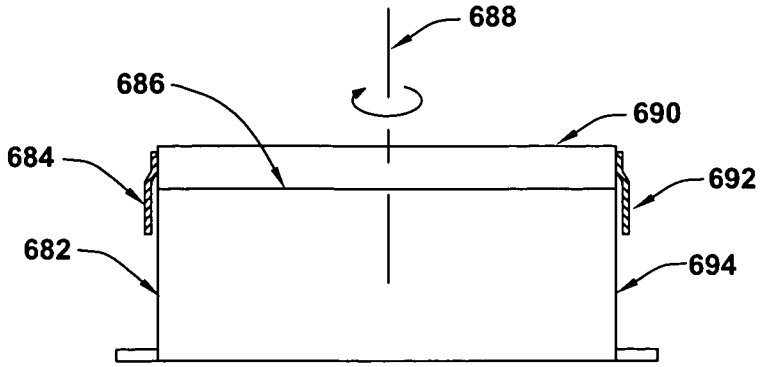
FIG. 35 is a cross section view of a workpiece spindle with a spindle top debris guard.

FIG. 35 is a cross section view of a workpiece spindle with a spindle top debris guard. A cylindrical workpiece rotary spindle 682 has a rotary spindle-top 690 that rotates about a spindle axis 688 where the spindle top 690 has a circumferential separation line 686 that separates the spindle top 690 from the spindle 682 base 694. Where these spindles 682 are used in abrading atmospheres, water mist, abrading debris and very small sized abrasive particles are present in the atmosphere surrounding the spindle 682. To prevent entry of this debris, water moisture and abrasive particles into the spindle 682 separation line 686 gap area, a circumferential drip-shield 684 is provided where the drip shield 684 has a drip lip 692 that extends below the separation line 686. Unwanted debris material and water simply drips off the surface of the drip shield 684. Build-up of debris matter on the drip shield 684 is typically avoided because of the continued presence of abrasive coolant water that continually washes the surface of the drip shield 684 and because of centrifugal forces as the spindle-top 690 is rotated. When the workpiece rotary spindles 682 are used in abrading processes, often special chemical additives are added to the coolant water to enhance the abrading action on workpieces (not shown) in abrading procedures such as chemical mechanical planarization. Both the cylindrical spindle 682 cylindrical drip shields 684 and the spindles 682 are constructed from materials that are resistant to materials comprising water coolants, chemical additives, abrading debris and abrasive particles.

Figure 36:
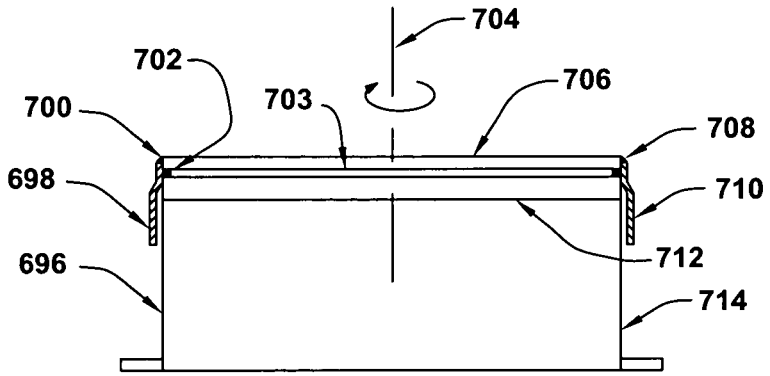
FIG. 36 is a cross section view of a workpiece spindle with a spindle O-ring debris guard.

FIG. 36 is a cross section view of a workpiece spindle with a spindle O-ring debris guard. A cylindrical workpiece spindle 696 has a rotary spindle-top 706 that rotates about a spindle axis 704 where the spindle-top 706 has a circumferential separation line 712 that separates the spindle-top 706 from the spindle 696 base 714. Where these spindles 696 are used in abrading atmospheres, water mist, abrading debris and very small sized abrasive particles are present in the atmosphere surrounding the spindle 696. To prevent entry of this debris, water moisture and abrasive particles in the spindle 696 separation line 712 area, a circumferential drip-shield 698 is provided where the drip shield 698 has a drip lip 710 that extends below the separation line 712. Unwanted debris material and water simply drips off the surface of the drip shield 698. Build-up of debris matter on the drip shield 698 is typically avoided because of the continued presence of abrasive coolant water that continually washes the surface of the drip shield 698 and because of centrifugal forces as the spindle-top 706 is rotated. When the workpiece spindles 696 are used in abrading processes, often special chemical additives are added to the coolant water to enhance the abrading action on workpieces (not shown) in abrading procedures such as chemical mechanical planarization. Both the cylindrical spindle 696 cylindrical drip shields 698 and the spindles 696 are constructed from materials that are resistant to materials comprising water coolants, chemical additives, abrading debris and abrasive particles. An O-ring 702 is shown positioned in an O-ring groove 703 that is a part of the spindle top 706 and this O-ring 702 acts as a seal to prevent water or debris from entering the top peripheral edge 700 of the spindle top 706. In addition, temporary sealant 708 can be used to seal this same peripheral edge 700 joint area.

Figure 37:
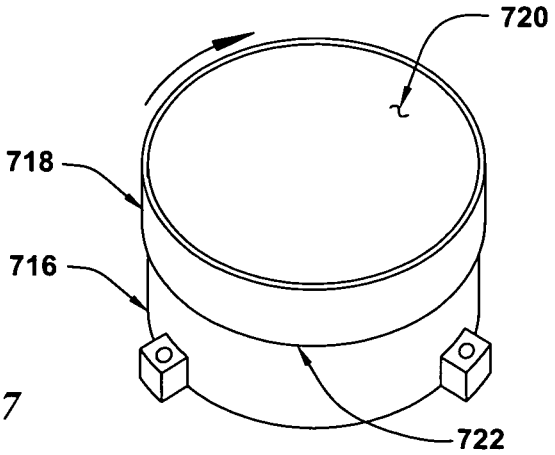
FIG. 37 is an isometric view of a workpiece spindle with a spindle top debris guard.

FIG. 37 is an isometric view of a workpiece spindle with a spindle top debris guard. A rotary workpiece spindle 716 has a drip shield 718 that extends around the periphery of the spindle 716 flat-surfaced spindle-top 720 where the drip shield 718 has a drip shield 718 lower periphery edge 722.

Figure 38:
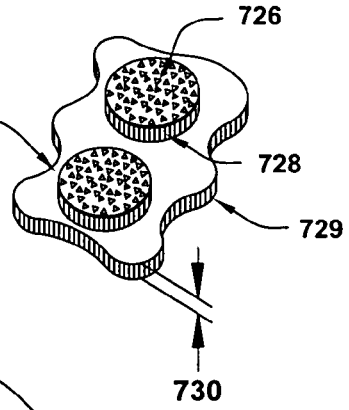
FIG. 38 is an isometric view of fixed-abrasive coated raised islands on an abrasive disk.

FIG. 38 is an isometric view of fixed-abrasive coated raised islands on an abrasive disk. Abrasive particle 726 coated raised islands 728 are attached to an abrasive disk 724 backing 729. The backing 729 has a backing thickness 730 that is thick enough to provide sufficient structural strength and support of the annular abrasive disk 724 whereby the disk 724 can be handled without damage to the disk 724 and where the disk 724 can be mounted to the flat annular surface of an abrading platen (not shown) where the disk 724 can be successfully attached to the platen abrasive disk 724 mounting surface with a vacuum attachment system (not shown). The backing 729 has a thickness 730 where the backing 729 is manufactured from a suitable backing material and has a suitable thickness 730 that together provide sufficient abrasive disk 724 strength and durability to resist dynamic abrading forces such that the backing 729 does not rip or tear or crumple when the abrasive disk 724 is subjected to abrading forces and abrading environments including water or water mist or chemicals that are present during the intended use of the abrasive disk 724.

Figure 39:
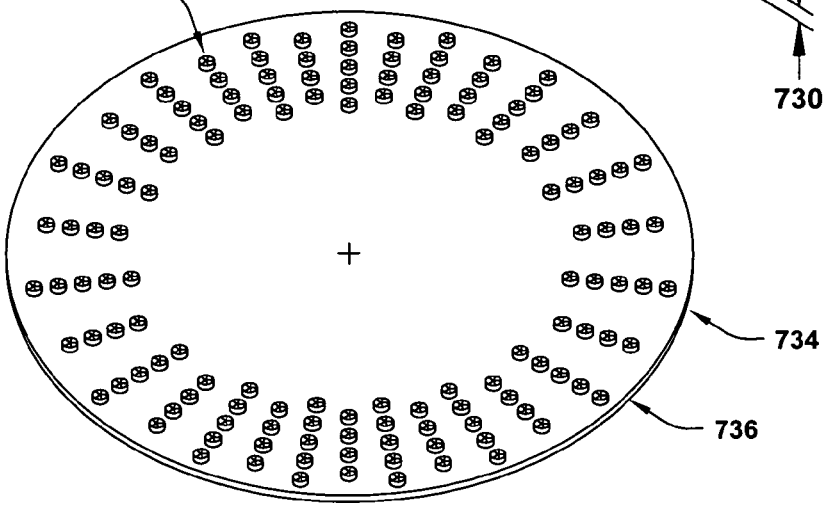
FIG. 39 is an isometric view of a fixed-abrasive coated raised island abrasive disk.

FIG. 39 is an isometric view of a fixed-abrasive coated raised island abrasive disk. Abrasive particle coated raised islands 732 are attached to an abrasive disk 736 backing 734.

Figure 40:
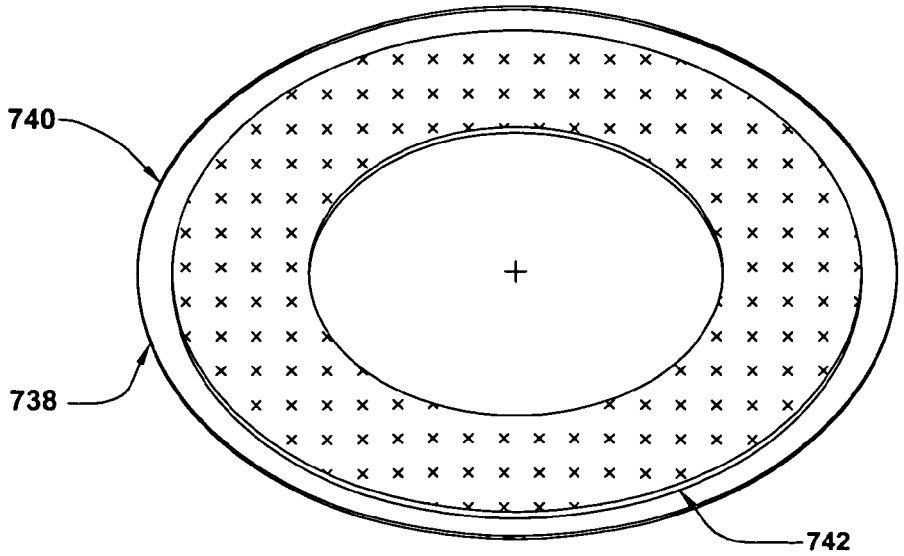
FIG. 40 is an isometric view of a solid-layer fixed-abrasive disk.

FIG. 40 is an isometric view of a flexible fixed-abrasive coated abrasive disk having a thick layer of solid abrasive material attached to the abrasive disk backing. A continuous flat-surfaced annular band of a thick layer of solid abrasive material 724 is attached to the flexible backing 738 of an abrasive disk 740 that can be attached with vacuum or by other mechanical attachment devices (not shown) to a flat-surfaced rotary platen (not shown).

FIG. 41 is an isometric view of fixed-abrasive coated raised islands on a flexible annular abrasive disk that has an open disk center. Abrasive particle 748 coated raised islands 750 are attached to an abrasive disk 746 backing 752 where the annular backing 752 has an abrasive disk 746 inner periphery 744. The backing 752 has a backing thickness 754 that is thick enough to provide sufficient structural strength and support of the annular abrasive disk 746 whereby the disk 746 can be handled without damage to the disk 746 and where the disk 746 can be mounted to the flat annular surface of an abrading platen (not shown) where the disk 746 can be successfully attached to the platen abrasive disk 746 mounting surface with a vacuum attachment system (not shown). The backing 752 has a thickness 744 where the backing 752 is manufactured from a suitable backing material and has a suitable thickness 744 that together provide sufficient abrasive disk 746 strength and durability to resist dynamic abrading forces such that the backing 752 does not rip or tear or crumple when the abrasive disk 746 is subjected to abrading forces and abrading environments including water or water mist or chemicals that are present during the intended use of the abrasive disk 746.

FIG. 42 is an isometric view of a flexible fixed-abrasive coated raised island annular abrasive disk. Abrasive particle coated raised islands 756 are attached to an abrasive disk 760 backing 762 and where the annular abrasive disk 760 has an open center and also has an annular inner radius 758.

FIG. 43 is an isometric view of a flexible annular fixed-abrasive coated abrasive disk having a thick layer of solid abrasive material attached to the annular abrasive disk backing. A continuous flat-surfaced annular band of a thick layer of solid abrasive material 768 is attached to the annular flexible backing 766 of an abrasive disk 764 that can be attached with vacuum or by other mechanical attachment devices (not shown) to a flat-surfaced rotary platen (not shown). The annular abrasive material 768 has inner radius abrasive periphery 772 and the abrasive disk 764 annular backing 766 has an abrasive disk 764 annular backing 766 inner radius periphery 770.

Figure 43A:
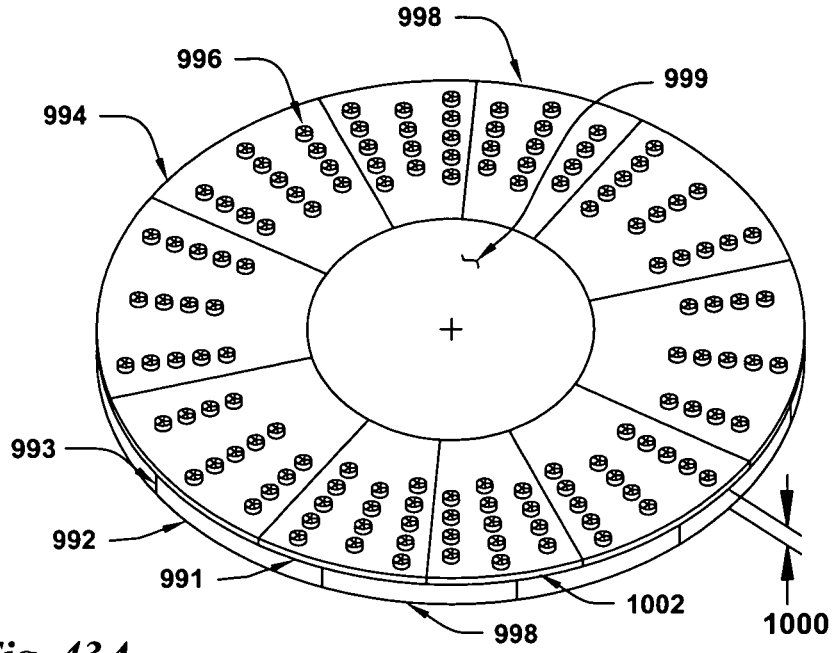
FIG. 43A is an isometric view of a heavy-duty abrasive disk with annular raised islands.

FIG. 43A is an isometric view of a heavy-duty abrasive disk with annular raised islands where the abrasive disk is a laminated disk. The flexible laminated disk 994 has a flexible top backing layer 1002 that is attached to a flexible bottom backing layer 998 where the top backing layer 1002 consists of pie-shaped truncated-arc segments 991 that are bonded to the bottom backing layer 998 pie-shaped truncated-arc segments 992. Abrasive coated raised islands 996 are attached to the top backing layer 1002. The bottom backing layer 998 can be constructed from a variety of materials including metal, fiber material, polymers and combinations thereof and the bottom backing layer 998 has a thickness 1000. The bottom backing layer 998 which has a thickness 1000 where the backing 998 is manufactured from a suitable backing material and has a suitable thickness 1000 that together provide sufficient abrasive disk 994 strength and durability to resist dynamic abrading forces such that the bottom backing layer 998 and the top backing layer 1002 do not individually or collectively rip or tear or crumple when the abrasive disk 994 is subjected to abrading forces and abrading environments including water or water mist or chemicals that are present during the intended use of the abrasive disk 994. The bottom backing layer 998 truncated-arc segments 992 and the top backing layer 1002 truncated-arc segments 991 have staggered abrasive disk 994 radial positions from each other where the top backing layer 1002 truncated-arc segments 991 lap over the truncated-arc joint lines 993 between the bottom backing layer 998 truncated-arc segments 992. There is a laminated disk 994 top backing layer 1002 center continuous-surfaced cylindrical backing disk 999 that is directly adjacent to and attached to the top backing layer 1002 truncated-arc segments 991. There is another laminated disk 994 bottom backing layer 998 center continuous-surfaced cylindrical backing disk (not shown) that is directly adjacent to and attached to the bottom backing layer 998 truncated-arc segments 992. The top backing layer 1002 center continuous-surfaced cylindrical backing disk 999 is also bonded to the bottom backing layer 998 center continuous-surfaced cylindrical backing disk.

Figure 43B:
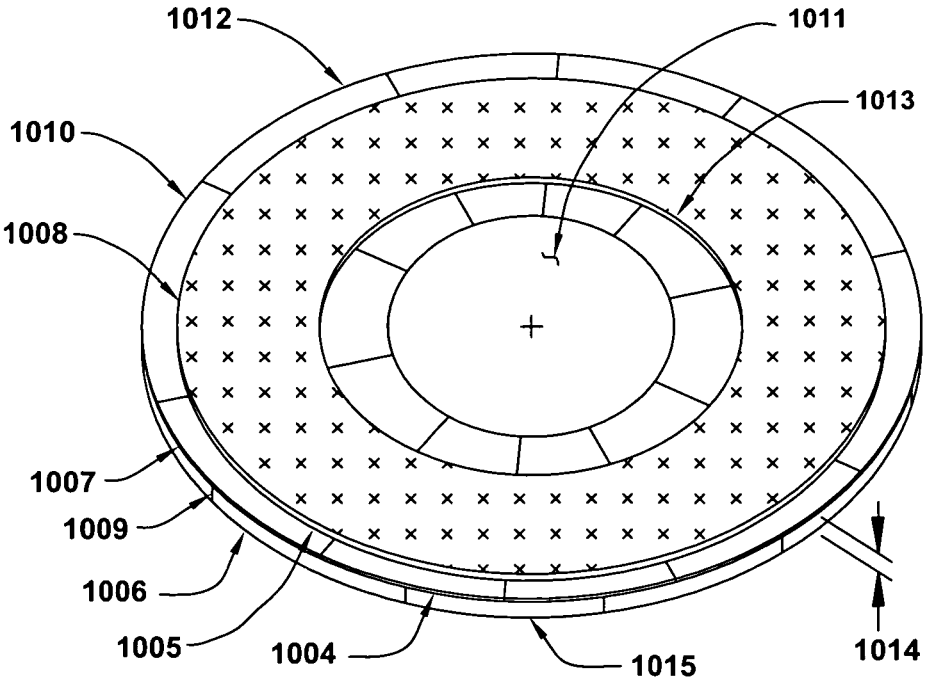
FIG. 43B is an isometric view of a heavy-duty disk with a solid-layer of fixed-abrasive.

FIG. 43B is an isometric view of a heavy-duty disk with a solid-layer of fixed-abrasive where the abrasive disk is a laminated disk. The flexible laminated disk 1010 has a flexible top backing layer 1007 that is attached to a flexible bottom backing layer 1015 where the top backing layer 1007 consists of pie-shaped truncated-arc segments 1004 that are bonded to the bottom backing layer 1015 pie-shaped truncated-arc segments 1006. Abrasive coated raised islands 996 are attached to the top backing layer 1007. The bottom backing layer 1015 can be constructed from a variety of materials including metal, fiber material, polymers and combinations thereof and the bottom backing layer 1015 has a thickness 1014. The bottom backing layer 1015 which has a thickness 1014 where the backing 1015 is manufactured from a suitable backing material and has a suitable thickness 1014 that together provide sufficient abrasive disk 1010 strength and durability to resist dynamic abrading forces such that the bottom backing layer 1015 and the top backing layer 1007 do not individually or collectively rip or tear or crumple when the abrasive disk 1010 is subjected to abrading forces and abrading environments including water or water mist or chemicals that are present during the intended use of the abrasive disk 1010. The bottom backing layer 1015 truncated-arc segments 1006 and the top backing layer 1007 truncated-arc segments 1004 have staggered abrasive disk 1010 radial positions from each other where the top backing layer 1007 truncated-arc segments 1004 lap over the truncated-arc joint lines 1009 between the bottom backing layer 1015 truncated-arc segments 1006. There is a laminated disk 1010 top backing layer 1007 center continuous-surfaced cylindrical backing disk 1011 that is directly adjacent to and attached to the top backing layer 1007 truncated-arc segments 1004. There is another laminated disk 1010 bottom backing layer 1015 center continuous-surfaced cylindrical backing disk (not shown) that is directly adjacent to and attached to the bottom backing layer 1015 truncated-arc segments 1006. The top backing layer 1007 center continuous-surfaced cylindrical backing disk 1011 is also bonded to the bottom backing layer 1015 center continuous-surfaced cylindrical backing disk. A continuous flat-surfaced annular band of a thick layer of solid abrasive material 1008 is attached to the flexible laminated disk 1010 flexible top backing layer 1007 where the flexible bottom backing layer 1015 can be attached with vacuum or by other mechanical attachment devices (not shown) to a flat-surfaced rotary platen (not shown).

Figure 43C:
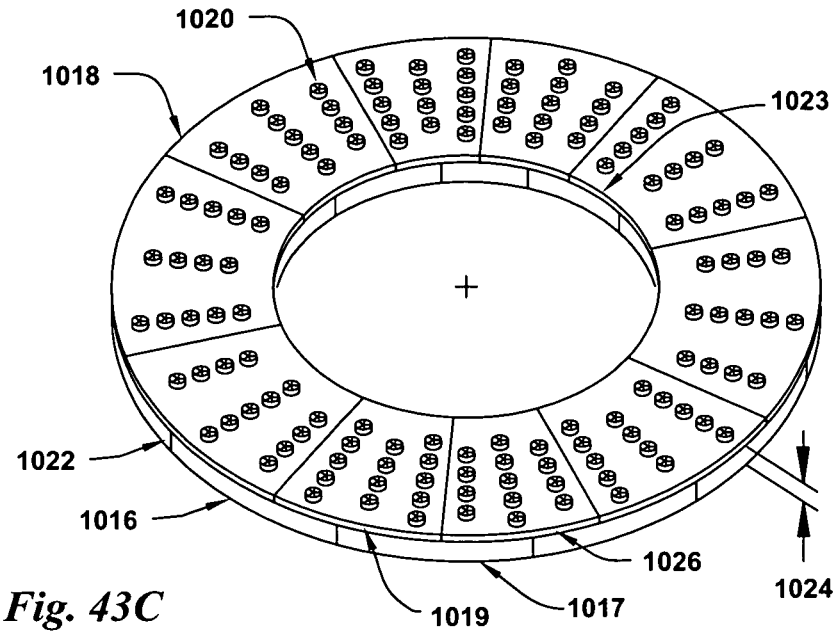
FIG. 43C is an isometric view of an annular heavy-duty abrasive disk with raised islands.

FIG. 43C is an isometric view of an annular heavy-duty abrasive disk with raised islands where the abrasive disk is a laminated disk. The flexible laminated disk 1018 has a flexible top backing layer 1026 that is attached to a flexible bottom backing layer 1017 where the top backing layer 1026 consists of pie-shaped truncated-arc segments 1019 that are bonded to the bottom backing layer 1017 pie-shaped truncated-arc segments 1016. Abrasive coated raised islands 1020 are attached to the top backing layer 1026. The bottom backing layer 1017 can be constructed from a variety of materials including metal, fiber material, polymers and combinations thereof and the bottom backing layer 1017 has a thickness 1024. The bottom backing layer 1017 which has a thickness 1024 where the backing 1017 is manufactured from a suitable backing material and has a suitable thickness 1024 that together provide sufficient abrasive disk 1018 strength and durability to resist dynamic abrading forces such that the bottom backing layer 1017 and the top backing layer 1026 do not individually or collectively rip or tear or crumple when the abrasive disk 1018 is subjected to abrading forces and abrading environments including water or water mist or chemicals that are present during the intended use of the abrasive disk 1018. The bottom backing layer 1017 truncated-arc segments 1016 and the top backing layer 1026 truncated-arc segments 1019 have staggered abrasive disk 1018 radial positions from each other where the top backing layer 1026 truncated-arc segments 1019 lap over the truncated-arc joint lines 1022 between the bottom backing layer 1017 truncated-arc segments 1016. The flexible annular abrasive disk 1018 has a central void-opening 1023.

Figure 43D:
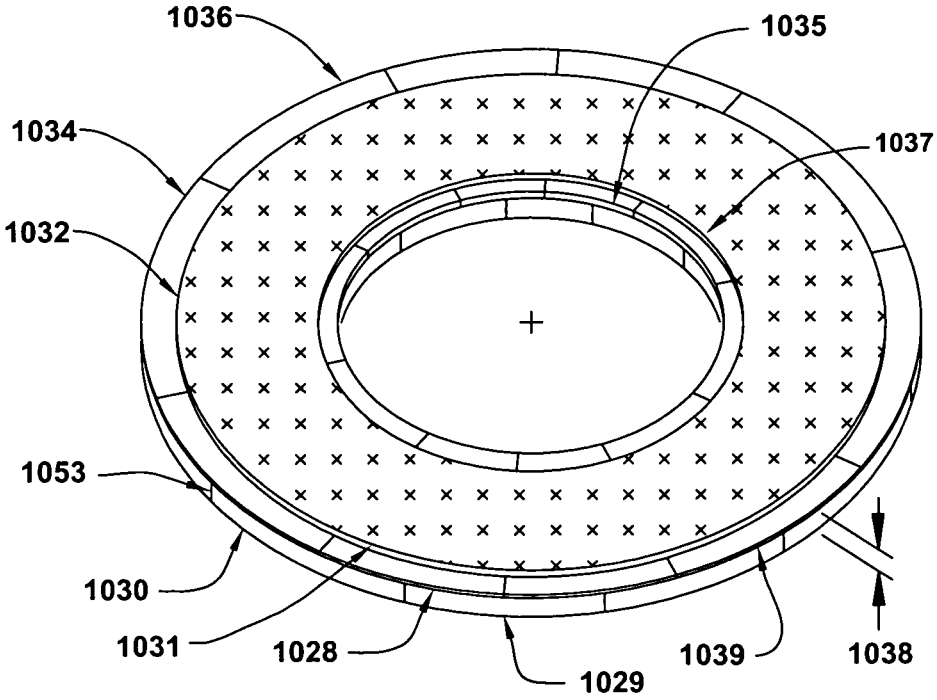
FIG. 43D is an isometric view of an annular heavy-duty disk with a layer of fixed-abrasive.

FIG. 43D is an isometric view of an annular heavy-duty abrasive disk where the abrasive disk is a laminated disk with a layer of fixed-abrasive. The flexible laminated disk 1034 has a flexible top backing layer 1039 that is attached to a flexible bottom backing layer 1029 where the top backing layer 1039 consists of pie-shaped truncated-arc segments 1028 that are bonded to the bottom backing layer 1029 pie-shaped truncated-arc segments 1030. The bottom backing layer 1029 can be constructed from a variety of materials including metal, fiber material, polymers and combinations thereof and the bottom backing layer 1029 has a thickness 1038. The bottom backing layer 1029 which has a thickness 1038 where the backing 1029 is manufactured from a suitable backing material and has a suitable thickness 1038 that together provide sufficient abrasive disk 1034 strength and durability to resist dynamic abrading forces such that the bottom backing layer 1029 and the top backing layer 1039 do not individually or collectively rip or tear or crumple when the abrasive disk 1034 is subjected to abrading forces and abrading environments including water or water mist or chemicals that are present during the intended use of the abrasive disk 1034. The bottom backing layer 1029 truncated-arc segments 1030 and the top backing layer 1039 truncated-arc segments 1028 have staggered abrasive disk 1034 radial positions from each other where the top backing layer 1039 truncated-arc segments 1028 lap over the truncated-arc joint lines 1033 between the bottom backing layer 1029 truncated-arc segments 1030. The flexible annular abrasive disk 1034 has a central void-opening 1023. A continuous flat-surfaced annular band of a thick layer of solid abrasive material 1032 is attached to the flexible laminated disk 1034 flexible top backing layer 1039 where the flexible bottom backing layer 1029 can be attached with vacuum or by other mechanical attachment devices (not shown) to a flat-surfaced rotary platen (not shown).

Figure 44:
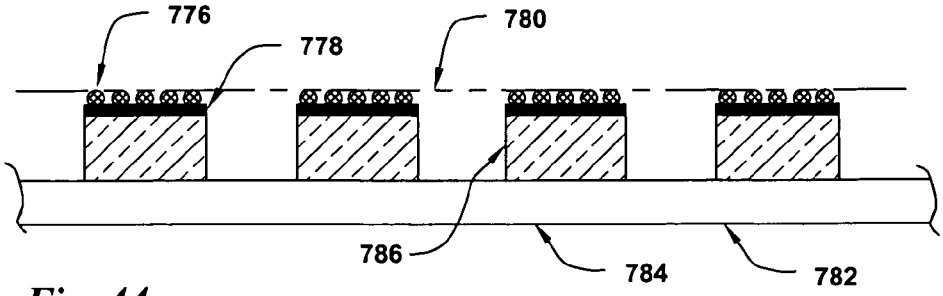
FIG. 44 is a cross section view of abrasive beads coated on raised island islands.

FIG. 44 is a cross section view of abrasive beads coated on raised island islands. Abrasive beads 776 are attached with a layer of adhesive 778 to raised islands 786 that are attached to an abrasive disk 784 flexible backing 782. The top surfaces of the beads 776 that are attached to all the islands 786 are precisely located in a common plane 780 to provide uniform workpiece (not shown) abrading when the disk 784 is attached to a rotating platen (not shown). The raised islands 786 prevent hydroplaning of the workpieces when the abrasive disk 784 is operated at very high abrading speeds in the presence of workpiece coolant water.

Figure 45:
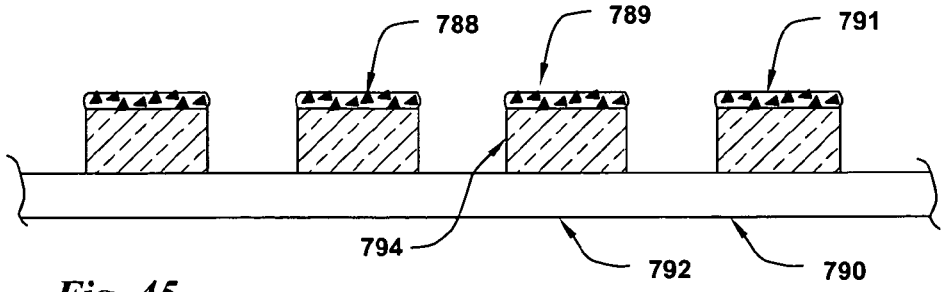
FIG. 45 is a cross section view of abrasive slurry coated on raised island islands.

FIG. 45 is a cross section view of abrasive slurry coated on raised island islands. Abrasive slurry coating 788 containing abrasive particles 789 in an adhesive binder 791 is coated as a coating 788 layer on to the top surfaces of raised islands 794 that are attached to an abrasive disk 790 flexible backing 792.

Figure 46:
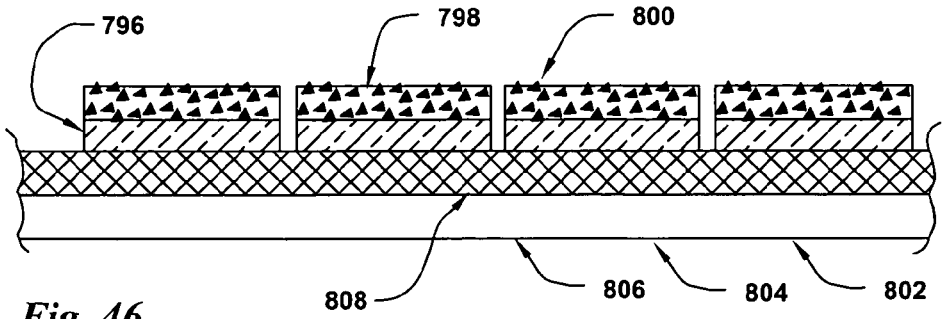
FIG. 46 is a cross section view of thick layers of abrasive coated on raised island islands.

FIG. 46 is a cross section view of thick layers of abrasive coated on raised island islands. A thick layer of solid abrasive material 798 is attached to rigid raised island structures 796 that are attached to a thick, strong and durable flexible backing 808 that is attached to a flexible backing 806 that has a smooth surface 804 that allows the thick abrasive disk 802 to be conformably attached to a flat-surfaced platen (not shown) with vacuum.

Figure 47:
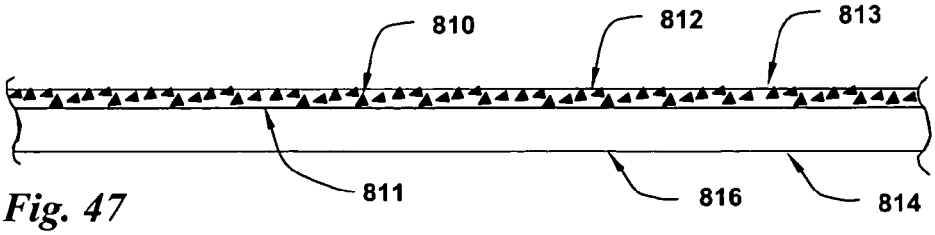
FIG. 47 is a cross section view of a continuous layer of abrasive coated on a disk backing.

FIG. 47 is a cross section view of a continuous layer of abrasive coated on a disk backing. Abrasive slurry coating 812 containing abrasive particles 810 mixed in an adhesive binder 813 is continuous-coated as an abrasive slurry coating 812 layer on to the top surface 811 of an abrasive disk 814 backing 816.

Figure 48:
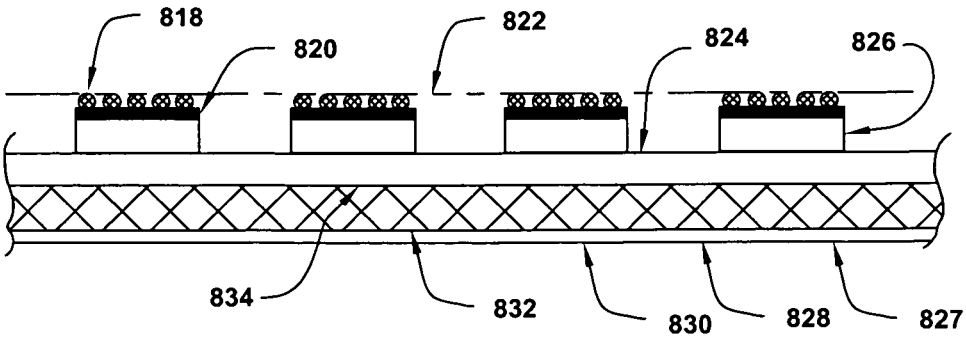
FIG. 48 is a cross section view of abrasive bead raised islands on a foam-backed disk.

FIG. 48 is a cross section view of abrasive bead raised islands on a foam-backed disk. Abrasive beads 818 are attached with a layer of adhesive 820 to raised islands 826 that are attached to an abrasive disk 828 flexible backing 824. A foam backing 832 is attached to the bottom surface 834 of the flexible backing 824. The flexible backing 830 having a smooth surface 827 is attached to the foam backing 832 to allow the abrasive disk 828 to be attached to the flat surface of a platen (not shown). The top surfaces of the beads 818 that are attached to all the islands 826 are precisely located in a common plane 822 to provide uniform workpiece (not shown) abrading when the disk 828 is attached to a rotatable platen (not shown).

Figure 49:
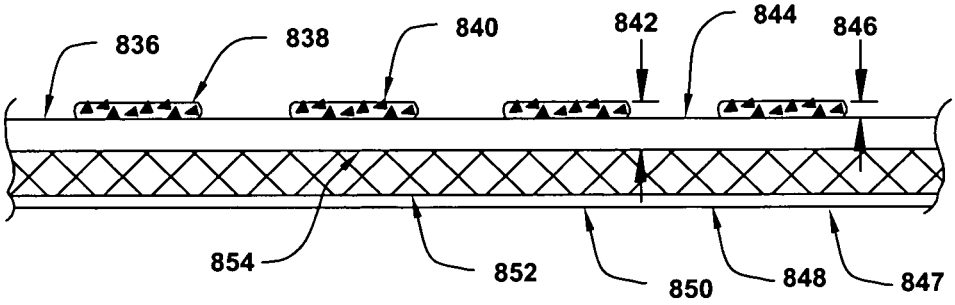
FIG. 49 is a cross section view of shallow-height abrasive raised islands on foam disk.

FIG. 49 is a cross section view of a chemical mechanical planarization (CMP) type of shallow-height abrasive raised islands on foam disk. Shallow-height abrasive islands 838 are attached a flexible backing 844. A foam backing 852 is attached to the bottom surface 854 of the flexible backing 844. A smooth surfaced backing 850 having a smooth surface 847 is attached to the foam backing 852 to allow the abrasive disk 848 to be attached to the flat surface of a platen (not shown). The top surfaces 840 of the shallow abrasive islands 838 are precisely equal in thickness 842 from the bottom side 854 of the flexible backing 844 to assure uniform abrading of the abrasive disk 848. Each of the shallow raised islands 838 have a height 846 measured from the top surface of the backing 844 that is only approximately 0.001 inch high. The shallow raised islands 838 can be molded on to the top surface of the backing 844 or the islands 838 can be coated on the top surface of the backing 844 by a gravure coating process.

Figure 50:
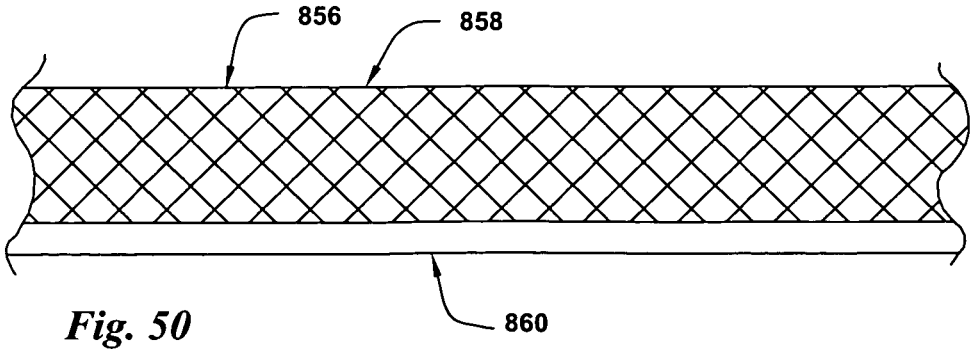
FIG. 50 is a cross section view of a CMP resilient foam pad attached to a disk backing.

FIG. 50 is a cross section view of a chemical mechanical planarization (CMP) type of resilient foam pad attached to a disk backing. A CMP-type abrasive disk 856 has a porous resilient foam pad 858 attached to a polymer or metal flexible backing 860 that allows the flexible abrasive disk 856 to be attached to the flat surface of a rotating platen (not shown). A liquid mixture containing loose abrasive particles can be applied to the porous pad 858 abrasive disk 856 as the flexible disk 856 is rotated while in abrading contact with one or more workpieces (not shown) that are attached to fixed-position workpiece rotating spindles (not shown).

Figure 51:
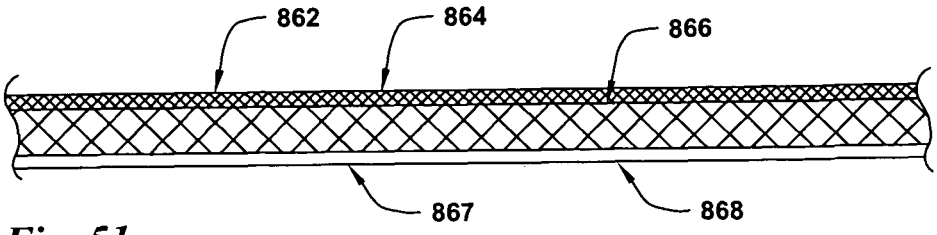
FIG. 51 is a cross section view of a CMP resilient foam pad with a top surface nap layer.

FIG. 51 is a cross section view of a CMP resilient foam pad with a top surface nap layer. A flexible abrasive disk pad 862 has an attached top porous nap layer 864 that is attached to a base layer 866 that is attached to a smooth-surfaced backing layer 868. The base layer 866 comprises a resilient foam material or a semi-rigid polymer material or a fiber material. The use of the backing layer 868 is optional as it provides a sealed bottom surface 867 to the disk pad 862 that allows the disk 862 to be attached to a rotary platen (not shown) by a vacuum disk attachment system. A liquid slurry (not shown) containing lose abrasive particles is applied to the porous nap layer 864 that is flat abrading contact with workpieces (not shown).

Figure 52:
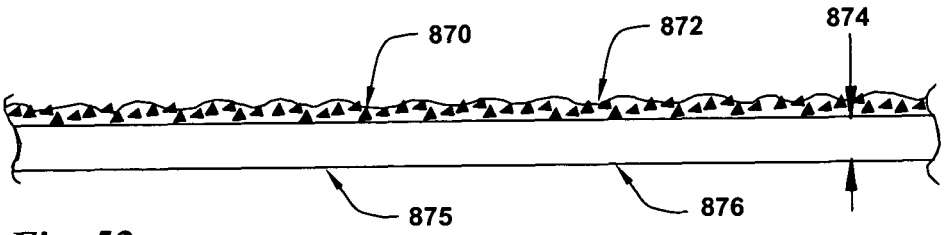
FIG. 52 is a cross section view of a flat disk covered with an abrasive slurry layer.

FIG. 52 is a cross section view of a flat disk covered with an abrasive slurry layer. A flexible metal abrasive slurry disk 876 is shown coated with a liquid slurry mixture 872 containing lose abrasive particles 870. The disk 876 has a precision-thickness 874 over its full annular abrading surface and also has a smooth mounting surface 875 that provides a sealed surface that allows the disk 876 to be attached to a rotary platen (not shown) by a vacuum disk attachment system.

Figure 53:
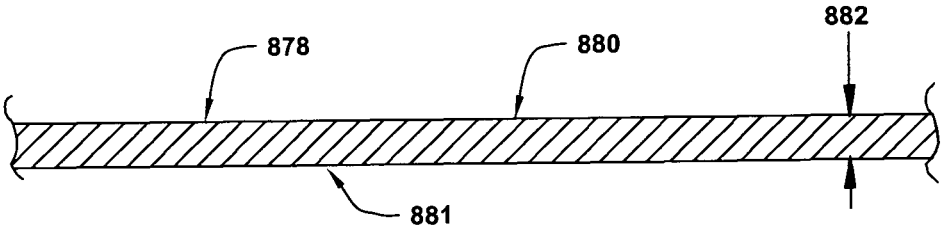
FIG. 53 is a cross section view of a flat disk cover used for abrasive slurry.

FIG. 53 is a cross section view of a flat disk cover used for abrasive slurry. A flexible metal abrasive slurry disk 878 is shown without a liquid slurry mixture. The disk 878 has a precision-thickness 882 over its full annular abrading surface and the disk 878 has a precision-flat abrading surface 880 over its full annular abrading surface. The disk 878 has a smooth mounting surface 881 that provides a sealed surface that allows the disk 878 to be attached to a rotary platen (not shown) by a vacuum disk attachment system.

Figure 54:
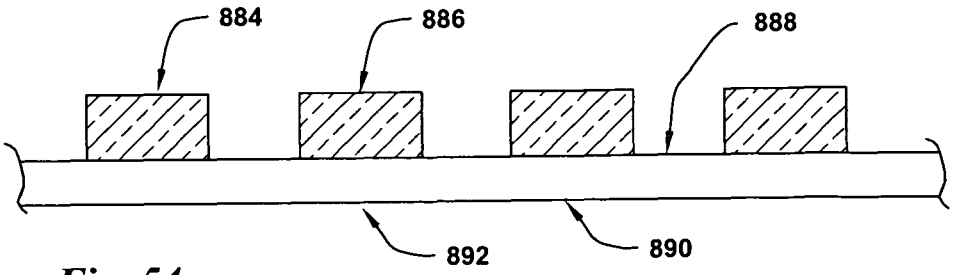
FIG. 54 is a cross section view of raised island structures attached to a backing disk.

FIG. 54 is a cross section view of non-abrasive-coated raised island structures attached to a backing disk. Raised island structures 884 have island flat top surfaces 886 that are precisely co-planar with each other and that are also precisely co-planar with a non-abrasive disk 888 backing 890 bottom mounting surface 892. The island structures 884 that are attached to the non-abrasive disk 888 flexible backing 890 do not have an abrasive coating. These flexible non-abrasive disks 888 can be attached at the backing surface 892 to a platen (not shown) for use as an abrading device by applying a liquid abrasive slurry (not shown) to the raised island structures 884 flat top surfaces 886 and rotating the disk 888 when workpieces (not shown) are in flat-surfaced contact with the raised island structures 884 flat top surfaces 886.

The same type of non-abrasive disk 888 that has raised island structures 884 that have island 884 flat top surfaces 886 that are precisely co-planar with each other and that are also precisely co-planar with a non-abrasive disk 888 backing 890 bottom mounting surface 892 can also be used to produce abrasive coated raised island disks (not shown) by coating the island 884 top flat surfaces 886 with a layer of abrasive material (not shown).

Figure 55:
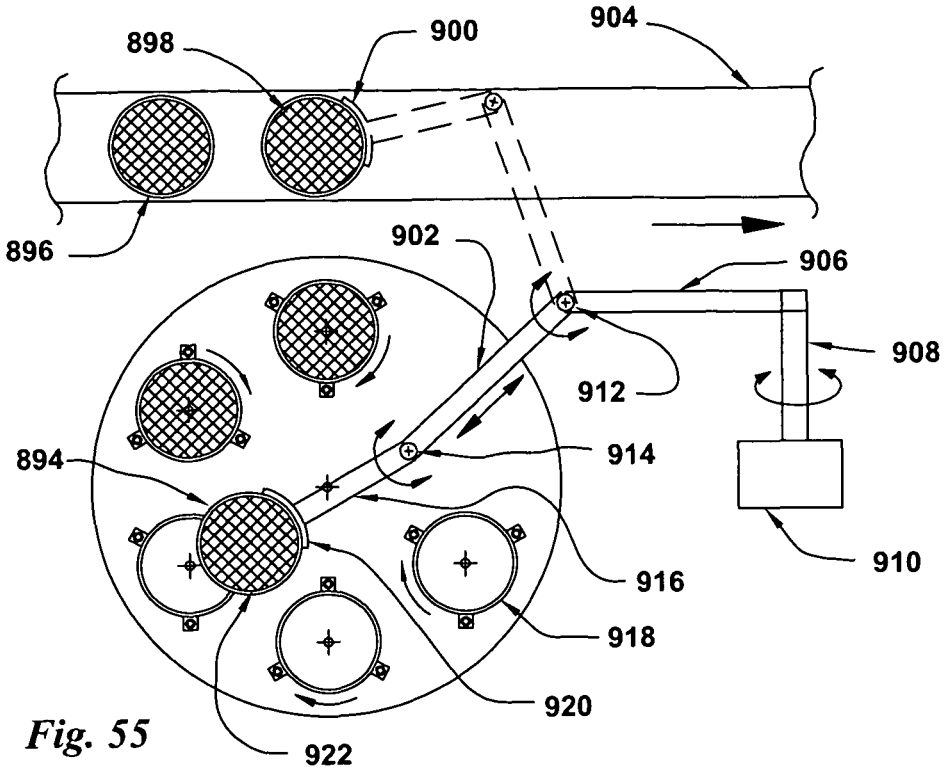
FIG. 55 is a top view of an automatic robotic workpiece loader for multiple spindles.

FIG. 55 is a top view of an automatic robotic workpiece loader for multiple spindles. An automated robotic device 910 has a rotatable shaft 908 that has an arm 906 to which is connected a pivot arm 902 that, in turn, supports another pivot arm 916. A workpiece carrier holder 920 attached to the pivot arm 916 holds a workpiece carrier 922 that contains a workpiece 894 where the robotic device 910 positions the workpiece 894 and carrier 922 on and concentric with the workpiece rotary spindle 918. Other workpieces 898 and carriers 896 are shown on a moving workpiece transfer belt 904 where they are picked up by the carrier holder 900. The workpieces 894 and 898 and workpiece carriers 922, 896 can also be temporarily stored in other devices comprising cassette storage devices (not shown). The workpieces 894, 898 and workpiece carriers 922, 896 can also be removed from the spindles 918 after the workpieces 894, 898 are abraded and the workpieces 894, 898 and workpiece carriers 922, 896 can then be placed in or on a moving belt (not shown) or a cassette device (not shown). The workpieces 894, 898 can also optionally be loaded directly on the spindles 918 without the use of the workpiece carriers 922, 896. Access for the robotic device 910 is provided in the open access area between two wide-spaced adjacent spindles 918.

Figure 56:
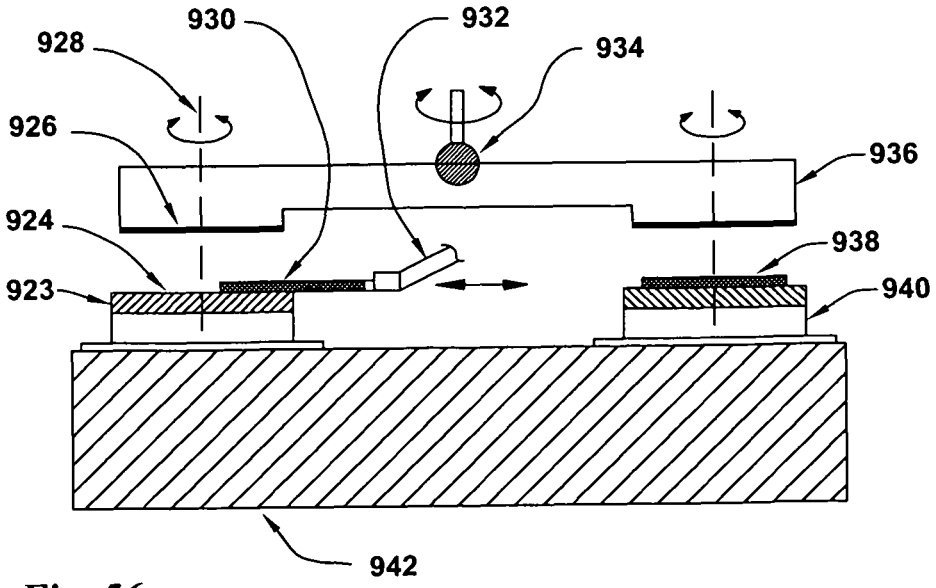
FIG. 56 is a side view of an automatic robotic workpiece loader for multiple spindles.

FIG. 56 is a side view of an automatic robotic workpiece loader for multiple spindles. An automated workpiece loader device 932 (partially shown) can be used to load workpieces 930, 938 onto spindles 940 that have spindle tops 923 that have flat surfaces 924 and where the spindle tops 923 rotate about the spindle axis 928. A floating platen 936 that is rotationally driven by a spherical-action device 934 has an annular abrasive surface 926 that contacts the equal-thickness workpieces 930 and 938 where the platen 936 is partially supported by abrading contact with the three independent near-equal spaced three-point spindles 940 and the abrading pressure on the workpieces 930 and 938 is controlled by controlled force-loading of the spherical action device 934. The spindles 940 are supported by a granite machine base 942.

Figure 57:
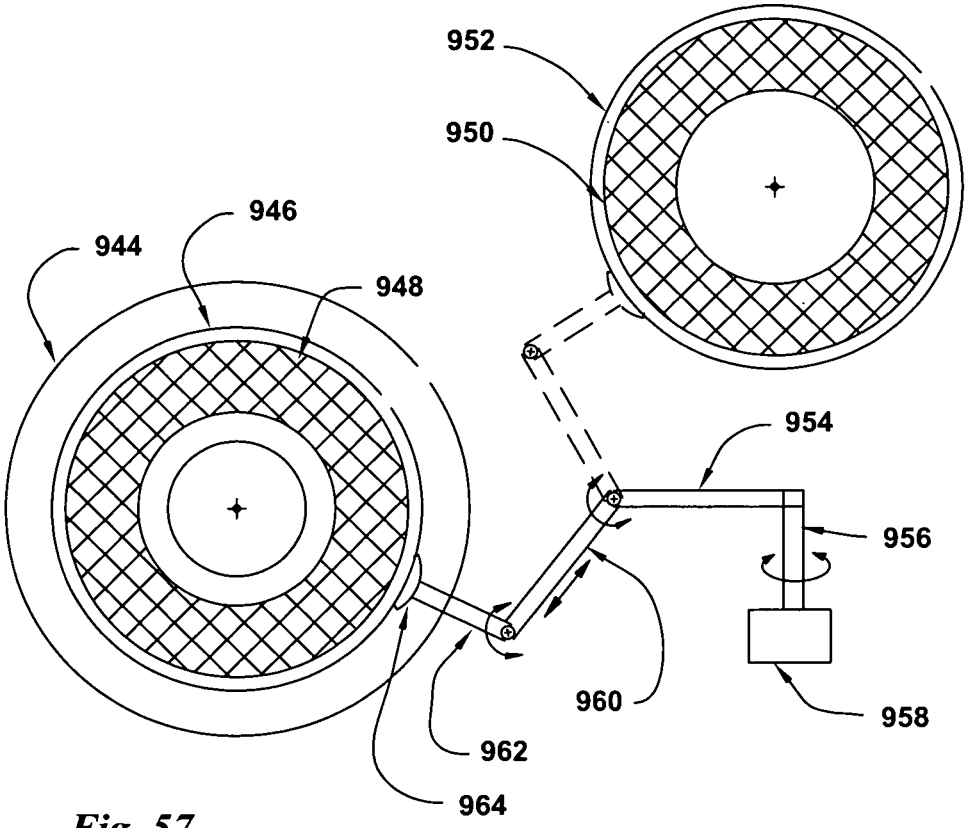
FIG. 57 is a top view of an automatic robotic abrasive disk loader for an upper platen.

FIG. 57 is a top view of an automatic robotic abrasive disk loader for an upper platen. An automated robotic device 958 has a rotatable shaft 956 that has an arm 954 to which is connected a pivot arm 960 that, in turn, supports another pivot arm 962. An abrasive disk carrier holder 964 attached to the pivot arm 962 holds an abrasive disk carrier 946 that contains an abrasive disk 948 where the robotic device 958 positions the abrasive disk 948 and disk carrier 946 on and concentric with the platen 944. Another abrasive disk 950 and abrasive disk carrier plate 952 are shown in a remote location where the abrasive disk 950 can also be temporarily stored in other devices comprising cassette storage devices (not shown). Guide or stop devices (not shown) can be used to aid concentric alignment of the abrasive disk 948 and the platen 944 and the robotic device can position the abrasive disk 948 in flat conformal contact with the flat-surfaced platen 944 after which, vacuum (not shown) is applied to attach the disk 948 to the platen 944 flat abrading surface (not shown). Then the pivot arms 962, 960 and 954 and the carrier holder 964 and the disk carrier 946 are translated back to a location away from the platen 944.

Figure 58:
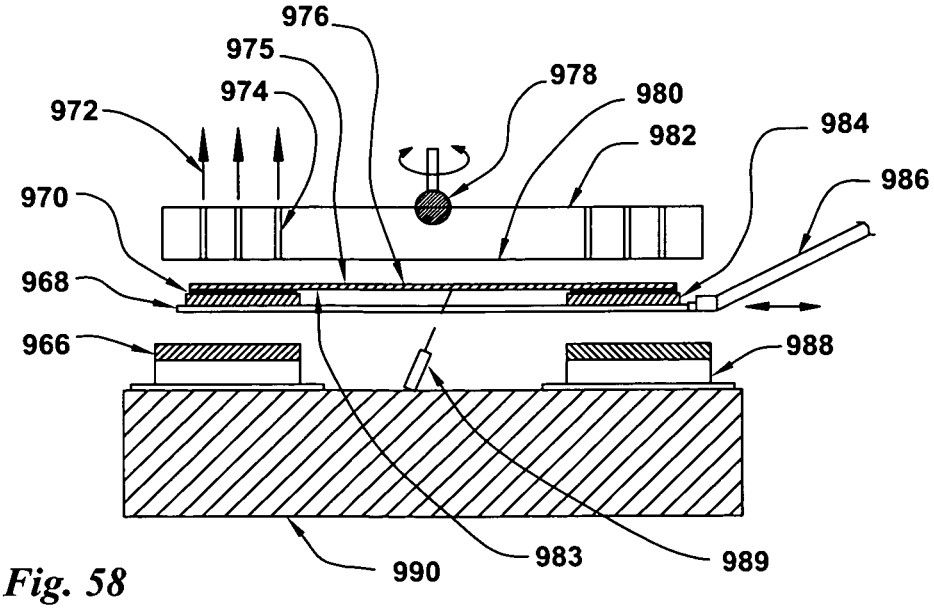
FIG. 58 is a side view of an automatic robotic abrasive disk loader for an upper platen.

FIG. 58 is a side view of an automatic robotic abrasive disk loader for an upper platen. An automated robotic device 986

(partially shown) has a carrier holder plate 968 that has an attached resilient annular disk support pad 984 that supports an abrasive disk 976 that has an abrasive layer 970. The abrasive disk carrier holder 968 that contains the abrasive disk 976 is moved whereby the robotic device 986 positions the abrasive disk 976 and disk carrier 968 on to and concentric with the platen 982. The resilient layer pad 984 attached to the carrier holder 968 allows the back-disk-mounting side 975 of the abrasive disk 976 to be in flat conformal contact with the platen 982 abrading surface 980 before the vacuum 972 that is present in the platen 982 vacuum ports 974 is activated. The platen 982 has vacuum 972 that is applied through vacuum port holes 974 to attach the abrasive disk 976 to the abrading surface 980 of the platen 982. The floating platen 982 is driven rotationally by a spherical action device 978 to allow abrading surface 983 of the abrasive disk 976 that is attached to the floating platen 982 abrading surface 980 to be in flat abrading contact with equal-thickness flat-surface workpieces (not shown) that are attached in flat surface contact to the flat top surface of the rotating spindle-top component 966 of at least three each three-point spindles 988 (one not shown) that are mounted on a granite base 990. After the abrasive disk 976 is attached to the platen 982 the robotic device 986 carrier holder 968 is withdrawn from the platen 982 area.

An optical sensor device 989 is attached to the granite machine base 990 to monitor the status and condition of the floating platen 982 abrading surface 980 and to monitor the abrasive disk 976 and also to monitor the condition of the abrading surface 983 of the abrasive disk 976 after attachment and during the abrading procedure operation. The optical sensor device 989 can be air-purged to prevent fouling of the optical sensor with coolant water spray or abrading debris.

Figure 59:
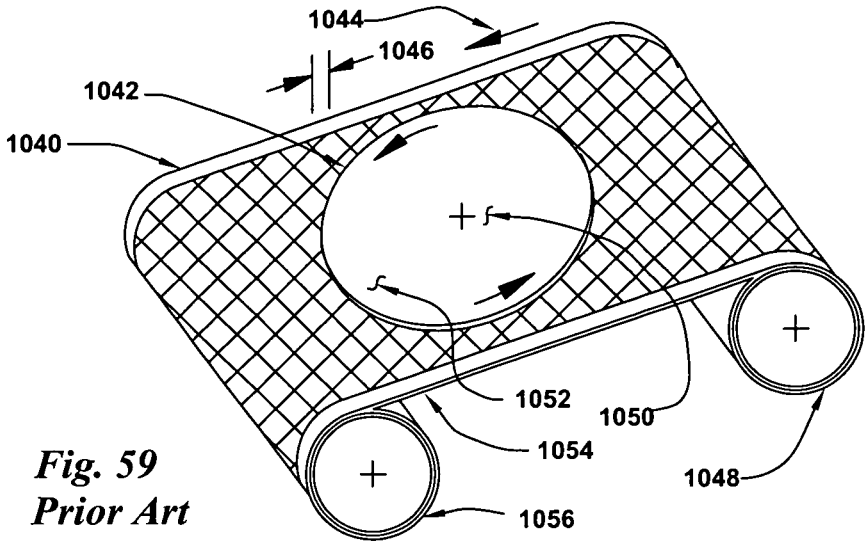
Fig. 59 Prior Art
FIG. 59 is an isometric view of a workpiece on a fixed-abrasive CMP web polisher.

FIG. 59 is an isometric view of a workpiece on a fixed-abrasive CMP web polisher. A fixed-abrasive CMP-type web polisher 1040 has a flat mid-section and it has a web winder roll 1056 and a web unwind roll 1048 that advances the shallow-island fixed-abrasive flexible web 1054. The web 1054 is stationary during the flat workpiece 1042 polishing action and the web 1054 advances forward an incremental distance 1046 in the direction 1044 when a new workpiece 1042 is polished. The workpiece 1042 rotates with a high abrading speed at the outer periphery area 1052 of the workpiece 1042 and with a near-zero workpiece abrading speed at the inner portion area 1050 of workpiece 1042. Because the abrasive web 1054 is not attached to the flat web 1054 support plate (not shown) under the web 1054, the abrasive web 1054 can be wrinkled by the rubbing action of the rotating workpiece 1042.

Figure 60:
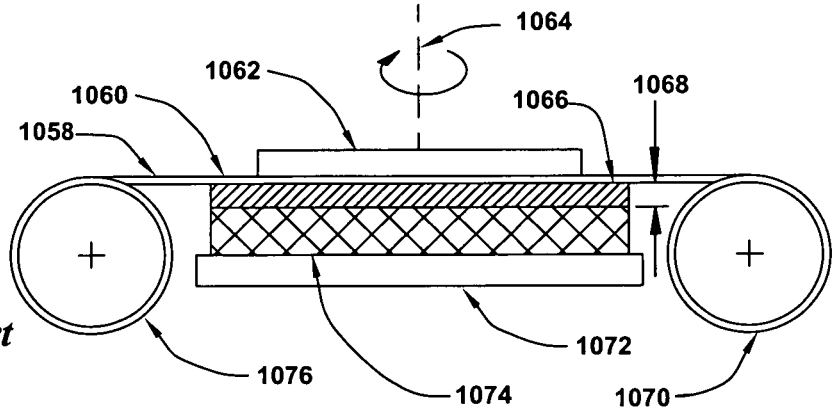
Fig. 60 Prior Art
FIG. 60 is a cross section view of a workpiece on a fixed-abrasive CMP web polisher.

FIG. 60 is a cross section view of a workpiece on a fixed-abrasive CMP web polisher. A fixed-abrasive CMP-type web polisher 1058 has a flat mid-section and it has a web winder roll 1076 and a web unwind roll 1070 that advances the shallow-island fixed-abrasive flexible web 1060. The shallow-island abrasive web 1060 is stationary during the flat workpiece 1062 polishing action procedure and the workpiece 1062 rotates about an axis 1064 while the fixed-abrasive web 1060 is stationary. The flexible fixed-abrasive web 1060 is supported by a rigid, or semi-rigid, polymer, or other material, flat-surfaced stationary plate 1066. The stationary web support plate 1066 has a dimensional thickness 1068 that determines the stiffness of the web support platen 1066. The web support plate 1066 is attached to a resilient support base 1074 that is supported by a rigid web polisher 1058 base 1072. The resilient support base 1074 allows the web support plate 1066 to tilt or to deform locally to provide near-flat-surface abrading contact with the rotating flat-surfaced workpiece 1062. Typically the resilient support base 1074 material has reduced-elastic deformation characteristics where some time period is required before the deformed material is restored to its original position after it was deformed by a high-spot area of a contacting rotating workpiece 1062. Here, the support base 1074 material experiences a motion-damping type of time delay in that it does not dimensionally respond quickly when it is allowed to return to its original shape after a surface deformation-causing force is removed. This damping-type of dimensional response prevents full abrading pressure contact to a moving low-spot area of the moving workpiece 1062 that follows the high-spot area, especially if the workpiece 1062 is rotated at high speeds. The result is that the support base 1074 is not able to flex sufficiently fast to accommodate surface-defect variations of the abraded surface of the rotating workpiece 1062 whereby undesirable non-uniform abrading action is applied across the abraded surface of the workpiece 1062.

The workpiece 1062 is typically a thin semiconductor wafer that is exceedingly flat. However, the flat top surface of the web support base 1066 that is in direct contact with the abrasive web 1060 typically has a flatness-variation accuracy that is significantly less than the flatness-variation accuracy of the semiconductor workpieces 1062. Also, the abrading surface of the fixed-abrasive shallow-island web 1060 has undesirable non-uniform down-stream web thickness variations. These variations occur because the web 1060 abrasive surface is worn-down progressively as it advances incrementally with the sequential introduction of new workpiece 1062 semiconductor wafers that are polished on the same portion of the shallow-island web 1060 used to polish previous-polished workpieces 1062.

Because the flexible abrasive web 1060 is constructed from a thin polymer web material and the shallow islands have such small heights, this shallow-island abrasive web 1060 has a high structural stiffness in the direction perpendicular to the flat surface of the web 1060. Here, the high-spot non-planar imperfection areas of the web support plate 1066 are directly translated to the localized web 1060 abrasive contact areas with the flat surface of the wafer workpiece 1062.

Intentional out-of-plane flexing of the thin wafer workpieces 1062 can increase the sizes of the localized mutual abrading contact areas between portions of the wafer workpiece 1062 and the abrasive web 1060. However, most wafer-type workpieces 1062 are typically mounted on rigid flat-surfaced carriers (not shown) that do not provide out-of-plane flexing of the workpiece 1062 to match surface variations of the supporting plate 1066.

The workpiece 1062 has a rotation axis 1064 and the abrading speed at the portion of the workpiece 1062 near the workpiece 1062 rotation axis is near-zero and the abrading speed near the outer periphery of the rotating workpiece 1062 is maximum. The CMP-type abrading speed varies proportionally across the radial portion of the rotating workpiece 1062. Because the abrasive web 1060 is stationary, the abrasive web 1060 does not contribute any abrading speed to any portion of the abraded surface of the flat-surfaced rotated workpieces 1062. Here, the material removal rate from the workpiece 1062 ranges from near-zero at the radial center of the workpiece 1062 that is close to the workpiece 1062 rotational axis 1064 to a large material removal rate at the outer periphery of the rotating workpiece 1062 instead of the desired uniform material removal rate across the full abraded surface of the workpiece 1062.

Figure 61:
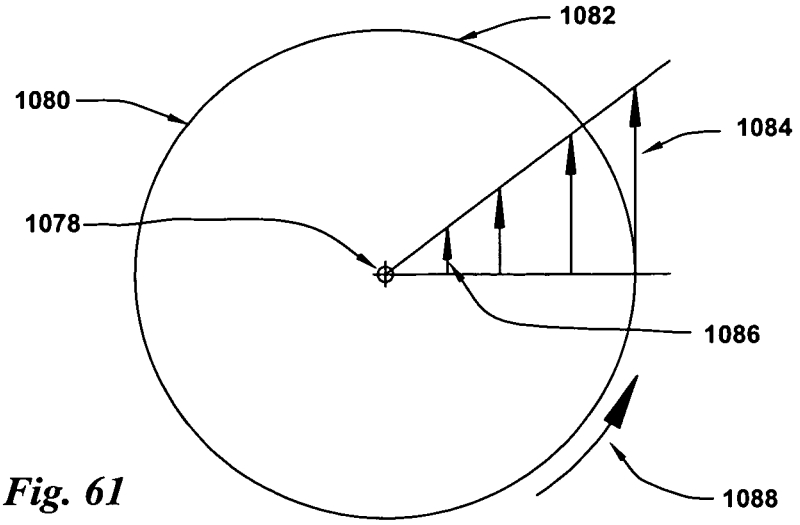
FIG. 61 is a top view of a rotating workpiece on a fixed-abrasive CMP web polisher.

FIG. 61 is a top view of a rotating workpiece on a fixed-abrasive CMP web polisher. The workpiece 1080 rotates in a direction 1088 about an axis 1078 where the workpiece 1080 has a maximum abrading speed 1084 at the outer periphery

1082 of the workpiece 1080 and a minimum abrading speed 1086 near the workpiece 1080 center and an abrading speed of zero at the workpiece 1080 rotation axis 1078 location High Speed Lapping Machines A. Lapper Machine Configuration A preferred configuration of a high speed lapper machine is one having a stable massive granite base and that has a large diameter platen that remains precisely flat over long periods of time and at all speeds of operation. Air bearings are used to support the platen to provide precision platen flatness accuracy at reasonable machine costs. Also, air bearings are used to support the workpiece holder spindle to provide precise friction free control of the abrading contact pressure over the different phases of the lapping operation. Abrading force control and mechanism weight counterbalance is provided by friction free air bearing pressure cylinders that are supplied by electronically controlled air pressure.

The upper portion of the lapper machine is an independent structure unit that allows the workpiece holder axis to be adjusted perpendicular to the plane of the abrasive. This upper machine portion also provides X-Y translation of the workpiece holder to traverse the workpiece surface across the full annular surface of the abrasive during a lapping operation. This traversing action provides even wear across the surface of the workpiece and also the abrasive. Multiple workpiece stations positioned around the circumference of the platen allow a number of workpiece to be processed at the same time. Force and position sensors, including precision capacitive sensors, are used to sense and control the lapper machine devices and determine the state of completion or surface finish characteristics or the workpieces as they are processed. Drive motors allow the speed of the workpiece rotation and the speed of the platen to be changed continuously during a lapping procedure.

Programmable controllers are used to automate the abrading operation of the lapper for each workpiece. Vacuum is supplied to the platens for installation and removal of the different raised island abrasive disks. Water is supplied for use as an abrading coolant. The platen is surrounded by a retaining wall that collects spent coolant water and the abrading debris is separated from the waste water for collection and disposal. The coolant water also continuously washes the abrasive disks which simplifies the repetitive reuse of disks.

B. Lapper Machine Platens

1. Precision-Flat Platen Surface

The platens must have surfaces that are and remain precisely flat at all operating speeds to allow the interchange of abrasive disks having different abrasive particle sizes. The peripheral abrading speed of these platens exceeds 10,000 surface feet per minute. To attain these abrading speeds, small diameter platens must rotate at very high speeds but large diameter platens can rotate slower. Vacuum port holes located at the outer annular periphery of the platens allow the flexible raised island abrasive disks to be quickly attached to the platen surfaces.

2. Types of Platen Spindle Assemblies a. Small Platen Commercial Spindles

Platen vacuum disk attachment interface plates can be mounted on the top flat surfaces of commercially available rotary spindles. These spindles are unitary closed-frame devices. Most roller bearing spindles have limited rotational speeds because of the heat generated by the pre-loaded bearings that support the spindle shaft. Small diameter platens must have high rotational speeds for high speed flat lapping. To reach 10,000 SFM speeds a 12 inch diameter platen must operate at 3,200 rpm. Air bearing spindles can operate at high rotational speeds but have significant load force limitations. They are particularly sensitive to over-hanging forces which significantly limits the size of the vacuum interface plates that are mounted on them. Nominally very small abrading contact forces are imposed on a platen during high speed lapping. However, occasional large platen load forces can be experienced in the event where a thin abrasive disk becomes torn and is wedged between the workpiece holder and the high-inertia moving platen.

b. Large Platen Air Bearing Spindles

Platen assemblies used for large diameter abrasive disks have a unique open-frame construction. The horizontal platen assembly is supported at the outer periphery by air bearing pads that control the platen planar surface motion only in a vertical direction perpendicular to the platen surface. A simple platen-center axial needle bearing can be used to control only the radial position of the platen. The needle bearing also allows free platen assembly axial motion in the direction perpendicular to the platen surface. In this way, the air bearing pads provide very precision vertical control of the platen planar surface as they are not constrained axially by the needle bearing. Precision control of the platen radial motion is not required for high speed flat lapping so inexpensive needle bearings are sufficient for the application.

The air bearing platen assembly is constructed of materials that are free from residual stresses to provide a low inertia rigid structure that is dimensionally stable over long periods of time. The platen assembly uses a three-point support to maximize the platen dimensional stability independent of the lapper machine base support frame. Three equal spaced air bearing pads are positioned around the periphery of the platen structure to support the platen assembly. These air bearing pads have large surface areas that contact a smooth annular rail that is attached to the bottom of the platen assembly. These large contact areas allow each air bearing pad to sustain large loading forces without the occurrence of any damage to the pads or to the platen assembly. In addition, the structural rigidity of the composite platen assembly distributes localized load forces to adjacent air pads in the event of an abrasive disk tearing and jamming-up as the platen rotates.

Single or multiple workpiece lapping stations are located directly above the platen assembly air bearing pads. If desired, extra air bearing support pads and work stations can also be positioned between the three primary three-point support pads.

C. Granite Machine Bases

1. Selection of Granite Base Material

Granite is dimensionally a very stable structural material and has sufficient mass to attenuate machine vibrations. It can be formed into many different shapes and can be fitted with fasteners that can be used to mount lapping machine members. Also, water passageways can be drilled to provide temperature control of portions of the granite base to minimize thermal distortion of the base. In addition, granite bases can be machined to provide precision flat surfaces that are very stable with time. Here, a granite base is typically has a three-point support during the surface machining operation.

2. Shape of Granite Bases

A variety of granite base shapes can be used to optimize the function of the lapper machine. These include rectangular, triangular and donut shapes.

3. Support of Granite Bases

When a granite base is used, the same three-point support that was used to machine the base is retained in the lapper machine to minimize base surface distortions due to the weight of the granite base.

4. Platen Assembly Support

The platen assembly also has a tree-point support to minimize distort of three points. In addition, the primary support for the workpiece holder assembly is supported at the same three points as the platen assembly. This assures that any localized dimensional change in the base is simultaneously transmitted to both the platen support and the workpiece holder assembly. Here they both will move together and retain their relative alignment. This is important when using a rigid workpiece spindle assembly. However, in the more common case where the workpiece holder has a floating spherical motion, this mutual alignment is not so important.

D. Gauges Determine Workpiece Completion

As workpieces become more flat and smooth, the stiction forces between the workpieces and the abrasive become larger. These large stiction forces also act on the workpiece holder devices and on the workpiece holder spindle mechanisms. Here, the stiction forces tend to bend or deflect certain of the lapper machine component parts away from other adjacent parts. This increases the nominal gap between the adjacent parts. Because all of the machine components have known linear or non-linear spring constant characteristics, larger stiction forces result in predictable larger deflections and larger gaps. A measurement of the gap distance change can provide an accurate indication of the magnitude of the stiction forces. In turn, the magnitude of the stiction force is a predictable measure of the state of completion of the lapping procedure. This knowledge allows the lapping procedure to be terminated when the procedure is completed.

Capacitance gauges and eddy current gap distance sensing gauges can be used to dynamically determine the state of completion of a workpiece as it is being subjected to high speed lapping. Also, force or deflection sensing gages such as strain gages can be used to sense the magnitude of the stiction forces.

E. Rotary Platen Accuracy

In order to provide ultra flat raised island abrasive surfaces for high speed flat lapping the rotary platens that the abrasive disks are mounted on must also be precisely flat. These platens must be flat over the full circumference of the annular abrasive and they must remain flat at all operating speeds. In addition the platens must remain flat over the full time that the lapper machine is operated on a daily or monthly basis. Special care is exercised in the design of the lapper machine and with the use of operating process procedures to assure that this platen flatness accuracy is held to the required specifications, especially with large diameter platens. Typically the platen abrading surface flatness must be held to less than 0.0001 inches on platens that can have platen diameters that exceed 3 feet where the surface speed of the platen exceeds 100 mph. Traditional roller bearings that can provide these platen flatness accuracies are not operated at these high rotational speeds. However, air bearings can be used to support the abrasive disk platen with the required precision flatness at these high speeds. Here, the structural distortions of the platen assembly due to thermal contraction from the cooling effects of the expanding air bearing pressurized air can be avoided by using a special thermally isolated annular air bearing support rail.

A wide size range of abrasive disk diameters or abrasive disk annular radial widths can be used with a given sized platen. The outer diameter of the platen simply has to be larger than the largest diameter of the abrasive disks.

F. Very Large Sized Platens

Platens having 144 inch diameters, used for the very large raised island disks, can also be built using air bearings that support the outer periphery of the platen directly underneath the annular band of abrasive. The platen structure is fabricated from stress-free materials, such as cast aluminum plate, that are structural-adhesive bonded together to provide stable platens that remain flat over long periods of time. It is only necessary to lap the structure lower air bearing rail surface and the top outer annular surface of the platen where the annular band of abrasive is located. The bottom rail surface can be lapped by a number of different well established lapping processes. This same lower rail surface can be used to lap the top platen surface. Here, a simple air bearing pad mechanism supports a platen-surface lapping device, or grinder, while the mechanism is rotated tangentially around the flat-lapped air bearing rail. These very large platens and lapper machines can be manufactured by numerous special machine companies.

G. Progressive Use of Finer Abrasive Particles

Abrasive disks are typically used in sets of three abrasive particles sizes. The first disk has coarse sized particles to remove the large out-of-plane defects and establish the nominal flatness of a workpiece. The second disk has medium sized particles to further refine the flatness and develop a smoother surface. The third disk has very fine particles to polish the workpiece where the surface is both precisely flat and very smooth.

To provide an even more smoothly polished workpiece than do the spaced abrasive beads, a fourth disk can be used that has a continuous layer of very fine abrasive particles coated on the island tops. The abrasive is a mixture of abrasive particles and an adhesive that is flat-coated on the surface of the raised islands.

H. Abrasive Disk Flatness-Initialization Procedure

A new unused abrasive disk will always conform to the surface of a platen. A platen that has flatness variations will result in an abrasive surface that replicates these non-flat surface variations. However, the top abrading surface of the new abrasive disk will develop a precision planar surface after abrading contact with a workpiece as the platen rotates. Any thickness variations in the abrasive disk and any localized platen out-of-plane flatness variations will be removed during this lapping initialization process. Once an abrasive disk-flatness is initialized with a given platen, that disk can be removed and be reinstalled at a later time at the same tangential position on that platen to instantly provide a disk abrasive planar surface attribute. The flatness variation of a "initialized" disk abrasive surface is substantially less than the prescribed 0.0001 inch flatness variation tolerance that is established for the platen surface and for the 0.0001 inch thickness variation tolerance for the abrasive disk.

I. Vacuum Attachment of Disks to the Platens

Abrasive disks must be repetitively attached and removed from the lapping machine platens to complete the high speed flat lapping of workpieces. The abrasive disks are flexible and the disk backings have flat mounting surfaces that can provide a vacuum seal when the disks are mounted with vacuum to a flat platen surface.

The vacuum disk attachment system provides huge forces that bond the thin flexible raised island abrasive disks to the robust flat surfaced platens. These bonding forces are so large because all of the vacuum force of 10, or more, psig is applied to each square inch of surface area of an abrasive disk. At a modest 10 psig vacuum, a small sized 12 inch diameter abrasive disk having a surface area of 113 inches squared, results in a disk attachment bonding force of 1,130 lbs. With a perfect vacuum of 14.7 psig the disk hold-down bonding force is 1,661 lbs. These large disk attachment forces assure that the abrasive disks are in full conformal contact with the precision-flat platen surface. Here, the top flat planar surface of the abrasive disk assumes the precision flatness of the platen. The abrasive surface is simply off-set fro the platen by the precision thickness of the disk. Use of vacuum to attach precision thickness raised island abrasive disks to the precision flat platens results in an planar abrasive surface that is precisely flat and therefore, capable of high speed flat lapping.

Each platen-mounted raised island abrasive disk is rigid in a direction perpendicular to the disk surface. As a result, the typical small contact abrading forces applied to the disk have little effect on distorting the thickness of the disk. The abrading contact forces acting in a direction perpendicular to the abrasive surface are intentionally small because of the extraordinary cut rates of the abrasive particles at the high speeds used in high speed flat lapping. Friction forces in a direction parallel to the abrasive surface, due to the contact abrading forces, are correspondingly small. Also, the raised islands prevent large stiction-type disk shearing forces (from the coolant water) to act parallel to the flat surface of the moving disks. These small disk surface liquid shearing forces and friction forces have little effect on the disk because the disk is bonded to the structurally stiff platen by the huge vacuum disk attachment forces.

Platen surfaces have patterns of vacuum port holes that extend under the abrasive annular portion of an abrasive disk to assure that the disk is firmly attached to the platen surface. Use of the vacuum disk attachment system assures that each disk is in full conformal contact with the platen flat surface. Also, each individual disk can be marked so that it can be remounted in the exact same tangential position on the platen by using the vacuum attachment system. Here, a disk that is "worn-in" to the flatness variation of a given platen will recapture that registered platen position and will not have to be "worn-in" again upon reinstallation.

When an abrasive disk is partially worn down, the top surface of the abrasive wears-in to assume a true planar flatness even when there are very small out-of-plane defects in the platen surface. After usage, this disk can be removed to be temporarily replaced by a disk having different sized abrasive particles. However, before the disk is removed from a platen, the disk and the platen are marked at a mutual tangential location. Then when the original disk is re-mounted on the same platen, the marking on the disk is tangentially aligned with the marking on the platen. This assures that the disk is positioned at the same original location on the platen to reestablish the true planar surface of the disk abrasive without having to re-wear in the abrasive disk.

Coolant water acts as a continuous flushing agent to keep each disk and the platen clean during an abrading procedure. This allows clean abrasive disks to be quickly removed from a platen by interrupting the platen vacuum for future use. Another disk can be quickly installed and attached to the platen by simply re-applying the vacuum to the platen.

J. Filter Collection of Abrading Debris

Coolant water is supplied on a continuous basis during a lapping operation. This water flushes out grinding debris from the workpiece surface where the water and debris is thrown off the platen by centrifugal force. This water is routed to a filter to conveniently collect the debris for disposal. The filtered water can be recycled.

K. Lapper Machine Process Operations

Because the high speed lapping operation removes workpiece material so rapidly, the lapping machine platen speed is typically started and ended at very low rotational speeds and at low abrading contact pressures. Here, the rate of material removal is directly proportional to both the contact pressure and the localized abrading surface speed. Faster speeds and higher pressures increase the material removal rates. The removal rate is diminished as the pressure decreases and as the abrading speed decreases. Typical abrading speeds are in excess of 10,000 surface feet per minute (about 3,000 rpm for a 12 inch diameter disk).

Typical abrading contact pressures are less than 1 lb per square inch. Reducing the abrading pressures and surface speeds at the beginning of an abrading process allows the workpiece to be initially flattened where the highest portions of a workpiece are removed. Then higher speeds and pressures are applied to maximize the material removal across the full flat surface of a workpiece. Finally, the speeds and pressures are reduced at the end of the operation to assure that the workpiece surface finish is abraded uniformly. During the lapping procedure, the workpiece is rotated while the workpiece is in contact with the moving abrasive. The rotational speed of the workpiece can also be adjusted during the abrading procedure to optimize the uniformity of the workpiece flatness and surface finish.

L. Flatness Accuracy of Abrading System Components

To provide precision-flat and smoothly-polished workpieces surfaces at high abrading speeds when using the fixed-spindle floating-platen abrading system, all of the system components that are actively used in the abrading process must have precision-flat surfaces and these components must also be precisely aligned relative to each other. These precision-flat surfaces and precision alignments must be maintained at all abrading speeds and all process speeds and under all processing conditions. It is not sufficient that the components only have the required precision flatness characteristics and alignments in a static at-rest state; they must retain them when they are subjected to dynamic conditions including events such as the occurrence of abrading forces. This performance criterion requires that the system have components that are robust and that are not substantially affected by the continual presence of water-wetted abrasive particles in the system abrading environment. In addition, the abrasive disks used in the lapping or abrading process must have an abrasive disk thickness that is uniform over the full abrading surface of the disk.

Using stationary-position air bearing spindles having rotating flat top surfaces in the fixed-spindle floating-platen abrading system offers a number of significant advantages. These spindles have large 12 inch diameters that can easily hold large workpieces such as 300 mm semiconductor wafers; they have extraordinary-flat spindle-top flat surfaces that provide the desired flat lapping accuracy; they are extremely stiff which enables them to resist spindle-top deflections due to abrading forces; they can be operated at very high speeds for high speed lapping while retaining excellent dynamic flatness; they have extremely low rotational friction which allows accurate measurement of the abrading torque that is applied to individual spindles to ascertain the abrading state of completion of workpieces; and they are inherently self-cleaning due to the internal pressurized air which allows them to be operated without contamination in the water-mist abrasive-particle abrading environment present in high speed flat lapping. The flatness accuracy provided by the precision stationary-position air bearing rotary spindle flat top surfaces to support flat-surfaced workpieces is decidedly superior to the flatness of the moving workpiece supporting surfaces that is provided by conventional abrading systems, including slurry lapping and micro-grinding (flat-honing).

It is critical that all three of the individual spindle-top flat-surfaces to be precisely flat to provide supporting surfaces that the flat-surfaced workpieces can conform to without localized distortion of these workpieces that are often quite thin and even flexible. It is also important that all three of the air-bearing spindles are near-equal separated from each other to provide stable three-point support of the rotating floating platen. In addition, it is critical that all three of the spindle-tops planar flat surfaces are precisely aligned in a common plane to allow the precision-flat platen abrading surface to be in conformal flat-contact with all three of the spindles tops, or with the workpieces that are attached to the spindle-tops.

In addition, great care must be exercised to prevent thermal effects from distorting portions of the abrading system relative to other portions where these distortions cause misalignment of the critical abrading system components. One common source of this type of thermal distortion is friction heat that is generated by the abrading process. Another common source is heat that is generated by electrical components such as electric motors that drive the spindles or the platen. The effects of these heating (or cooling) effects tend to influence the system structural stability over a period of time. It is necessary that the abrading system perform as-desired when first started up and remain so over long periods of production operations.

Often these thermal-effects are concentrated at localized areas and they set up temperature gradients across structural elements of the system. Due to the coefficient of thermal expansion, portions of the uneven-temperature structural components or other abrading machine components grow or shrink in size relative to other portions of the components. Structural stresses are often generated by these temperature gradients that magnify the localized distortions of critical components of the abrading system. These distortions can result in the loss of the planar flatness of individual system machine components or result in distortions of the mutual planar alignment of component elements such as the spindle-top flat surfaces. Localized cooling effects from sources such as air bearings can also generate unwanted misalignments of critical abrading system components. These abrading system heat sources and cooling effects have been individually recognized and accounted for in the elementary design of the fixed-spindle floating-platen abrading system. The overall extreme simplicity of the fixed-spindle floating-platen abrading system minimizes thermal-effect distortions of the system which allows precision lapping to be successfully performed throughout typical production operation sequences.

The platen abrasive disks typically have annular bands of fixed-abrasive coated rigid raised-island structures. There is insignificant elastic distortion of the individual raised islands or of the whole thickness of the raised island abrasive disks when they are subjected to typical abrading pressures. These abrasive disks must also be precisely uniform in thickness across the full annular abrading surface of the disk to assure that full-surface abrading takes place over the full flat surface of the workpieces located on the tops of each of the three spindles.

To be successfully used for high speed lapping, the overall thickness of the abrasive disks, measured from the top surface of the exposed abrasive to the bottom mounting surface of the disk backing must be uniform across the full disk-abrasive surface with a standard deviation in thickness of less than 0.0001 inches. The top flat surfaces of the islands are coated with a very thin coating of abrasive. The abrasive coating typically consists of a monolayer of 0.002 inch diameter beads that contain very small 3 micron (0.0001 inch) or sub-micron diamond abrasive particles. The 3 micron particles have a size of 100 millionths of an inch which is also approximately equal to 10 helium lightbands of flatness. Raised island abrasive disks are attached with vacuum to ultra-flat platens that rotate at very high abrading surface speeds, often in excess of 10,000 SFM (100 mph).

Most conventional platen abrasive surfaces have original-condition flatness tolerances of approximately 0.0001 inches (100 millionths) that typically wear down into a non-flat condition during abrading operations to approximately 0.0006 inches before they are reconditioned to re-establish the original flatness variation of 0.0001 inches. By comparison, the typical flatness of a precision air bearing spindle is less than 5 millionths of an inch. The rotary air bearing spindle-tops experience extremely low deflections due to abrading forces because of their very high stiffness.

There are two distinctly different components of the planar flatness of the abrading surface of a rotating platen. One component is the circumferential flatness of the platen. The other component is the radial flatness of the platen. In addition, it is important to establish the planar flatness of the abrading-surface of the platen to which is attached the precision-thickness abrasive disks. Because the abrasive disks are attached to the platen abrading-surface, these disks protect the platen abrading surface from abrasive wear. However, the abrasive that is attached to the abrasive disks do experience continuous wear during abrading actions. This abrasive wear of the abrasive surface generates a non-flat abrasive surface that will prevent the creation of precision-flat lapped workpieces. When the platen abrasive planar surface becomes excessively worn, it must be re-conditioned to again provide the capability for precision-flat lapping.

Radial platen abrasive surface wear-down is due to the abrading speed differential that exists across the radius of a rotating platen. Here the wear rate, of both the workpieces and the platen annular abrasive, is directly proportional to the localized abrading speed. Because the outer radius of a rotating platen annular abrasive travels faster than the inner radius, the wear-down rates are substantially higher at the platen outer radius than at the platen inner radius. This radial wear-down is an on-going process and its effects must be corrected periodically. Radial wear of the abrading surfaces occurs for all rotary-platen systems including slurry lapping and micro-grinding (flat-honing).

When there is extra-wear of a platen abrading-surface or the platen abrasive surface, the radial-worn surface assumes a shallow-angle cone-shape. The amount radial wear must be accurately measured to determine the localized deviation of the surface from straight-edge surface to ascertain the necessity of corrective measures and also, to determine the success of these corrective measures. These out-of-plane radial-surface measurements are not made relative to the full planar platen abrasive surface but rather to individual radial straight-line segments of the platen planar abrasive surface. Measurements taken at one straight-line location is typically duplicated at other circumferential locations because the platen abrasive wear-down has a common cause of speed differential across the radial width of the platen abrasive. Cone-shapes, reverse-cone-shapes, valleys and raised portions all tend to extend uniformly around the circumference of the platen abrading surface. Also, the abrasive surface reconditioning methods are devoted primarily to correcting the radial deviation of the platen abrasive and only secondarily, to correcting the circumferential surface variations of the platen abrasive surface. To reestablish the radial flatness of a platen annular abrading surface, conditioning ring type abrasive surfaces are placed in pressure-contact with the platen abrasive and both the conditioning ring and the platen are rotated. The speeds, abrading pressures and directions of rotation are all selected to correct the defined deficiencies of the platen abrasive surface. This conditioning-ring corrective action is very effect in reducing the radial out-of-plane deficiencies of the platen abrasive.

The process of measuring these radial platen abrading surface variations is described here. A straight-edge device, or its electronic equivalent, is placed across the full diameter of the platen annular abrading surface where the straight-edge device also intersects the platen center of rotation. The straight-edge line contacts the platen abrading annular surface at two contact-points that are positioned opposed from each other across the platen rotational center. There is a straight-edge line located at the surface of the straight-edge device that contacts the platen abrading annular surface where the straight edge line is centered on the longitudinal surface of the straight-edge device. Measurement points are then selected where they are located in a measuring-line segment that conforms to the platen abrading surface wherein the measuring-line intersects the platen center of rotation. The measuring-line extends radially along the annular bandwidth from the abrading surface annular band inner radius to the abrading surface annular band outer radius. One straight-edge line platen contact-point is located on the portion of the annular platen abrading surface that is diagonal across the platen rotational center from the measuring-line segment. The other straight-edge line platen contact-point is located on the portion of the annular platen abrading surface that is on the measuring-line segment. The distances of the individual measuring-points from the straight-edge line are then determined and the standard deviation of the individual measuring-points from the straight-edge line is determined. It is preferred that the standard deviation is less than 0.001 inches and more preferred that the standard deviation is less than 0.0002 inches and even more preferred that the standard deviation is less than 0.0001 inches.

The platens must also have flat planar surfaces where points on the abrading surface of a platen have a standard deviation of less than 0.002 inches from the plane of the abrading surface and it is preferred that the standard deviation is less than 0.001 inches and more preferred that the standard deviation is less than 0.0002 inches and even more preferred that the standard deviation is less than 0.0001 inches.

M. Co-Planar Alignment of Spindle-Top Flat Surfaces

To provide precision-flat and smoothly-polished workpieces surfaces at high abrading speeds it is necessary that each of the individual rotary workpiece spindles used in the fixed-spindle floating platen abrading system have flat-surfaced spindle-tops that are precisely flat and also that the spindle-tops rotate about a spindle axis that is precisely perpendicular to the respective spindle-top flat surface. Select air bearing spindles typically have spindle-tops that are flat within 5 millionths of and inch when measured as the spindle top rotates which is an indication that the spindle-top axis of rotation is precisely perpendicular to the spindle-top flat surface. It is desired that the spindle-top flat surface has a standard deviation from the plane of the spindle-top flat surface of less than 0.0001 inches (100 millionths of an inch). Here the flatness accuracy capabilities of the select air bearing spindles far exceed the accuracy requirements required for successful high speed flat lapping.

Not only do the spindle-tops need to be precisely flat, these fixed-position spindles must be aligned where their flat surfaces are precisely co-planar with each other. To form a three-point support of the flat-surfaced floating-abrasive platen, the three primary spindles are placed in circle on the flat horizontal flat surface of a rigid and dimensionally stable machine base. The rotational axes of all of the spindles intersect this circle which is equal in diameter and concentric with the circumferential center-line of the platen abrading surface. By spacing the three spindles an equal distance from each other on this circle, the resultant positioning forms a three-point support of the rotational platen where the platen is stable as it rests on these three spindles. More spindles can be added to the primary three spindles to provide more workstations on an abrading machine. However, all of the spindles, including the three primary spindles, must have spindle-top flat surfaces that are all precisely co-planar with each other.

The plane formed by these co-planar spindles does not have to be precisely parallel with the machine base horizontal flat surface that the spindles are attached to. Here, the planar floating platen abrading surface is three-point supported by these spindles and the rotating platen can successfully perform the abrading action on flat-surfaced workpieces that are attached to the spindles even if the platen planar abrading surface is at a slight angle to the machine base flat surface. The mutual co-planar alignment of the individual spindle-top flat surfaces is not dependent on the flatness accuracy of the machine base. Also, the spindles do not need to have precision equal heights to successfully align the spindle-tops to be precisely co-planar. Instead, each individual spindle is supported by three equally-spaced legs that are positioned around the perimeter of the spindle where the legs form a three-point support of the spindle. More than three support legs can be attached to the spindles but the extra legs tend to make spindle alignment adjustments more difficult than with a spindle that has three equally-spaced support legs.

There are various process procedures that can be used to align all of the spindles-tops in a common plane. In one procedure, a "point-and-shoot" laser device is used to co-planar align all three spindle-tops to a reference plane that passes through spindle-top surface points located at the spindle axis of rotation where these points lie on the surface of all three spindle-tops. This type of laser has a single narrow laser beam and it is mounted on one of the spindle top surfaces and a laser beam readout target is placed on another of the three spindle-top surfaces. The combination laser-readout devices are calibrated prior to use on the spindle-tops with a precision flat surface plate to establish the location of the specific sensor pixels on the digital target sensor array that are at the same elevation as the laser beam. Also, the laser device is aligned with the spindle top it is mounted on where the laser beam is precisely parallel with the spindle-top flat surface.

The spindle that the laser is mounted upon can be adjusted until the laser beam intersects the receptor readout device selected pixels when the laser receptor is positioned at the center of rotation of the target spindle. To direct the laser beam to the target sensor the laser can be rotated on the spindle-top to direct the laser beam at the target sensor or the spindle-top can be rotated to accomplish this. Then the laser spindle is tilt-adjusted to where the height-selected array sensors are activated by the laser beam. When this alignment is completed, the planar surface of the laser spindle-top is tilt-angle aligned with a point on the surface of the target spindle where this point is located at the rotational center of the target spindle. The laser is then rotated on the spindle-top until it is directed at the target sensor that has been moved to the center of the third spindle spindle-top. The third spindle is then height adjusted and tilt-angle adjusted where the laser beam activates the height-selected array sensors on the laser target Then the "point-and-shoot" laser and targets can be re-directed where the laser targets are sequentially moved across the width and depth of the target spindle-top to align the target spindle to be co-planar with the laser spindle-top surface. This procedure is repeated by moving the laser device sequentially to all three spindle-tops to mutually align all three spindle-tops in a common plane. These laser-target array devices are very accurate and the roll, pitch and yaw (X, Y, Z axes) adjustments can be made with these or other types of alignments procedure steps. In another procedure, the laser device can be positioned at a site remote from the three spindles and the three spindle-tops can be co-planar aligned relative to this remote site.

A more desirable procedure is to use a laser device that has a rotating laser-beam head that provide a precision plane of laser light that is directed at target array sensors positioned on all three spindle-tops. A single target sensor can be moved from spindle to spindle or multiple sensors can be used where each spindle has its own sensor. First the alignment procedure establishes a common reference plane that passes through center-points on all three spindle-top flat surfaces. Then the target sensors are sequentially moved across the width and depth positions on the target spindle-tops to complete the co-planar alignment of all three spindles. This alignment procedure is done in steps where a coarse co-planar alignment is completed, then a fine adjustment is completed and then an ultra-fine adjustment is completed. This type of rotating-beam laser provides very precision co-planar alignment with the aid of software laser measurement data programs. Here, the laser device can be mounted on a select spindle head or the laser device can be positioned at a remote site that is close to all the spindles. An excellent remote site for the rotary laser device is at the center of the machine base, nested between all three (or more) spindles. The co-planar alignment accuracy is a function of the sensor target distance from the rotating laser head.

An L-740 Ultra Precision Leveling Laser System can be provided by Hamar Laser of Danbury, Conn. which has a flatness alignment capability of 30 millionths of an inch per foot of distance between the rotating laser head and the laser target. This accuracy is approximately three times better than the 0.0001 inch (100 millionths of an inch) co-planar spindle-top flat rotating surface alignment required for successful high speed flat lapping for a medium-sized abrading system. The alignment process is quick and also can be performed periodically to confirm the coplanar alignment of the spindles. This laser system can also be used to verify the flatness of the platen precision-flat abrading surface and can be used to verify the flatness of the abrasive surface of the abrasive disk attached to the platen.

This fixed-spindle floating-platen abrading system must be precisely aligned to provide successful high speed flat lapping of flat surfaced workpieces. Once the precision co-planar alignment of the spindles is made, it is critical that this precision alignment is maintained over long periods of time. To accomplish this, the rigid machine bases that support the spindles must be rigid and dimensionally stable over these long periods of time and during extended abrading process procedures. The bases must be resistant to material creep-type dimensional changes due to internal stress in the machine base material and they must not deflect or reactively move when they are subjected to steady-state or dynamic abrading forces. Also, the dimensional stability of the machine base must not be affected by heat generated by the machine components such as motors or heat generated by abrading friction or affected by cooling effects from air bearing devices. The preferred machine base is granite or epoxy-granite. The machine bases must be large enough and heavy enough to provide this dimensional stability for the spindles that are mounted on them. Air bearing spindles that have the desired 12 inch diameter spindle-top sizes and the required flatness accuracy are typically quite heavy. They weigh between 100 and 150 lbs each. It is also desirable to provide constant temperature control of the granite bases with the use of heat transfer fluid coolant passageways within the body of the machine base body.

The floating platens must also be rigid and dimensionally stable to provide abrading surfaces that remain precisely flat over long periods of time. It is important that they be light in weight and structurally stiff enough that they do not deform when subjected to substantial abrading forces. Controlled abrading forces that are imposed on the workpieces are applied by the spherical-action platen support device that is located at the center of rotation of the platen. Because very low abrading forces are typically applied to the workpieces during high speed abrading, it is necessary to very accurately control these applied abrading forces. The imposed abrading forces are the net difference between the weight of the platen structure and the force and the applied force of the platen support device. If a platen structure is very heavy, it is difficult to precisely control the accuracy of the imposed abrading forces on the workpieces. However, the platens and platen structures can be constructed from stress-free aluminum materials that are adhesively bonded together to provide a lightweight, stiff and dimensionally stable platen apparatus. The abrading surfaces of the aluminum platen can be hard-coat anodized to provide an extremely hard wear surface. Often, zero-friction air bearing platen support devices are used to improve accurate control of the imposed abrading forces. Strain gauges are also used to determine the net workpiece abrading force by subtracting the weight of the platen structure from the platen support device applied force.

There are many abrading machines that have groups of workpiece rotating spindle heads that are mounted on a support frame that is lowered to allow abrading contact of multiple workpieces with a horizontal abrasive covered rotating platen. These upper-type workpiece spindles are all lowered together as a group to contact the abrasive surface. However, each of the spindles float-free from the other spindles to allow individual abrading-force control of each spindle where the spindles move along their spindle rotating axes.

Converting these free-floating upper spindles into a system where heavy 100 lb spindles are rigidly mounted to a common frame that could be free-floating to allow uniform contact of all of the workpieces with the rigid abrasive platen would not be practical. The supporting frame would be extremely heavy in order to provide a rigid and dimensionally stable base for the rigid spindles. Controlling the abrading forces on the workpieces would be very difficult with this heavy spindle-support frame. Providing a frame that would remain dimensionally stable and accurate over long periods of time would result in a complex frame that would be difficult to construct and would be expensive. Material creep dimensional changes and thermal-stress dimension issues would require sophisticated engineering considerations for the floating upper spindle frame system as compared to this simple-construction system that uses a granite base that supports three heavy air bearing workpiece spindles that have the required flatness accuracy for successful flat lapping of workpieces. Furthermore, there would be operator safety issues where this heavy but free-floating frame is suspended above the horizontal abrasive covered platen. Loading and removal of individual workpieces would also be difficult as these individual workpieces would have to be presented to the upper spindle flat surfaces without line-of-sight visual access to the workpieces. Precision co-planar alignment of the spindle-tops to within the 0.0001 inches that is required for successful precision flat lapping or precision abrading of workpieces would be extremely difficult when all of the spindles are mounted to a floating spindle-frame support apparatus.

Fixed-Spindle Floating-Platen Spherical-Mount System

A three-point fixed-spindle floating-platen abrading machine assembly apparatus having rotary spindles mounted on spherical rotation spindle-mounts is described that has the flowing features:

a) at least three rotary spindles having circular rotatable flat-surfaced spindle-tops that each have a rotatable flat-surfaced spindle-top axis of rotation at the center of a respective rotatable flat-surfaced spindle-top;

b) wherein the at least three rotatable flat-surfaced spindle-tops' axes of rotation are perpendicular to the respective rotatable flat-surfaced spindle-tops' flat surfaces;

c) an abrading machine base having a horizontal nominally-flat top surface and a spindle-circle where the spindle-circle is coincident with the machine base nominally-flat top surface;

d) rotary spindle two-piece spindle-mount devices consisting essentially of a rotatable spindle-mount spherical-action rotor and a stationary spindle-mount spherical-base where both the rotatable spindle-mount spherical-action rotor and the stationary spindle-mount spherical-base have a common-radius spherical joint wherein the rotatable spindle-mount spherical-action rotors are mounted in common-radius spherical-joint surface contact with respective stationary spindle-mount spherical-bases and wherein the rotatable spindle-mount spherical-action rotors are supported by the respective stationary spindle-mount spherical-bases where each rotary spindle two-piece spindle-mount device allows the rotatable spindle-mount spherical-action rotors to be rotated through spherical angles relative to the respective stationary spindle-mount spherical-bases and wherein the at least three rotary spindles are mechanically attached to respective at least three rotary spindle two-piece spindle-mount devices' rotatable spindle-mount spherical-action rotors and wherein rotary spindle two-piece spindle-mount devices' locking devices are adapted to lock the respective rotatable spindle-mount spherical-action rotors to the respective stationary spindle-mount spherical-bases;

e) wherein the at least three rotary spindles are located with approximately equal spacing between the at least three of the rotary spindles and the at least three rotatable flat-surfaced spindle-tops' axes of rotation intersect the machine base spindle-circle and where the respective at least three rotary spindle two-piece spindle-mount devices' spindle-mount spherical-bases are mechanically attached to the machine base nominally-flat top surface at respective at least three rotary spindles' spindle-circle locations;

f) wherein the at least three rotatable flat-surfaced spindle-tops' flat surfaces can be aligned to be co-planar with respect to each other by spherical rotation of the rotatable spindle-mount spherical-action rotors relative to the respective stationary spindle-mount spherical-bases;

g) wherein rotary spindle two-piece spindle-mount device' locking devices are adapted to lock the respective rotatable spindle-mount spherical-action rotors to the respective stationary spindle-mount spherical-bases to maintain the co-planar alignment of the at least three rotatable flat-surfaced spindle-tops' flat surfaces;

h) a floating, rotatable abrading platen having a precision-flat annular abrading-surface that has an annular abrading-surface radial width and an annular abrading-surface inner radius and an annular abrading-surface outer radius and where the floating, rotatable abrading platen is supported by and is rotationally driven about an floating, rotatable abrading platen rotation axis located at a rotational center of the floating, rotatable abrading platen by a spherical-action rotation device located at the rotational center of the floating, rotatable abrading platen and where the floating, rotatable abrading platen spherical-action rotation device restrains the floating, rotatable abrading platen in a radial direction relative to the floating, rotatable abrading platen axis of rotation and where the floating, rotatable abrading platen axis of rotation is concentric with the machine base spindle-circle;

i) wherein the floating, rotatable abrading platen spherical-action rotation device allows spherical motion of the floating, rotatable abrading platen about the floating, rotatable abrading platen rotational center where the precision-flat annular abrading-surface of the floating, rotatable abrading platen that is supported by the floating, rotatable abrading platen spherical-action rotation device is nominally horizontal; and j) flexible abrasive disk articles having annular bands of abrasive coated surfaces that have an abrasive coated surface annular band radial width and an abrasive coated surface annular band inner radius and an abrasive coated surface annular band outer radius where a selected flexible abrasive disk is attached in flat conformal contact with an floating, rotatable abrading platen precision-flat annular abrading-surface such that the attached abrasive disk is concentric with the floating, rotatable abrading platen precision-flat annular abrading-surface wherein the floating, rotatable abrading platen precision-flat annular abrading-surface radial width is at least equal to the radial width of the attached flexible abrasive disk abrasive coated annular abrading band and wherein the floating, rotatable abrading platen precision-flat annular abrading-surface provides conformal support of the full-abrasive-surface of the flexible abrasive disk abrasive coated surface annular band where the floating, rotatable abrading platen precision-flat annular abrading-surface inner radius is less than an inner radius of the attached flexible abrasive disk abrasive coated surface annular band and where an floating, rotatable abrading platen precision-flat annular abrading-surface outer radius is greater than the outer radius of the attached flexible abrasive disk abrasive coated surface annular band;

k) wherein the selected flexible abrasive disk is attached in flat conformal contact with the floating, rotatable abrading platen precision-flat annular abrading-surface by a disk attachment technique selected from the group consisting of vacuum disk attachment techniques, mechanical disk attachment techniques and adhesive disk attachment techniques;

l) wherein approximately equal thickness workpieces having parallel or near-parallel opposed flat workpiece top surfaces and flat workpiece bottom surfaces can be attached in flat-surfaced contact with the flat surfaces of the respective at least three rotatable flat-surfaced spindle-tops where the workpiece bottom surfaces contact the flat surfaces of the respective at least three rotatable flat-surfaced spindle-tops;

m) wherein the floating, rotatable abrading platen is movable vertically along the floating, rotatable abrading platen rotation axis by the floating, rotatable abrading platen spherical-action rotation device to allow the abrasive surface of the flexible abrasive disk attached to the floating, rotatable abrading platen precision-flat annular abrading-surface to contact the top surfaces of the approximately equal thickness workpieces that are attached to the flat surfaces of the respective at least three rotatable flat-surfaced spindle-tops wherein the at least three rotary spindles provide at least three-point support of the floating, rotatable abrading platen; and n) wherein the total floating, rotatable abrading platen abrading contact force applied to approximately equal thickness workpieces that are attached to the respective at least three rotatable flat-surfaced spindle-top flat surfaces by contact of the abrasive surface of the flexible abrasive disk that is attached to the floating, rotatable abrading platen precision-flat annular abrading-surface with the top surfaces of the approximately equal thickness workpieces that are attached to the flat surfaces of the respective at least three rotatable flat-surfaced spindle-tops is controlled through the floating, rotatable abrading platen spherical-action floating, rotatable abrading platen rotation device to allow the total floating, rotatable abrading platen abrading contact force to be evenly distributed to the approximately equal thickness workpieces attached to the respective at least three rotatable flat-surfaced spindle-tops;

o) wherein the at least three rotatable flat-surfaced spindle-tops having the attached approximately equal thickness workpieces can be rotated about the respective rotatable flat-surfaced spindle-tops' rotation axes and the floating, rotatable abrading platen having the attached flexible abrasive disk can be rotated about the floating, rotatable abrading platen rotation axis to single-side abrade the approximately equal thickness workpieces that are attached to the flat surfaces of the at least three rotatable flat-surfaced spindle-tops while the moving abrasive surface of the flexible abrasive disk that is attached to the moving floating, rotatable abrading platen precision-flat annular abrading-surface is in force-controlled abrading contact with the top surfaces of the approximately equal thickness workpieces that are attached to the respective at least three rotatable flat-surfaced spindle-tops and where the floating, rotatable abrading platen precision-flat annular abrading-surface assumes a co-planar alignment with the precisely co-planar flat surfaces of the respective at least three rotatable flat-surfaced spindle-tops.

In addition the machine having the two-piece spherical-action spindle mount is described where at least one flat-surfaced circular device is selected from the group consisting of workpiece carriers, abrasive conditioning rings and abrasive disks is attached to the flat surfaces of the at least three rotatable flat-surfaced spindle-tops where the selected flat-surfaced circular devices are attached to the at least three rotatable flat-surfaced spindle-tops by attachment systems selected from the group consisting of vacuum attachment, mechanical attachment and adhesive attachment and wherein the attached flat-surfaced circular devices are concentric with the respective rotatable flat-surfaced spindle-tops.

Also, the machine having the two-piece spherical-action spindle mount is described where the machine base structural material is selected from the group consisting of granite and epoxy-granite and wherein the machine base structural material can optionally be temperature controlled by use of a temperature-controlled fluid that circulates in fluid passageways internal to the machine base structural materials.

Furthermore, the machine having the two-piece spherical-action spindle mount is described where the at least three rotary spindles are air bearing rotary spindles. Also, the machine having the two-piece spherical-action spindle mount can be configured where the floating, rotatable abrading platen flexible abrasive disk articles are selected from the group consisting of: flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization resilient disk pads that are suitable for use with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, and flexible flat-surfaced metal or polymer disks.

Also, the machine having the two-piece spherical-action spindle mount can be configured where auxiliary rotary spindles in excess of three rotary spindles which are primary rotary spindles are attached to the machine base flat surface using rotary spindle two-piece spindle-mount devices and where the auxiliary rotary spindles are each positioned between adjacent primary rotary spindles, and where the auxiliary rotary spindles have circular rotatable flat-surfaced spindle-tops that each have rotatable flat-surfaced spindle-top axis of rotation at a center of their respective auxiliary rotatable flat-surfaced spindle spindle-top and where the respective auxiliary rotatable flat-surfaced spindle spindle-tops' axes of rotation intersect the machine base spindle-circle and where the top surfaces of the rotary spindle respective rotatable flat-surfaced spindle-tops of the auxiliary rotary spindles are precisely co-planar with the precisely co-planar top surfaces of the rotatable flat-surfaced spindle-tops of the three primary rotary spindles and the rotary spindle two-piece spindle-mount device' locking devices are engaged to lock the auxiliary rotary spindles' respective rotatable spindle-mount spherical-action rotors to the respective stationary spindle-mount spherical-bases to maintain the co-planar alignment of the auxiliary rotatable flat-surfaced spindles' spindle-tops' flat surfaces.

A process is described of abrading flat-surfaced approximately equal thickness workpieces using an at least three-point fixed-spindle floating-platen abrading machine comprising:

a) providing at least three rotary spindles having circular rotatable flat-surfaced spindle-tops that each have a rotatable flat-surfaced spindle-top axis of rotation at the center of a respective rotatable flat-surfaced spindle-top;

b) wherein the at least three rotatable flat-surfaced spindle-tops' axes of rotation are perpendicular to the respective rotatable flat-surfaced spindle-tops' flat surfaces;

c) providing an abrading machine base having a horizontal nominally-flat top surface and a spindle-circle where the spindle-circle is coincident with the machine base nominally-flat top surface;

d) providing a rotary spindle two-piece spindle-mount devices consisting essentially of a rotatable spindle-mount spherical-action rotor and a stationary spindle-mount spherical-base where both the rotatable spindle-mount spherical-action rotor and the stationary spindle-mount spherical-base have a common-radius spherical-joint wherein the rotatable spindle-mount spherical-action rotors are mounted in common-radius spherical-joint surface contact with respective stationary spindle-mount spherical-bases and wherein the rotatable spindle-mount spherical-action rotors are supported by the respective stationary spindle-mount spherical-bases where each rotary spindle two-piece spindle-mount device allows the rotatable spindle-mount spherical-action rotors to be rotated through spherical angles relative to the respective stationary spindle-mount spherical-bases and wherein the at least three rotary spindles are mechanically attached to respective at least three rotary spindle two-piece spindle-mount devices' rotatable spindle-mount spherical-action rotors and wherein rotary spindle two-piece spindle-mount device' locking devices are adapted to lock the respective rotatable spindle-mount spherical-action rotors to the respective stationary spindle-mount spherical-bases;

e) providing that the at least three rotary spindles are located with approximately equal spacing between the at least three of the rotary spindles and the at least three rotatable flat-surfaced spindle-tops' axes of rotation intersect the machine base spindle-circle and where the respective at least three rotary spindle two-piece spindle-mount devices' spindle-mount spherical-bases are mechanically attached to the machine base nominally-flat top surface at respective at least three rotary spindles' spindle-circle locations;

f) providing that the at least three rotatable flat-surfaced spindle-tops' flat surfaces are aligned to be co-planar with respect to each other by spherical rotation of the rotatable spindle-mount spherical-action rotors relative to the respective stationary spindle-mount spherical-bases;

g) wherein rotary spindle two-piece spindle-mount device' locking devices lock the respective rotatable spindle-mount spherical-action rotors to the respective stationary spindle-mount spherical-bases to maintain the co-planar alignment of the at least three rotatable flat-surfaced spindle-tops' flat surfaces;

h) providing a floating, rotatable abrading platen having a precision-flat annular abrading-surface that has an annular abrading-surface radial width and an annular abrading-surface inner radius and an annular abrading-surface outer radius and where the floating, rotatable abrading platen is supported by and is rotationally driven about an floating, rotatable abrading platen rotation axis located at a rotational center of the floating, rotatable abrading platen by a spherical-action rotation device located at the rotational center of the floating, rotatable abrading platen and where the floating, rotatable abrading platen spherical-action rotation device restrains the floating, rotatable abrading platen in a radial direction relative to the floating, rotatable abrading platen axis of rotation and where the floating, rotatable abrading platen axis of rotation is concentric with the machine base spindle-circle;

i) wherein the floating, rotatable abrading platen spherical-action rotation device spherical moves the floating, rotatable abrading platen about the floating, rotatable abrading platen rotational center where the precision-flat annular abrading-surface of the floating, rotatable abrading platen that is supported by the floating, rotatable abrading platen spherical-action rotation device is nominally horizontal; and j) providing flexible abrasive disk articles having annular bands of abrasive coated surfaces that have an abrasive coated surface annular band radial width and an abrasive coated surface annular band inner radius and an abrasive coated surface annular band outer radius where a selected flexible abrasive disk is attached in flat conformal contact with an floating, rotatable abrading platen precision-flat annular abrading-surface such that the attached abrasive disk is concentric with the floating, rotatable abrading platen precision-flat annular abrading-surface wherein the floating, rotatable abrading platen precision-flat annular abrading-surface radial width is at least equal to the radial width of the attached flexible abrasive disk abrasive coated annular abrading band and wherein the floating, rotatable abrading platen precision-flat annular abrading-surface provides conformal support of the full-abrasive-surface of the flexible abrasive disk abrasive coated surface annular band where the floating, rotatable abrading platen precision-flat annular abrading-surface inner radius is less than an inner radius of the attached flexible abrasive disk abrasive coated surface annular band and where an floating, rotatable abrading platen precision-flat annular abrading-surface outer radius is greater than the outer radius of the attached flexible abrasive disk abrasive coated surface annular band;

k) providing that the selected flexible abrasive disk is attached in flat conformal contact with the floating, rotatable abrading platen precision-flat annular abrading-surface by a disk attachment technique selected from the group consisting of vacuum disk attachment techniques, mechanical disk attachment techniques and adhesive disk attachment techniques;

l) providing approximately equal thickness workpieces having parallel or near-parallel opposed flat workpiece top surfaces and flat workpiece bottom surfaces can be attached in flat-surfaced contact with the flat surfaces of the respective at least three rotatable flat-surfaced spindle-tops where the workpiece bottom surfaces contact the flat surfaces of the respective at least three rotatable flat-surfaced spindle-tops;

m) moving the floating, rotatable abrading platen vertically along the floating, rotatable abrading platen rotation axis by the floating, rotatable abrading platen spherical-action rotation device to allow the abrasive surface of the flexible abrasive disk attached to the floating, rotatable abrading platen precision-flat annular abrading-surface to contact the top surfaces of the approximately equal thickness workpieces that are attached to the flat surfaces of the respective at least three rotatable flat-surfaced spindle-tops wherein the at least three rotary spindles provide at least three-point support of the floating, rotatable abrading platen; and n) applying a total floating, rotatable abrading platen abrading contact force to approximately equal thickness workpieces that are attached to the respective at least three rotatable flat-surfaced spindle-top flat surfaces by contact of the abrasive surface of the flexible abrasive disk that is attached to the floating, rotatable abrading platen precision-flat annular abrading-surface with the top surfaces of the approximately equal thickness workpieces that are attached to the flat surfaces of the respective at least three rotatable flat-surfaced spindle-tops where the total floating, rotatable abrading platen abrading contact force is controlled through the floating, rotatable abrading platen spherical-action floating, rotatable abrading platen rotation device to allow the total floating, rotatable abrading platen abrading contact force to be evenly distributed to the approximately equal thickness workpieces attached to the respective at least three rotatable flat-surfaced spindle-tops;

o) wherein the at least three rotatable flat-surfaced spindle-tops having the attached approximately equal thickness workpieces are rotated about the respective rotatable flat-surfaced spindle-tops' rotation axes and the floating, rotatable abrading platen having the attached flexible abrasive disk can be rotated about the floating, rotatable abrading platen rotation axis to single-side abrade the approximately equal thickness workpieces that are attached to the flat surfaces of the at least three rotatable flat-surfaced spindle-tops while the moving abrasive surface of the flexible abrasive disk that is attached to the moving floating, rotatable abrading platen precision-flat annular abrading-surface is in force-controlled abrading contact with the top surfaces of the approximately equal thickness workpieces that are attached to the respective at least three rotatable flat-surfaced spindle-tops and where the floating, rotatable abrading platen precision-flat annular abrading-surface assumes a co-planar alignment with the precisely co-planar flat surfaces of the respective at least three rotatable flat-surfaced spindle-tops.

The process of abrading workpieces using the two-piece spherical-action spindle mount abrading machine is also described where the approximately equal thickness workpieces have approximately equal thickness workpieces' top surfaces and respective approximately equal thickness workpieces' bottom surfaces where the approximately equal thickness workpieces' top surfaces are approximately equal thickness first workpiece surfaces and the approximately equal thickness workpieces' bottom surfaces are respective approximately equal thickness second workpiece surfaces and where the flat-surfaced approximately equal thickness workpieces are attached to the at least three rotatable flat-surfaced spindle-tops where the respective approximately equal thickness workpieces' second workpiece surfaces are attached to the at least three rotatable flat-surfaced spindle-tops, and the approximately equal thickness workpieces' first surfaces are abraded by the flexible abrasive disk article that is attached to the floating, rotatable abrading platen precision-flat annular abrading-surface and after the approximately equal thickness workpieces' first workpiece surface are abraded, the flat-surfaced approximately equal thickness workpieces are removed from the at least three rotatable flat-surfaced spindle-tops and the respective flat-surfaced approximately equal thickness workpieces are re-attached to the at least three rotatable flat-surfaced spindle-tops where the approximately equal thickness workpieces' abraded first workpiece surfaces are attached to the rotatable flat-surfaced spindle-tops and the respective approximately equal thickness workpieces' second workpiece surfaces are abraded by the flexible abrasive disk article that is attached to the floating, rotatable abrading platen precision-flat annular abrading-surface workpiece.

In addition, the process of using the two-piece spherical-action spindle mount machine is also described where the floating, rotatable abrading platen flexible abrasive disk articles are selected from the group consisting of: flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization resilient disk pads that are suitable for use with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, and flexible flat-surfaced metal or polymer disks.

Further, the process of using the two-piece spherical-action spindle mount abrading machine is also described where the at least three rotary spindles are air bearing rotary spindles. Here, the same process of using the two-piece spherical-action spindle mount abrading machine can be used where the machine base structural material is selected from the group consisting of granite and epoxy-granite and wherein the machine base structural material can optionally be temperature controlled by use of a temperature-controlled fluid that circulates in fluid passageways internal to the machine base structural materials.

Further, the process of using the two-piece spherical-action spindle mount abrading machine where auxiliary rotary spindles in excess of three rotary spindles which are primary rotary spindles are attached to the machine base flat surface using rotary spindle two-piece spindle-mount devices and where the auxiliary rotary spindles are each positioned between adjacent primary rotary spindles, and where the auxiliary rotary spindles have circular rotatable flat-surfaced spindle-tops that each have rotatable flat-surfaced spindle-top axis of rotation at a center of their respective auxiliary rotatable flat-surfaced spindle spindle-top and where the respective auxiliary rotatable flat-surfaced spindle spindle-tops' axes of rotation intersect the machine base spindle-circle and where the top surfaces of the rotary spindle respective rotatable flat-surfaced spindle-tops of the auxiliary rotary spindles are precisely co-planar with the precisely co-planar top surfaces of the rotatable flat-surfaced spindle-tops of the three primary rotary spindles and the rotary spindle two-piece spindle-mount device' locking devices are engaged to lock the auxiliary rotary spindles' respective rotatable spindle-mount spherical-action rotors to the respective stationary spindle-mount spherical-bases to maintain the co-planar alignment of the auxiliary rotatable flat-surfaced spindles' spindle-tops' flat surfaces.

Another process of using the two-piece spherical-action spindle mount abrading machine having the attached rotary spindles is described for abrading the spindle-tops of an at least three-point fixed-spindle floating-platen abrading machine comprising:

a) providing at least three rotary spindles having circular rotatable flat-surfaced spindle-tops that each have a rotatable flat-surfaced spindle-top axis of rotation at the center of a respective rotatable flat-surfaced spindle-top;
b) wherein the at least three rotatable flat-surfaced spindle-tops' axes of rotation are perpendicular to the respective rotatable flat-surfaced spindle-tops' flat surfaces;
c) providing an abrading machine base having a horizontal nominally-flat top surface and a spindle-circle where the spindle-circle is coincident with the machine base nominally-flat top surface;
d) providing a rotary spindle two-piece spindle-mount devices consisting essentially of a rotatable spindle-mount spherical-action rotor and a stationary spindle-mount spherical-base where both the rotatable spindle-mount spherical-action rotor and the stationary spindle-mount spherical-base have a common-radius spherical-joint wherein the rotatable spindle-mount spherical-action rotors are mounted in common-radius spherical joint surface contact with respective stationary spindle-mount spherical-bases and wherein the rotatable spindle-mount spherical-action rotors are supported by the respective stationary spindle-mount spherical-bases where each rotary spindle two-piece spindle-mount device allows the rotatable spindle-mount spherical-action rotors to be rotated through spherical angles relative to the respective stationary spindle-mount spherical-bases and wherein the at least three rotary spindles are mechanically attached to respective at least three rotary spindle two-piece spindle-mount devices' rotatable spindle-mount spherical-action rotors and wherein rotary spindle two-piece spindle-mount device' locking devices are adapted to lock the respective rotatable spindle-mount spherical-action rotors to the respective stationary spindle-mount spherical-bases;

e) providing that the at least three rotary spindles are located with approximately equal spacing between the at least three of the rotary spindles and the at least three rotatable flat-surfaced spindle-tops' axes of rotation intersect the machine base spindle-circle and where the respective at least three rotary spindle two-piece spindle-mount devices' spindle-mount spherical-bases are mechanically attached to the machine base nominally-flat top surface at respective at least three rotary spindles' spindle-circle locations;

f) providing that the at least three rotatable flat-surfaced spindle-tops' flat surfaces are aligned to be co-planar with respect to each other by spherical rotation of the rotatable spindle-mount spherical-action rotors relative to the respective stationary spindle-mount spherical-bases;

g) wherein rotary spindle two-piece spindle-mount device' locking devices lock the respective rotatable spindle-mount spherical-action rotors to the respective stationary spindle-mount spherical-bases to maintain the co-planar alignment of the at least three rotatable flat-surfaced spindle-tops' flat surfaces;

h) providing a floating, rotatable abrading platen having a precision-flat annular abrading-surface that has an annular abrading-surface radial width and an annular abrading-surface inner radius and an annular abrading-surface outer radius and where the floating, rotatable abrading platen is supported by and is rotationally driven about an floating, rotatable abrading platen rotation axis located at a rotational center of the floating, rotatable abrading platen by a spherical-action rotation device located at the rotational center of the floating, rotatable abrading platen and where the floating, rotatable abrading platen spherical-action rotation device restrains the floating, rotatable abrading platen in a radial direction relative to the floating, rotatable abrading platen axis of rotation and where the floating, rotatable abrading platen axis of rotation is concentric with the machine base spindle-circle;

i) wherein the floating, rotatable abrading platen spherical-action rotation device spherical moves the floating, rotatable abrading platen about the floating, rotatable abrading platen rotational center where the precision-flat annular abrading-surface of the floating, rotatable abrading platen that is supported by the floating, rotatable abrading platen spherical-action rotation device is nominally horizontal; and j) providing flexible abrasive disk articles having annular bands of abrasive coated surfaces that have an abrasive coated surface annular band radial width and an abrasive coated surface annular band inner radius and an abrasive coated surface annular band outer radius where a selected flexible abrasive disk is attached in flat conformal contact with an floating, rotatable abrading platen precision-flat annular abrading-surface such that the attached abrasive disk is concentric with the floating, rotatable abrading platen precision-flat annular abrading-surface wherein the floating, rotatable abrading platen precision-flat annular abrading-surface radial width is at least equal to the radial width of the attached flexible abrasive disk abrasive coated annular abrading band and wherein the floating, rotatable abrading platen precision-flat annular abrading-surface provides conformal support of the full-abrasive-surface of the flexible abrasive disk abrasive coated surface annular band where the floating, rotatable abrading platen precision-flat annular abrading-surface inner radius is less than an inner radius of the attached flexible abrasive disk abrasive coated surface annular band and where an floating, rotatable abrading platen precision-flat annular abrading-surface outer radius is greater than the outer radius of the attached flexible abrasive disk abrasive coated surface annular band;

k) providing that the selected flexible abrasive disk is attached in flat conformal contact with the floating, rotatable abrading platen precision-flat annular abrading-surface by a disk attachment technique selected from the group consisting of vacuum disk attachment techniques, mechanical disk attachment techniques and adhesive disk attachment techniques;

l) vertically moving the floating, rotatable abrading platen along the floating, rotatable abrading platen rotation axis by the floating, rotatable abrading platen spherical-action rotation device to allow the abrasive surface of the flexible abrasive disk that is attached to the floating, rotatable abrading platen precision-flat annular abrading-surface to contact the co-planar flat surfaces of the at least three rotatable flat-surfaced spindle-tops wherein the at least three rotary spindles provide at least three-point support of the floating, rotatable abrading platen;

m) applying a total floating, rotatable abrading platen abrading contact force to the at least three rotatable flat-surfaced spindle-tops' flat surfaces by contact of the abrasive surface of the flexible abrasive disk that is attached to the floating, rotatable abrading platen precision-flat annular abrading-surface with the flat surfaces of the at least three rotatable flat-surfaced spindle-tops where the total floating, rotatable abrading platen abrading contact force is controlled through the floating, rotatable abrading platen spherical-action floating, rotatable abrading platen rotation device to allow the total floating, rotatable abrading platen abrading contact force to be evenly distributed to the respective at least three rotatable flat-surfaced spindle-tops; and n) rotating the at least three rotatable flat-surfaced spindle-tops about their respective rotatable flat-surfaced spindle-tops' rotation axes and rotating the floating, rotatable abrading platen having the attached flexible abrasive disk about the floating, rotatable abrading platen rotation axis to abrade the co-planar flat surfaces of the at least three rotatable flat-surfaced spindle-tops while the moving abrasive surface of the flexible abrasive disk that is attached to the moving floating, rotatable abrading platen precision-flat annular abrading-surface is in force-controlled abrading contact with the co-planar flat surfaces of the at least three rotatable flat-surfaced spindle-tops and where the floating, rotatable abrading platen precision-flat annular abrading-surface assumes a co-planar alignment with the precisely co-planar flat surfaces of respective at least three rotatable flat-surfaced spindle-tops.

In addition, the process of using the two-piece spherical-action spindle mount abrading machine for abrading the top flat surfaces of the rotary spindles is described for an at least three-point fixed-spindle floating-platen abrading machine where auxiliary rotary spindles in excess of three rotary spindles which are primary rotary spindles are attached to the machine base flat surface using rotary spindle two-piece spindle-mount devices and where the auxiliary rotary spindles are each positioned between adjacent primary rotary spindles, and where the auxiliary rotary spindles have circular rotatable flat-surfaced spindle-tops that each have rotatable flat-surfaced spindle-top axis of rotation at a center of their respective auxiliary rotatable flat-surfaced spindle spindle-top and where the respective auxiliary rotatable flat-surfaced spindle spindle-tops' axes of rotation intersect the machine base spindle-circle and where the top surfaces of the rotary spindle respective rotatable flat-surfaced spindle-tops of the auxiliary rotary spindles are precisely co-planar with the precisely co-planar top surfaces of the rotatable flat-surfaced spindle-tops of the three primary rotary spindles and the rotary spindle two-piece spindle-mount device' locking devices are engaged to lock the auxiliary rotary spindles' respective rotatable spindle-mount spherical-action rotors to the respective stationary spindle-mount spherical-bases to maintain the co-planar alignment of the auxiliary rotatable flat-surfaced spindles' spindle-tops' flat surfaces.

Further, a process is described of abrading a non-precision-flat annular abrading-surface of a floating, rotatable abrading platen on an at least three-point fixed-spindle floating-platen abrading machine to recondition or reestablish the planar precision-flatness of the floating, rotatable abrading platen annular abrading-surface comprising:

a) providing at least three rotary spindles having circular rotatable flat-surfaced spindle-tops that each have a rotatable flat-surfaced spindle-top axis of rotation at the center of a respective rotatable flat-surfaced spindle-top;

b) wherein the at least three rotatable flat-surfaced spindle-tops' axes of rotation are perpendicular to the respective rotatable flat-surfaced spindle-tops' flat surfaces;

c) providing an abrading machine base having a horizontal nominally-flat top surface and a spindle-circle where the spindle-circle is coincident with the machine base nominally-flat top surface;

d) providing a rotary spindle two-piece spindle-mount devices consisting essentially of a rotatable spindle-mount spherical-action rotor and a stationary spindle-mount spherical-base where both the rotatable spindle-mount spherical-action rotor and the stationary spindle-mount spherical-base have a common-radius spherical-joint wherein the rotatable spindle-mount spherical-action rotors are mounted in common-radius spherical joint surface contact with respective stationary spindle-mount spherical-bases and wherein the rotatable spindle-mount spherical-action rotors are supported by the respective stationary spindle-mount spherical-bases where each rotary spindle two-piece spindle-mount device allows the rotatable spindle-mount spherical-action rotors to be rotated through spherical angles relative to the respective stationary spindle-mount spherical-bases and wherein the at least three rotary spindles are mechanically attached to respective at least three rotary spindle two-piece spindle-mount devices' rotatable spindle-mount spherical-action rotors and wherein rotary spindle two-piece spindle-mount device' locking devices are adapted to lock the respective rotatable spindle-mount spherical-action rotors to the respective stationary spindle-mount spherical-bases;

e) providing that the at least three rotary spindles are located with approximately equal spacing between the at least three of the rotary spindles and the at least three rotatable flat-surfaced spindle-tops' axes of rotation intersect the machine base spindle-circle and where the respective at least three rotary spindle two-piece spindle-mount devices' spindle-mount spherical-bases are mechanically attached to the machine base nominally-flat top surface at respective at least three rotary spindles' spindle-circle locations;

f) providing that the at least three rotatable flat-surfaced spindle-tops' flat surfaces are aligned to be co-planar with respect to each other by spherical rotation of the rotatable spindle-mount spherical-action rotors relative to the respective stationary spindle-mount spherical-bases;

g) wherein rotary spindle two-piece spindle-mount device' locking devices lock the respective rotatable spindle-mount spherical-action rotors to the respective stationary spindle-mount spherical-bases to maintain the co-planar alignment of the at least three rotatable flat-surfaced spindle-tops' flat surfaces;

h) providing a floating, rotatable abrading platen having a non-precision-flat annular abrading-surface that has an annular abrading-surface radial width and an annular abrading-surface inner radius and an annular abrading-surface outer radius and where the floating, rotatable abrading platen is supported by and is rotationally driven about an floating, rotatable abrading platen rotation axis located at a rotational center of the floating, rotatable abrading platen by a spherical-action rotation device located at the rotational center of the floating, rotatable abrading platen and where the floating, rotatable abrading platen spherical-action rotation device restrains the floating, rotatable abrading platen in a radial direction relative to the floating, rotatable abrading platen axis of rotation and where the floating, rotatable abrading platen axis of rotation is concentric with the machine base spindle-circle;

i) wherein the floating, rotatable abrading platen spherical-action rotation device spherical moves the floating, rotatable abrading platen about the floating, rotatable abrading platen rotational center where the precision-flat annular abrading-surface of the floating, rotatable abrading platen that is supported by the floating, rotatable abrading platen spherical-action rotation device is nominally horizontal; and j) attaching abrasive disk components having abrasive surfaces concentric to the circular flat surfaces of at least three rotatable flat-surfaced spindle-tops wherein the rotatable flat-surfaced spindle-top abrasive disk components have abrasive disk component outer diameters that are larger than the radial width of the non-precision-flat annular abrading-surface of the floating, rotatable abrading platen wherein outer diameter portions of the rotatable flat-surfaced spindle-top disk-type abrasive components extend radially over both the floating, rotatable abrading platen non-precision-flat annular abrading-surface inner annular radius and the floating, rotatable abrading platen non-precision-flat annular abrading-surface outer annular radius;

k) moving the floating, rotatable abrading platen vertically along the floating, rotatable abrading platen rotation axis by the floating, rotatable abrading platen spherical-action rotation device to allow the floating, rotatable abrading platen non-precision-flat annular abrading-surface to contact the abrasive surfaces of the rotatable flat-surfaced spindle-top abrasive disk components wherein the at least three rotary spindles having the attached disk-type abrasive components provide at least three-point support of the floating, rotatable abrading platen; and l) applying a total floating, rotatable abrading platen abrading contact force to the abrasive surface of the abrasive disk components that are attached to the at least three rotatable flat-surfaced spindle-top flat surfaces by contact of the non-precision-flat annular abrading-surface of the floating, rotatable abrading platen with the abrasive surfaces of the abrasive disk components that are attached to the flat surfaces of the respective at least three rotatable flat-surfaced spindle-tops where the total floating, rotatable abrading platen abrading contact force is controlled through the floating, rotatable abrading platen spherical-action rotation device to allow the total floating, rotatable abrading platen abrading contact force to be evenly distributed to respective at least three rotary spindles' abrasive disk components;

m) rotating the at least three rotatable flat-surfaced spindle-tops having the attached abrasive disk components about the respective rotatable flat-surfaced spindle-tops' rotation axes of rotation and rotating the floating, rotatable abrading platen having the non-precision-flat annular abrading-surface about the floating, rotatable abrading platen rotation axis to abrade the non-precision-flat annular abrading-surface of the floating, rotatable abrading platen with the rotatable flat-surfaced spindle-top disk-type abrasive components while the moving floating, rotatable abrading platen non-precision-flat annular abrading-surface is in force-controlled abrading contact with the abrasive surfaces of the rotatable flat-surfaced spindle-top abrasive disk components and where the non-precision-flat annular abrading-surface of the floating, rotatable abrading platen develops a precision-flat annular abrading-surface due to the at least three rotatable flat-surfaced spindle-tops abrasive disk components' abrading action on the floating, rotatable abrading platen abrading-surface and where the floating, rotatable abrading platen precision-flat annular abrading-surface assumes a co-planar alignment with the precisely co-planar flat surfaces of the at least three rotatable flat-surfaced spindle-tops.

Further, the process of abrading the non-precision-flat annular abrading-surface of a floating, rotatable abrading platen is described where the non-precision-flat annular abrading-surface of the floating, rotatable abrading platen is abraded to recondition or reestablish planar precision-flatness of the non-precision-flat floating, rotatable abrading platen annular abrading-surface using abrasive conditioning ring rotatable flat-surfaced spindle-top abrasive components, the process comprising:

a) attaching abrasive conditioning ring abrasive components concentric to the circular flat surfaces of the at least three rotatable flat-surfaced spindle-tops where the rotatable flat-surfaced spindle-top abrasive conditioning rings have an abrasive coated annular flat surface that has an abrasive conditioning ring abrasive coated annular outer diameter that is larger than the radial width of the annular abrading-surface of the floating, rotatable abrading platen and wherein outer diameter portions of the abrasive conditioning rings' annular abrasive flat surface extend radially over both the floating, rotatable abrading platen non-precision-flat annular abrading-surface inner annular radius and the floating, rotatable abrading platen non-precision-flat annular abrading-surface outer annular radius; and b) adapting the abrasive conditioning rings that are attached to the at least three rotatable flat-surfaced spindle-tops where the abrasive conditioning ring annular abrasive flat surfaces have equal-heights above each respective rotatable flat-surfaced spindle-top;

c) moving the floating, rotatable abrading platen vertically along the floating, rotatable abrading platen rotation axis by the floating, rotatable abrading platen spherical-action rotation device to allow the floating, rotatable abrading platen non-precision-flat annular abrading-surface to contact the abrasive flat surfaces of the rotatable flat-surfaced spindle-top abrasive conditioning rings wherein the at least three rotary spindles having the attached rotatable flat-surfaced spindle-top abrasive conditioning rings provide at least three-point support of the floating, rotatable abrading platen; and d) applying a total floating, rotatable abrading platen abrading contact force to the abrasive flat surface of the abrasive conditioning rings abrasive components that are attached to the at least three spindle-top flat surfaces by contact of the non-precision-flat floating, rotatable abrading platen annular abrading-surface with the abrasive flat surfaces of the abrasive conditioning rings where the total floating, rotatable abrading platen abrading contact force is controlled through the floating, rotatable abrading platen spherical-action rotation device to allow the total floating, rotatable abrading platen abrading contact force to be evenly distributed to the respective at least three rotary spindles' abrasive conditioning rings;

e) rotating the at least three rotatable flat-surfaced spindle-tops having the attached abrasive conditioning rings about the respective at least three rotatable flat-surfaced spindle-tops axes of rotation and rotating the floating, rotatable abrading platen about the floating, rotatable abrading platen rotation axis to abrade the non-precision-flat annular abrading-surface of the floating, rotatable abrading platen with the abrasive conditioning rings' abrasive flat surfaces while the moving floating, rotatable abrading platen non-precision-flat annular abrading-surface is in force-controlled abrading contact with the abrasive conditioning rings' abrasive flat surfaces and where the non-precision-flat annular abrading-surface of the floating, rotatable abrading platen develops a precision-flat annular abrading-surface due to the at least three rotatable flat-surfaced spindle-tops' abrasive conditioning rings abrasive flat surfaces abrading action on the floating, rotatable abrading platen abrading-surface and where the floating, rotatable abrading platen precision-flat annular abrading-surface assumes a co-planar alignment with the precisely co-planar flat surfaces of the at least three rotatable flat-surfaced spindle-tops.

Also, a process is described of abrading a non-precision-flat annular abrasive surface of an abrasive disk that is attached to a precision-flat annular abrading-surface of a floating, rotatable abrading platen on an at least three-point fixed-spindle floating-platen abrading machine to recondition or reestablish the planar precision-flatness of the flat annular abrasive surface of the abrasive disk, the process comprising:

a) providing at least three rotary spindles having circular rotatable flat-surfaced spindle-tops that each have a rotatable flat-surfaced spindle-top axis of rotation at the center of a respective rotatable flat-surfaced spindle-top;

b) wherein the at least three rotatable flat-surfaced spindle-tops' axes of rotation are perpendicular to the respective rotatable flat-surfaced spindle-tops' flat surfaces;

c) providing an abrading machine base having a horizontal nominally-flat top surface and a spindle-circle where the spindle-circle is coincident with the machine base nominally-flat top surface;

d) providing a rotary spindle two-piece spindle-mount devices consisting essentially of a rotatable spindle-mount spherical-action rotor and a stationary spindle-mount spherical-base where both the rotatable spindle-mount spherical-action rotor and the stationary spindle-mount spherical-base have a common-radius spherical-joint wherein the rotatable spindle-mount spherical-action rotors are mounted in common-radius spherical-joint surface contact with respective stationary spindle-mount spherical-bases and wherein the rotatable spindle-mount spherical-action rotors are supported by the respective stationary spindle-mount spherical-bases where each rotary spindle two-piece spindle-mount device allows the rotatable spindle-mount spherical-action rotors to be rotated through spherical angles relative to the respective stationary spindle-mount spherical-bases and wherein the at least three rotary spindles are mechanically attached to respective at least three rotary spindle two-piece spindle-mount devices' rotatable spindle-mount spherical-action rotors and wherein rotary spindle two-piece spindle-mount device' locking devices are adapted to lock the respective rotatable spindle-mount spherical-action rotors to the respective stationary spindle-mount spherical-bases;

e) providing that the at least three rotary spindles are located with approximately equal spacing between the at least three of the rotary spindles and the at least three rotatable flat-surfaced spindle-tops' axes of rotation intersect the machine base spindle-circle and where the respective at least three rotary spindle two-piece spindle-mount devices' spindle-mount spherical-bases are mechanically attached to the machine base nominally-flat top surface at respective at least three rotary spindles' spindle-circle locations;

f) providing that the at least three rotatable flat-surfaced spindle-tops' flat surfaces are aligned to be co-planar with respect to each other by spherical rotation of the rotatable spindle-mount spherical-action rotors relative to the respective stationary spindle-mount spherical-bases;

g) wherein rotary spindle two-piece spindle-mount device' locking devices lock the respective rotatable spindle-mount spherical-action rotors to the respective stationary spindle-mount spherical-bases to maintain the co-planar alignment of the at least three rotatable flat-surfaced spindle-tops' flat surfaces;

h) providing a floating, rotatable abrading platen having a precision-flat annular abrading-surface that has an annular abrading-surface radial width and an annular abrading-surface inner radius and an annular abrading-surface outer radius and where the floating, rotatable abrading platen is supported by and is rotationally driven about an floating, rotatable abrading platen rotation axis located at a rotational center of the floating, rotatable abrading platen by a spherical-action rotation device located at the rotational center of the floating, rotatable abrading platen and where the floating, rotatable abrading platen spherical-action rotation device restrains the floating, rotatable abrading platen in a radial direction relative to the floating, rotatable abrading platen axis of rotation and where the floating, rotatable abrading platen axis of rotation is concentric with the machine base spindle-circle;

i) wherein the floating, rotatable abrading platen spherical-action rotation device spherical moves the floating, rotatable abrading platen about the floating, rotatable abrading platen rotational center where the precision-flat annular abrading-surface of the floating, rotatable abrading platen that is supported by the floating, rotatable abrading platen spherical-action rotation device is nominally horizontal; and j) providing flexible abrasive disk articles having non-precision-flat annular bands of abrasive coated surfaces that have an abrasive coated surface annular band radial width and an abrasive coated surface annular band inner radius and an abrasive coated surface annular band outer radius, and attaching a flexible abrasive disk in flat conformal contact with a floating, rotatable abrading platen precision-flat annular abrading-surface such that the attached abrasive disk is concentric with the floating, rotatable abrading platen precision-flat annular abrading-surface wherein the floating, rotatable abrading platen precision-flat annular abrading-surface radial width is at least equal to the radial width of the attached flexible abrasive disk non-precision-flat annular abrasive surface and wherein the floating, rotatable abrading platen precision-flat annular abrading-surface provides conformal support of the full-abrasive-surface of the flexible abrasive disk non-precision-flat annular abrasive surface where the floating, rotatable abrading platen precision-flat annular abrading-surface inner radius is less than an inner radius of the attached flexible abrasive disk non-precision-flat annular abrasive surface where the floating, rotatable abrading platen precision-flat annular abrading-surface outer radius is greater than the outer radius of the attached flexible abrasive disk non-precision-flat annular abrasive surface;

k) attaching each flexible abrasive disk in flat conformal contact with the floating, rotatable abrading platen precision-flat annular abrading-surface by disk attachment systems selected from the group consisting of vacuum disk attachment, mechanical disk attachment and adhesive disk attachment;

l) attaching abrasive disk components having abrasive surfaces concentric to the circular flat surfaces of at least three rotatable flat-surfaced spindle-tops wherein the rotatable flat-surfaced spindle-top abrasive disk components have abrasive disk component outer diameters that are larger than the radial width of the non-precision-flat annular abrasive surface of the flexible disk that is attached to the floating, rotatable abrading platen precision-flat annular abrading-surface wherein outer diameter portions of the rotatable flat-surfaced spindle-top abrasive disk components extend radially over both the abrasive disk's non-precision-flat annular abrasive surface inner radius and the abrasive disk's non-precision-flat annular abrasive surface outer radius;

m) moving the floating, rotatable abrading platen vertically along the floating, rotatable abrading platen rotation axis by the floating, rotatable abrading platen spherical-action rotation device to allow the flexible abrasive disk non-precision-flat annular abrasive surface to contact the abrasive surfaces of the rotatable flat-surfaced spindle-top disk abrasive components wherein the at least three rotary spindles having the attached rotatable flat-surfaced spindle-top disk abrasive components provide at least three-point support of the floating, rotatable abrading platen; and n) applying a total floating, rotatable abrading platen abrading contact force to the abrasive surface of the rotatable flat-surfaced spindle-top disk abrasive components by contact of the flexible abrasive disk non-precision-flat annular abrasive surface with the abrasive surfaces of the disk abrasive components that are attached to the flat surfaces of the respective at least three rotatable flat-surfaced spindle-tops where the total floating, rotatable abrading platen abrading contact force is controlled through the floating, rotatable abrading platen spherical-action floating, rotatable abrading platen rotation device to allow the total floating, rotatable abrading platen abrading contact force to be evenly distributed to the respective at least three rotatable flat-surfaced spindles' spindle-top disk abrasive components;

o) rotating the at least three rotatable flat-surfaced spindle-tops having the attached disk abrasive components about the respective rotatable flat-surfaced spindle-tops' rotation axes of rotation and rotating the floating, rotatable abrading platen having the attached flexible abrasive disk with the non-precision-flat annular abrasive surface about the floating, rotatable abrading platen rotation axis to abrade the non-precision-flat annular abrasive surface of the flexible abrasive disk with the rotatable flat-surfaced spindle-top disk abrasive components while the moving non-precision-flat annular abrasive surface of the flexible abrasive disk that is attached to the moving floating, rotatable abrading platen is in force-controlled abrading contact with the abrasive surfaces of the rotatable flat-surfaced spindle-top disk abrasive components and where the non-precision-flat annular abrasive surface of the flexible abrasive disk develops a precision-flat annular abrasive surface due to the at least three rotatable flat-surfaced spindle-tops disk abrasive components' abrading action on the flexible abrasive disk annular abrasive surface and where the floating, rotatable abrading platen precision-flat annular abrading-surface assumes a co-planar alignment with the precisely co-planar flat surfaces of the at least three spindle-tops.

Also, the process of abrading a non-precision-flat annular abrasive surface of an abrasive disk that is attached to a precision-flat annular abrading-surface of a floating, rotatable abrading platen is described where the non-precision-flat abrasive disk annular abrasive surface of an abrasive disk that is attached to a precision-flat annular floating, rotatable abrading platen abrading-surface is abraded to recondition or reestablish planar precision-flatness of the annular abrasive surface of the non-precision-flat abrasive disk using abrasive conditioning rings types of abrasive components comprising:

a) attaching abrasive conditioning ring abrasive components concentric to the circular flat surfaces of at least three spindle-tops where the spindle-top abrasive conditioning rings have an abrasive coated annular flat surface that has an abrasive conditioning ring abrasive coated annular outer diameter that is larger than the radial width of the abrasive disk non-precision-flat annular abrasive surface and wherein outer diameter portions of the abrasive conditioning rings' annular abrasive flat surface extend radially over both the abrasive disk non-precision-flat annular abrasive surface inner annular radius and the abrasive disk non-precision-flat annular abrasive surface outer annular radius; and b) adapting the abrasive conditioning rings that are attached to the at least three rotatable flat-surfaced spindle-tops where the abrasive conditioning ring annular abrasive flat surfaces have equal-heights above each respective rotatable flat-surfaced spindle-top;

c) moving the floating, rotatable abrading platen vertically along the floating, rotatable abrading platen rotation axis by the floating, rotatable abrading platen spherical-action rotation device to allow the flexible abrasive disk non-precision-flat annular abrasive surface to contact the abrasive flat surfaces of the spindle-top abrasive conditioning rings wherein the at least three rotary spindles having the attached spindle-top abrasive conditioning rings provide at least three-point support of the floating, rotatable abrading platen; and d) applying a total floating, rotatable abrading platen abrading contact force to the abrasive flat surface of the abrasive conditioning rings abrasive components that are attached to the at least three spindle-top flat surfaces by contact of the non-precision-flat annular abrasive surface of the flexible abrasive disk with the abrasive flat surfaces of the abrasive conditioning rings where the total floating, rotatable abrading platen abrading contact force is controlled through the floating, rotatable abrading platen spherical-action rotation device to allow the total floating, rotatable abrading platen abrading contact force to be evenly distributed to the respective at least three rotary spindles' abrasive conditioning rings;

e) rotating the at least three spindle-tops having the attached abrasive conditioning rings about the respective at least three spindle-tops axes of rotation and rotating the floating, rotatable abrading platen about the floating, rotatable abrading platen rotation axis to abrade the non-precision-flat annular abrasive surface of the flexible abrasive disk with the abrasive conditioning rings' abrasive flat surfaces while the moving non-precision-flat annular abrasive surface of the abrasive disk that is attached to the moving floating, rotatable abrading platen is in force-controlled abrading contact with the abrasive conditioning rings abrasive flat surfaces and where the non-precision-flat abrasive disk annular abrasive surface develops a precision-flat annular abrasive surface due to the at least three spindle-tops' abrasive conditioning rings abrasive flat surfaces abrading action on the flexible abrasive disk annular abrasive surface and where the floating, rotatable abrading platen precision-flat annular abrading-surface assumes a co-planar alignment with the precisely co-planar flat surfaces of the at least three spindle-tops.

Also, the process of abrading a non-precision-flat annular abrasive surface of an abrasive disk that is attached to a precision-flat annular abrading-surface of a floating, rotatable abrading platen is described where auxiliary rotary spindles in excess of three rotary spindles which are primary rotary spindles are attached to the machine base flat surface using rotary spindle two-piece spindle-mount devices and where the auxiliary rotary spindles are each positioned between adjacent primary rotary spindles, and where the auxiliary rotary spindles have circular rotatable flat-surfaced spindle-tops that each have rotatable flat-surfaced spindle-top axis of rotation at a center of their respective auxiliary rotatable flat-surfaced spindle spindle-top and where the respective auxiliary rotatable flat-surfaced spindle spindle-tops' axes of rotation intersect the machine base spindle-circle and where the top surfaces of the rotary spindle respective rotatable flat-surfaced spindle-tops of the auxiliary rotary spindles are precisely co-planar with the precisely co-planar top surfaces of the rotatable flat-surfaced spindle-tops of the three primary rotary spindles and the rotary spindle two-piece spindle-mount device' locking devices are engaged to lock the auxiliary rotary spindles' respective rotatable spindle-mount spherical-action rotors to the respective stationary spindle-mount spherical-bases to maintain the co-planar alignment of the auxiliary rotatable flat-surfaced spindles' spindle-tops' flat surfaces.

Further, the process of abrading a non-precision-flat annular abrasive surface of an abrasive disk that is attached to a precision-flat annular abrading-surface of a floating, rotatable abrading platen is described where the floating, rotatable abrading platen flexible abrasive disk articles are selected from the group consisting of: flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization resilient disk pads that are suitable for use with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, and flexible flat-surfaced metal or polymer disks.

What is claimed:

1. An at least three-point, fixed-spindle floating-platen abrading machine comprising:

a) at least three rotary spindles having circular rotatable flat-surfaced spindle-tops that each have a spindle-top axis of rotation at the center of a respective rotatable flat-surfaced spindle-top for respective rotary spindles;

b) wherein the at least three spindle-tops' axes of rotation are perpendicular to the respective spindle-tops' flat surfaces;

c) an abrading machine base having a horizontal nominally-flat top surface and a spindle-circle where the spindle-circle is coincident with the machine base nominally-flat top surface;

d) rotary spindle two-piece spindle-mount devices comprising a rotatable spindle-mount spherical-action rotor and a stationary spindle-mount spherical-base where both the spindle-mount spherical-action rotor and a stationary spindle-mount spherical-base have a common-radius spherical-joint wherein each rotatable spindle-mount spherical-action rotor is mounted in common-radius spherical-joint surface contact with a respective stationary spindle-mount spherical-bases and wherein the rotatable spindle-mount spherical-action rotors are supported by the respective stationary spindle-mount spherical-bases where each rotary spindle two-piece spindle-mount device allows the rotatable spindle-mount spherical-action rotors to be rotated through spherical angles relative to the respective stationary spindle-mount spherical-bases and wherein the at least three rotary spindles are mechanically attached to respective at least three rotary spindle two-piece spindle-mount devices' rotatable spindle-mount spherical-action rotors and wherein rotary spindle two-piece spindle-mount device locking devices are adapted to lock the respective rotatable spindle-mount spherical-action rotors to the respective stationary spindle-mount spherical-bases;

e) wherein the at least three rotary spindles are located with near-equal spacing between the at least three of the rotary spindles and the at least three spindle-tops' axes of rotation intersect the machine base spindle-circle and where the respective at least three rotary spindle two-piece spindle-mount devices' spindle-mount spherical-bases are mechanically attached to the machine base nominally-flat top surface at locations of those respective at least three rotary spindles' spindle-circles;

f) wherein the at least three spindle-tops' flat surfaces are aligned as co-planar with each other by spherical rotation of the rotatable spindle-mount spherical-action rotors relative to the respective stationary spindle-mount spherical-bases;

g) wherein rotary spindle two-piece spindle-mount device locking devices lock the respective rotatable spindle-mount spherical-action rotors to the respective stationary spindle-mount spherical-bases to maintain the co-planar alignment of the at least three spindle-tops' flat surfaces;

h) a floating, rotatable abrading platen having a precision-flat annular abrading-surface that has an annular abrading-surface radial width and an annular abrading-surface inner radius and an annular abrading-surface outer radius and where the abrading platen is supported by and is rotationally driven about an abrading platen rotation axis located at a rotational center of the abrading platen by a spherical-action rotation device located at the rotational center of the abrading platen and where the abrading platen spherical-action rotation device restrains the abrading platen in a radial direction relative to the abrading platen axis of rotation and where the abrading platen axis of rotation is concentric with the machine base spindle-circle;

i) wherein the abrading platen spherical-action rotation device allows spherical motion of the abrading platen about the abrading platen rotational center where the precision-flat annular abrading-surface of the abrading platen that is supported by the abrading platen spherical-action rotation device is nominally horizontal; and j) flexible abrasive disk articles having annular bands of abrasive coated surfaces that have an abrasive coated surface annular band radial width and an abrasive coated surface annular band inner radius and an abrasive coated surface annular band outer radius and where a selected flexible abrasive disk is attached in flat conformal contact with an abrading platen precision-flat annular abrading-surface such that the attached abrasive disk is concentric with the abrading platen precision-flat annular abrading-surface wherein the abrading platen precision-flat annular abrading-surface radial width is at least equal to the radial width of the attached flexible abrasive disk abrasive coated annular abrading band and wherein the abrading platen precision-flat annular abrading-surface provides conformal support of the full-abrasive-surface of the flexible abrasive disk abrasive coated surface annular band where the abrading platen precision-flat annular abrading-surface inner radius is less than an inner radius of the attached flexible abrasive disk abrasive coated surface annular band and where an abrading platen precision-flat annular abrading-surface outer radius is greater than the outer radius of the attached flexible abrasive disk abrasive coated surface annular band;

k) wherein each flexible abrasive disk is attached in flat conformal contact with the abrading platen precision-flat annular abrading-surface by a disk attachment techniques selected from the group consisting of vacuum disk attachment techniques, mechanical disk attachment techniques and adhesive disk attachment techniques;

l) wherein equal-thickness workpieces having parallel opposed flat workpiece top surfaces and flat workpiece bottom surfaces are attached in flat-surfaced contact with the flat surfaces of the respective at least three spindle-tops where the workpiece bottom surfaces contact the flat surfaces of the respective at least three spindle-tops;

m) wherein the abrading platen can be moved vertically along the abrading platen rotation axis by the abrading platen spherical-action rotation device to allow the abrasive surface of the flexible abrasive disk that is attached to the abrading platen precision-flat annular abrading-surface to contact the top surfaces of the workpieces that are attached to the flat surfaces of the respective at least three spindle-tops wherein the at least three rotary spindles provide at least three-point support of the abrading platen;

n) wherein the total abrading platen abrading contact force applied to workpieces that are attached to the respective at least three spindle-top flat surfaces by contact of the abrasive surface of the flexible abrasive disk that is attached to the abrading platen precision-flat annular abrading-surface with the top surfaces of the workpieces that are attached to the flat surfaces of the respective at least three spindle-tops is controlled through the abrading platen spherical-action abrading platen rotation device to allow the total abrading platen abrading contact force to be evenly distributed to the workpieces attached to the respective at least three spindle-tops; and o) wherein the at least three spindle-tops having the attached equal-thickness workpieces can be rotated about the respective spindle-tops' rotation axes and the abrading platen having the attached flexible abrasive disk can be rotated about the abrading platen rotation axis to single-side abrade the equal-thickness workpieces that are attached to the flat surfaces of the at least three spindle-tops while the moving abrasive surface of the flexible abrasive disk that is attached to the moving abrading platen precision-flat annular abrading-surface is in force-controlled abrading contact with the top surfaces of the equal-thickness workpieces that are attached to the respective at least three spindle-tops and where the abrading platen precision-flat annular abrading-surface assumes a co-planar alignment with the precisely co-planar flat surfaces of the respective at least three spindle-tops.

2. The machine of claim 1 wherein at least one flat-surfaced circular device is selected from the group consisting of workpiece carriers, abrasive conditioning rings and abrasive disks is attached to the flat surfaces of the at least three spindle-tops where the selected flat-surfaced circular devices are attached to the at least three spindle-tops by attachment systems selected from the group consisting of vacuum attachment, mechanical attachment and adhesive attachment and wherein the attached flat-surfaced circular devices are concentric with the respective spindle-tops.

3. The machine of claim 1 wherein the machine base structural material is selected from the group consisting of granite and epoxy-granite and wherein the machine base structural material and the machine base structural material is either solid or is temperature controlled by a temperature-controlled fluid that circulates in fluid passageways internal to the machine base structural materials.

4. The machine of claim 1 wherein the at least three rotary spindles are air bearing rotary spindles.

5. The machine of claim 1 where the spindle-top flat surfaces of the at least three rotary spindles that are mechanically attached to respective at least three rotary spindle two-piece spindle-mount devices' rotatable spindle-mount spherical-action rotors can be aligned to be precisely co-planar with the other spindle-tops' flat surfaces by adjusting the spherical angle of the rotatable spindle-mount spherical-action rotors relative to the respective stationary spindle-mount spherical-bases while the rotatable spindle-mount spherical-action rotor is supported by respective stationary spindle-mount spherical-bases after which the rotary spindle two-piece spindle-mount device' locking devices are engaged to lock the respective rotatable spindle-mount spherical-action rotors to the respective stationary spindle-mount spherical-bases to structurally maintain the co-planar alignment of the at least three spindle-tops' flat surfaces.

6. The machine of claim 1 wherein the abrading platen flexible abrasive disk articles are selected from the group consisting of: flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization resilient disk pads that are suitable for use with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, and flexible flat-surfaced metal or polymer disks.

7. The machine of claim 1 where auxiliary rotary spindles in excess of three rotary spindles, which are primary rotary spindles, are attached to the machine base flat surface using rotary spindle two-piece spindle-mount devices and where the auxiliary rotary spindles are each positioned between adjacent primary rotary spindles, and where the auxiliary rotary spindles have circular rotatable flat-surfaced spindle-tops that each have spindle-top axis of rotation at a center of their respective auxiliary rotary spindle spindle-top and where the respective auxiliary rotary spindle spindle-tops' axes of rotation intersect the machine base spindle-circle and where top surfaces of the rotary spindle respective spindle-tops of the auxiliary rotary spindles are precisely co-planar with the precisely co-planar top surfaces of the spindle-tops of the three primary rotary spindles and the rotary spindle two-piece spindle-mount device' locking devices are engaged to lock the auxiliary rotary spindles' respective rotatable spindle-mount spherical-action rotors to the respective stationary spindle-mount spherical-bases to structurally maintain the co-planar alignment of the auxiliary rotary spindles' spindle-tops' flat surfaces.

8. A process of abrading flat-surfaced workpieces using an at least three-point fixed-spindle floating-platen abrading machine comprising:

a) providing at least three rotary spindles having circular rotatable flat-surfaced spindle-tops that each have a spindle-top axis of rotation at a center of respective rotatable flat-surfaced spindle-tops;

b) providing the at least three spindle-tops' axes of rotation perpendicular to the respective spindle-tops' flat surfaces;

c) providing an abrading machine base having a horizontal nominally-flat top surface and a spindle-circle where the spindle-circle is coincident with the abrading machine base nominally-flat top surface;

d) providing rotary spindle two-piece spindle-mount devices comprising a rotatable spindle-mount spherical-action rotor and a stationary spindle-mount spherical-base where both have a common-radius spherical-joint wherein the rotatable spindle-mount spherical-action rotors are mounted in common-radius spherical-joint surface contact with respective stationary spindle-mount spherical-bases and wherein the rotatable spindle-mount spherical-action rotors are supported by the respective stationary spindle-mount spherical-bases where each rotary spindle two-piece spindle-mount device allows the rotatable spindle-mount spherical-action rotors to be rotated through spherical angles relative to the respective stationary spindle-mount spherical-bases and wherein the at least three rotary spindles are mechanically attached to respective at least three rotary spindle two-piece spindle-mount devices' rotatable spindle-mount spherical-action rotors and wherein rotary spindle two-piece spindle-mount device locking devices are adapted to lock the respective rotatable spindle-mount spherical-action rotors to the respective stationary spindle-mount spherical-bases;

e) positioning the at least three rotary spindles with near-equal spacing between the at least three of the rotary spindles and the at least three spindle-tops' axes of rotation intersect the machine base spindle-circle and the respective at least three rotary spindle two-piece spindle-mount devices' spindle-mount spherical-bases are mechanically attached to the machine base nominally-flat top surface at respective at least three rotary spindles' spindle-circle locations;

f) aligning the at least three spindle-tops' flat surfaces co-planar with each other by spherical rotation of the rotatable spindle-mount spherical-action rotors relative to the respective stationary spindle-mount spherical-bases;

g) engaging the rotary spindle two-piece spindle-mount device locking devices to lock the respective rotatable spindle-mount spherical-action rotors to the respective stationary spindle-mount spherical-bases to maintain the co-planar alignment of the at least three spindle-tops' flat surfaces;

h) providing a floating, rotatable abrading platen having a precision-flat annular abrading-surface that has an annular abrading-surface radial width and an annular abrading-surface inner radius and an annular abrading-surface outer radius and where the abrading platen is supported by and is rotationally driven about an abrading platen rotation axis located at a rotational center of the abrading platen by a spherical-action rotation device located at the rotational center of the abrading platen and where the abrading platen spherical-action rotation device restrains the rotatable abrading platen in a radial direction relative to the abrading platen axis of rotation and where the abrading platen axis of rotation is concentric with the machine base spindle-circle;

i) allowing the abrading platen spherical-action rotation device to have spherical motion of the abrading platen about the abrading platen rotational center where the precision-flat annular abrading-surface of the abrading platen that is supported by the abrading platen spherical-action rotation device is nominally horizontal; and j) providing flexible abrasive disk articles having annular bands of abrasive coated surfaces that have an abrasive coated surface annular band radial width and an abrasive coated surface annular band inner radius and an abrasive coated surface annular band outer radius, attaching a selected flexible abrasive disk in flat conformal contact with an abrading platen precision-flat annular abrading-surface such that the attached abrasive disk is concentric with the abrading platen precision-flat annular abrading-surface wherein an abrading platen precision-flat annular abrading-surface radial width is at least equal to the radial width of the attached flexible abrasive disk abrasive coated annular abrading band and wherein the abrading platen precision-flat annular abrading-surface provides conformal support of the full-abrasive-surface of the flexible abrasive disk abrasive coated surface annular band where the abrading platen precision-flat annular abrading-surface inner radius is less than the inner radius of the attached flexible abrasive disk abrasive coated surface annular band and where the abrading platen precision-flat annular abrading-surface outer radius is greater than the outer radius of the attached flexible abrasive disk abrasive coated surface annular band;

k) attaching each flexible abrasive disk in flat conformal contact with the abrading platen precision-flat annular abrading-surface by disk attachment techniques comprising vacuum disk attachment techniques, mechanical disk attachment techniques and adhesive disk attachment techniques;

l) providing that equal-thickness workpieces having parallel or near-parallel opposed flat workpiece top surfaces and flat workpiece bottom surfaces are attached in flat-surfaced contact with the flat surfaces of a respective at least three spindle-tops where the workpiece bottom surfaces contact the flat surfaces of the respective at least three spindle-tops;

m) moving the abrading platen vertically along the abrading platen rotation axis by the abrading platen spherical-action rotation device to allow the abrasive surface of the flexible abrasive disk that is attached to the abrading platen precision-flat annular abrading-surface to contact the top surfaces of the workpieces that are attached to the flat surfaces of the respective at least three spindle-tops wherein the at least three rotary spindles provide at least three-point support of the abrading platen; and n) applying a total abrading platen abrading contact force to workpieces that are attached to the respective at least three spindle-top flat surfaces by contact of the abrasive surface of the flexible abrasive disk that is attached to the abrading platen precision-flat annular abrading-surface with the top surfaces of the workpieces that are attached to the flat surfaces of the respective at least three spindle-tops is controlled through the abrading platen spherical-action abrading platen rotation device to allow the total abrading platen abrading contact force to be evenly distributed to the workpieces attached to the respective at least three spindle-tops;

o) providing that the at least three spindle-tops having the attached equal-thickness workpieces are rotated about the respective spindle-tops' rotation axes and the abrading platen having the attached flexible abrasive disk is rotated about the abrading platen rotation axis to single-side abrade the equal-thickness workpieces that are attached to the flat surfaces of the at least three spindle-tops while the moving abrasive surface of the flexible abrasive disk that is attached to the moving abrading platen precision-flat annular abrading-surface is in force-controlled abrading contact with the top surfaces of the equal-thickness workpieces that are attached to the respective at least three spindle-tops and where the abrading platen precision-flat annular abrading-surface assumes a co-planar alignment with the precisely co-planar flat surfaces of the respective at least three spindle-tops.

9. The process of claim 8 where flat-surfaced equal-thickness workpieces having top and bottom surfaces are provided where a workpiece top surface is a first workpiece surface and a workpiece bottom surface is a second workpiece surface and where the flat-surfaced equal-thickness workpieces are attached to the at least three spindle-tops, and the first workpiece surfaces are abraded by the flexible abrasive disk article that is attached to the abrading platen precision-flat annular abrading-surface when the second workpiece surfaces are attached to the at least three spindle-tops, and after the first workpiece surface is abraded, the flat-surfaced equal-thickness workpieces are removed from the at least three spindle-tops and the flat-surfaced equal-thickness workpieces are re-attached to the at least three spindle-tops where the abraded first workpiece surfaces are attached to the spindle-tops and the second workpiece surfaces are abraded by the flexible abrasive disk article that is attached to the abrading platen precision-flat annular abrading-surface workpiece.

10. The process of claim 8 wherein the abrading platen flexible abrasive disk articles are selected from the group consisting of: flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization resilient disk pads that are suitable for use with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, and flexible flat-surfaced metal or polymer disks.

11. The process of claim 8 where the spindle-top flat surfaces of the at least three rotary spindles that are mechanically attached to respective at least three rotary spindle two-piece spindle-mount devices' rotatable spindle-mount spherical-action rotors can be aligned to be precisely co-planar with the other spindle-tops' flat surfaces by adjusting the spherical angle of the rotatable spindle-mount spherical-action rotors relative to the respective stationary spindle-mount spherical-bases while the rotatable spindle-mount spherical-action rotor is supported by respective stationary spindle-mount spherical-bases after which the rotary spindle two-piece spindle-mount device' locking devices are engaged to lock the respective rotatable spindle-mount spherical-action rotors to the respective stationary spindle-mount spherical-bases to structurally maintain the co-planar alignment of the at least three spindle-tops' flat surfaces.

12. The process of claim 8 where auxiliary rotary spindles in excess of three rotary spindles which are primary rotary spindles are attached to the machine base flat surface using rotary spindle two-piece spindle-mount devices and where the auxiliary rotary spindles are each positioned between adjacent primary rotary spindles, and where the auxiliary rotary spindles have circular rotatable flat-surfaced spindle-tops that each have spindle-top axis of rotation at a center of their respective auxiliary rotary spindle spindle-top and where the respective auxiliary rotary spindle spindle-tops' axes of rotation intersect the machine base spindle-circle and where the top surfaces of the rotary spindle respective spindle-tops of the auxiliary rotary spindles are precisely co-planar with the precisely co-planar top surfaces of the spindle-tops of the three primary rotary spindles and the rotary spindle two-piece spindle-mount device' locking devices are engaged to lock the auxiliary rotary spindles' respective rotatable spindle-mount spherical-action rotors to the respective stationary spindle-mount spherical-bases to structurally maintain the co-planar alignment of the auxiliary rotary spindles' spindle-tops' flat surfaces.

13. A process of abrading the top flat surfaces of rotary spindles using an at least three-point fixed-spindle floating-platen abrading machine comprising:

a) providing at least three rotary spindles having circular rotatable flat-surfaced spindle-tops that each have a spindle-top axis of rotation at a center of the respective rotatable flat-surfaced spindle-top;

b) providing the at least three spindle-tops' axes of rotation so that they are perpendicular to the respective spindle-tops' flat surfaces;

c) providing an abrading machine base having a horizontal nominally-flat top surface and a spindle-circle where the spindle-circle is coincident with the machine base nominally-flat top surface;

d) providing rotary spindle two-piece spindle-mount devices consisting of a rotatable spindle-mount spherical-action rotor and a stationary spindle-mount spherical-base where both have a common-radius spherical-joint wherein the rotatable spindle-mount spherical-action rotors are mounted in common-radius spherical-joint surface contact with respective stationary spindle-mount spherical-bases and wherein the rotatable spindle-mount spherical-action rotors are supported by the respective stationary spindle-mount spherical-bases where each rotary spindle two-piece spindle-mount device allows the rotatable spindle-mount spherical-action rotors to be rotated through spherical angles relative to the respective stationary spindle-mount spherical-bases and wherein the at least three rotary spindles are mechanically attached to respective at least three rotary spindle two-piece spindle-mount devices' rotatable spindle-mount spherical-action rotors and wherein rotary spindle two-piece spindle-mount device' locking devices have the capability to lock the respective rotatable spindle-mount spherical-action rotors to the respective stationary spindle-mount spherical-bases;

e) positioning the at least three rotary spindles with near-equal spacing between the at least three of the rotary spindles and that the at least three spindle-tops' axes of rotation intersect the machine base spindle-circle and where the respective at least three rotary spindle two-piece spindle-mount devices' spindle-mount spherical-bases are mechanically attached to the machine base nominally-flat top surface at those respective at least three rotary spindles' spindle-circle locations;

f) wherein the at least three spindle-tops' flat surfaces are aligned to be co-planar with each other by spherical rotation of the rotatable spindle-mount spherical-action rotors relative to the respective stationary spindle-mount spherical-bases;

g) engaging the rotary spindle two-piece spindle-mount device' locking devices to lock the respective rotatable spindle-mount spherical-action rotors to the respective stationary spindle-mount spherical-bases to structurally maintain the co-planar alignment of the at least three spindle-tops' flat surfaces;

h) providing a floating, rotatable abrading platen having a precision-flat annular abrading-surface that has an annular abrading-surface radial width and an annular abrading-surface inner radius and an annular abrading-surface outer radius and where the abrading platen is supported by and is rotationally driven about an abrading platen rotation axis located at a rotational center of the abrading platen by a spherical-action rotation device located at the rotational center of the abrading platen and where the abrading platen spherical-action rotation device restrains the abrading platen in a radial direction relative to the abrading platen axis of rotation and where the abrading platen axis of rotation is concentric with the machine base spindle-circle;

i) wherein the abrading platen spherical-action rotation device allows spherical motion of the abrading platen about the abrading platen rotational center where the precision-flat annular abrading-surface of the abrading platen that is supported by the abrading platen spherical-action rotation device is nominally horizontal; and j) providing flexible abrasive disk articles having annular bands of abrasive coated surfaces that have an abrasive coated surface annular band radial width and an abrasive coated surface annular band inner radius and an abrasive coated surface annular band outer radius where a selected flexible abrasive disk is attached in flat conformal contact with an abrading platen precision-flat annular abrading-surface such that the attached abrasive disk is concentric with the abrading platen precision-flat annular abrading-surface wherein the abrading platen precision-flat annular abrading-surface radial width is at least equal to the radial width of the attached flexible abrasive disk abrasive coated annular abrading band and wherein the abrading platen precision-flat annular abrading-surface provides conformal support of the full-abrasive-surface of the flexible abrasive disk abrasive coated surface annular band where the abrading platen precision-flat annular abrading-surface inner radius is less than the inner radius of the attached flexible abrasive disk abrasive coated surface annular band and where the abrading platen precision-flat annular abrading-surface outer radius is greater than the outer radius of the attached flexible abrasive disk abrasive coated surface annular band;

k) attaching a selected flexible abrasive disk in flat conformal contact with the abrading platen precision-flat annular abrading-surface by a disk attachment system selected from the group consisting of vacuum disk attachment, mechanical disk attachment and adhesive disk attachment;

l) vertically moving the abrading platen along the abrading platen rotation axis by the abrading platen spherical-action rotation device to allow the abrasive surface of the flexible abrasive disk that is attached to the abrading platen precision-flat annular abrading-surface to contact the co-planar flat surfaces of the at least three spindle-tops wherein the at least three rotary spindles provide at least three-point support of the abrading platen;

m) applying a total abrading platen abrading contact force to the at least three spindle-tops' flat surfaces by contact of the abrasive surface of the flexible abrasive disk that is attached to the abrading platen precision-flat annular abrading-surface with the flat surfaces of the at least three spindle-tops is controlled through the abrading platen spherical-action abrading platen rotation device to allow the total abrading platen abrading contact force to be evenly distributed to the respective at least three spindle-tops; and n) rotating the at least three spindle-tops about their respective spindle-tops' rotation axes and rotating the abrading platen having the attached flexible abrasive disk about the abrading platen rotation axis to abrade the co-planar flat surfaces of the at least three spindle-tops while the moving abrasive surface of the flexible abrasive disk that is attached to the moving abrading platen precision-flat annular abrading-surface is in force-controlled abrading contact with the co-planar flat surfaces of the at least three spindle-tops and where the abrading platen precision-flat annular abrading-surface assumes a co-planar alignment with the precisely co-planar flat surfaces of respective at least three spindle-tops.

14. The process of claim 13 where the spindle-top flat surfaces of the at least three rotary spindles that are mechanically attached to respective at least three rotary spindle two-piece spindle-mount devices' rotatable spindle-mount spherical-action rotors are aligned to be precisely co-planar with the other spindle-tops' flat surfaces by adjusting the spherical angle of the rotatable spindle-mount spherical-action rotors relative to the respective stationary spindle-mount spherical-bases while the rotatable spindle-mount spherical-action rotor is supported by respective stationary spindle-mount spherical-bases after which the rotary spindle two-piece spindle-mount device' locking devices are engaged to lock the respective rotatable spindle-mount spherical-action rotors to the respective stationary spindle-mount spherical-bases to maintain the co-planar alignment of the at least three spindle-tops' flat surfaces.

15. A process of abrading a non-precision-flat annular abrading-surface of a floating, rotatable abrading platen on an at least three-point fixed-spindle floating-platen abrading machine to recondition or reestablish the planar precision-flatness of the abrading platen annular abrading-surface comprising:

a) providing at least three rotary spindles having circular rotatable flat-surfaced spindle-tops that each have a spindle-top axis of rotation at a center of a respective rotatable flat-surfaced spindle-top;

b) aligning the at least three spindle-tops' axes of rotation so that the axes of rotation are perpendicular to the respective spindle-tops' flat surfaces;

c) providing an abrading machine base having a horizontal nominally-flat top surface and a spindle-circle where the spindle-circle is coincident with the machine base nominally-flat top surface;

d) providing rotary spindle two-piece spindle-mount devices consisting of a rotatable spindle-mount spherical-action rotor and a stationary spindle-mount spherical-base where both have a common-radius spherical-joint wherein the rotatable spindle-mount spherical-action rotors are mounted in common-radius spherical-joint surface contact with respective stationary spindle-mount spherical-bases and wherein the rotatable spindle-mount spherical-action rotors are supported by the respective stationary spindle-mount spherical-bases where each rotary spindle two-piece spindle-mount device allows the rotatable spindle-mount spherical-action rotors to be rotated through spherical angles relative to the respective stationary spindle-mount spherical-bases and wherein the at least three rotary spindles are mechanically attached to respective at least three rotary spindle two-piece spindle-mount devices' rotatable spindle-mount spherical-action rotors and wherein rotary spindle two-piece spindle-mount device' locking devices have the capability to lock the respective rotatable spindle-mount spherical-action rotors to the respective stationary spindle-mount spherical-bases;

e) providing that the at least three rotary spindles are located with near-equal spacing between the at least three of the rotary spindles and that the at least three spindle-tops' axes of rotation intersect the machine base spindle-circle and where the respective at least three rotary spindle two-piece spindle-mount devices' spindle-mount spherical-bases are mechanically attached to the machine base nominally-flat top surface at those respective at least three rotary spindles' spindle-circle locations;

f) wherein the at least three spindle-tops' flat surfaces are aligned to be co-planar with each other by spherical rotation of the rotatable spindle-mount spherical-action rotors relative to the respective stationary spindle-mount spherical-bases;

g) engaging the rotary spindle two-piece spindle-mount device' locking devices to lock the respective rotatable spindle-mount spherical-action rotors to the respective stationary spindle-mount spherical-bases to structurally maintain the co-planar alignment of the at least three spindle-tops' flat surfaces;

h) providing a floating, rotatable abrading platen having a non-precision-flat annular abrading-surface that has an annular abrading-surface radial width and an annular abrading-surface inner radius and an annular abrading-surface outer radius and the abrading platen is supported by and is rotationally driven about an abrading platen rotation axis located at a rotational center of the abrading platen by a spherical-action rotation device located at a rotational center of the abrading platen and where the abrading platen spherical-action rotation device restrains the abrading platen in a radial direction relative to the abrading platen axis of rotation and where the abrading platen axis of rotation is concentric with the machine base spindle-circle;

i) wherein the abrading platen spherical-action rotation device allows spherical motion of the abrading platen about the abrading platen rotational center where the non-precision-flat annular abrading-surface of the abrading platen that is supported by the abrading platen spherical-action rotation device is nominally horizontal; and j) attaching abrasive disk components having abrasive surfaces concentric to the circular flat surfaces of at least three spindle-tops wherein the spindle-top abrasive disk components have abrasive disk component outer diameters that are larger than the radial width of the non-precision-flat annular abrading-surface of the abrading platen wherein outer diameter portions of the spindle-top disk-type abrasive components extend radially over both the abrading platen non-precision-flat annular abrading-surface inner annular radius and the abrading platen non-precision-flat annular abrading-surface outer annular radius;

k) moving the abrading platen vertically along the abrading platen rotation axis by the abrading platen spherical-action rotation device to allow the abrading platen non-precision-flat annular abrading-surface to contact the abrasive surfaces of the spindle-top abrasive disk components wherein the at least three rotary spindles having the attached disk-type abrasive components provide at least three-point support of the abrading platen; and l) applying a total abrading platen abrading contact force to the abrasive surface of the abrasive disk components that are attached to the at least three spindle-top flat surfaces by contact of the non-precision-flat annular abrading-surface of the abrading platen with the abrasive surfaces of the abrasive disk components that are attached to the flat surfaces of the respective at least three spindle-tops is controlled through the abrading platen spherical-action rotation device to allow the total abrading platen abrading contact force to be evenly distributed to respective at least three rotary spindles' abrasive disk components;

m) rotating the at least three spindle-tops having the attached abrasive disk components about the respective spindle-tops' rotation axes of rotation and rotating the abrading platen having the non-precision-flat annular abrading-surface about the abrading platen rotation axis to abrade the non-precision-flat annular abrading-surface of the abrading platen with the spindle-top disk-type abrasive components while the moving abrading platen non-precision-flat annular abrading-surface is in force-controlled abrading contact with the abrasive surfaces of the spindle-top abrasive disk components and where the non-precision-flat annular abrading-surface of the abrading platen develops a precision-flat annular abrading-surface due to the at least three spindle-tops abrasive disk components' abrading action on the abrading platen abrading-surface and where the abrading platen precision-flat annular abrading-surface assumes a co-planar alignment with the precisely co-planar flat surfaces of the at least three spindle-tops.

16. The process of claim 15 where the non-precision-flat annular abrading-surface of the abrading platen is abraded to recondition or reestablish planar precision-flatness of the non-precision-flat annular abrading platen annular abrading-surface using abrasive conditioning ring spindle-top abrasive components, the process comprising:

a) attaching abrasive conditioning ring abrasive components concentric to the circular flat surfaces of the at least three spindle-tops where the spindle-top abrasive conditioning rings have an abrasive coated annular flat surface that has an abrasive conditioning ring abrasive coated annular outer diameter that is larger than the radial width of the annular abrading-surface of the abrading platen and wherein outer diameter portions of the abrasive conditioning rings' annular abrasive flat surface extend radially over both the abrading platen non-precision-flat annular abrading-surface inner annular radius and the abrading platen non-precision-flat annular abrading-surface outer annular radius; and b) attaching the abrasive conditioning rings to the at least three spindle-tops where the abrasive conditioning ring annular abrasive flat surfaces have equal-heights above each respective spindle-top;

c) moving the abrading platen vertically along the abrading platen rotation axis by the abrading platen spherical-action rotation device to allow the abrading platen non-precision-flat annular abrading-surface to contact the abrasive flat surfaces of the spindle-top abrasive conditioning rings wherein the at least three rotary spindles having the attached spindle-top abrasive conditioning rings provide at least three-point support of the abrading platen; and d) applying a total abrading platen abrading contact force to the abrasive flat surfaces of the conditioning rings that are attached to the at least three spindle-top flat surfaces by controlling contact of the non-precision-flat annular abrading-surface of the abrading platen with the abrasive flat surfaces of the abrasive conditioning rings through the abrading platen spherical-action rotation device to allow the total abrading platen abrading contact force to be evenly distributed to the respective at least three rotary spindles' abrasive conditioning rings;

e) rotating the at least three spindle-tops having the attached abrasive conditioning rings about the respective at least three spindle-tops axes of rotation and rotating the abrading platen about the abrading platen rotation axis to abrade the non-precision-flat annular abrading-surface of the abrading platen with the abrasive conditioning rings' abrasive flat surfaces while the moving abrading platen non-precision-flat annular abrading-surface is in force-controlled abrading contact with the abrasive conditioning rings' abrasive flat surfaces and where the non-precision-flat annular abrading-surface of the abrading platen develops a precision-flat annular abrading-surface due to the at least three spindle-tops' abrasive conditioning rings abrasive flat surfaces abrading action on the abrading platen abrading-surface and where the abrading platen precision-flat annular abrading-surface assumes a co-planar alignment with the precisely co-planar flat surfaces of the at least three spindle-tops.

17. A process of abrading a non-precision-flat annular abrasive surface of an abrasive disk that is attached to a precision-flat annular abrading-surface of a floating, rotatable abrading platen on an at least three-point fixed-spindle floating-platen abrading machine to recondition or reestablish the planar precision-flatness of the flat annular abrasive surface of the abrasive disk, the process comprising:

a) providing at least three rotary spindles having circular rotatable flat-surfaced spindle-tops that each have a spindle-top axis of rotation at a center of respective rotatable flat-surfaced spindle-tops;

b) providing that the at least three spindle-tops' axes of rotation are perpendicular to the respective spindle-tops' flat surfaces;

c) providing an abrading machine base having a horizontal nominally-flat top surface and a spindle-circle where the spindle-circle is coincident with the machine base nominally-flat top surface;

d) providing rotary spindle two-piece spindle-mount devices consisting of a rotatable spindle-mount spherical-action rotor and a stationary spindle-mount spherical-base where both have a common-radius spherical-joint wherein the rotatable spindle-mount spherical-action rotors are mounted in common-radius spherical-joint surface contact with respective stationary spindle-mount spherical-bases and wherein the rotatable spindle-mount spherical-action rotors are supported by the respective stationary spindle-mount spherical-bases where each rotary spindle two-piece spindle-mount device allows the rotatable spindle-mount spherical-action rotors to be rotated through spherical angles relative to the respective stationary spindle-mount spherical-bases and wherein the at least three rotary spindles are mechanically attached to respective at least three rotary spindle two-piece spindle-mount devices' rotatable spindle-mount spherical-action rotors and wherein rotary spindle two-piece spindle-mount device' locking devices have the capability to lock the respective rotatable spindle-mount spherical-action rotors to the respective stationary spindle-mount spherical-bases;

e) providing the at least three rotary spindles at locations with near-equal spacing between the at least three of the rotary spindles and that the at least three spindle-tops' axes of rotation intersect the machine base spindle-circle and where the respective at least three rotary spindle two-piece spindle-mount devices' spindle-mount spherical-bases are mechanically attached to the machine base nominally-flat top surface at those respective at least three rotary spindles' spindle-circle locations;

f) wherein the at least three spindle-tops' flat surfaces are aligned to be co-planar with each other by spherical rotation of the rotatable spindle-mount spherical-action rotors relative to the respective stationary spindle-mount spherical-bases;

g) engaging the rotary spindle two-piece spindle-mount device' locking devices to lock the respective rotatable spindle-mount spherical-action rotors to the respective stationary spindle-mount spherical-bases to structurally maintain the co-planar alignment of the at least three spindle-tops' flat surfaces;

h) providing a floating, rotatable abrading platen having a precision-flat annular abrading-surface that has an annular abrading-surface radial width and an annular abrading-surface inner radius and an annular abrading-surface outer radius and where the abrading platen is supported by and is rotationally driven about an abrading platen rotation axis located at a rotational center of the abrading platen by a spherical-action rotation device located at the rotational center of the abrading platen and where the abrading platen spherical-action rotation device restrains the rotatable abrading platen in a radial direction relative to the abrading platen axis of rotation and where the abrading platen axis of rotation is concentric with the machine base spindle-circle;

i) wherein the abrading platen spherical-action rotation device allows spherical motion of the abrading platen about the abrading platen rotational center where the precision-flat annular abrading-surface of the abrading platen that is supported by the abrading platen spherical-action rotation device is nominally horizontal; and j) providing flexible abrasive disk articles having non-precision-flat annular abrasive surfaces that have an abrasive surface annular radial width and an abrasive surface annular inner radius and an abrasive surface annular outer radius, and attaching a flexible abrasive disk in flat conformal contact with an abrading platen precision-flat annular abrading-surface such that the attached abrasive disk is concentric with the abrading platen precision-flat annular abrading-surface wherein the abrading platen precision-flat annular abrading-surface radial width is at least equal to the radial width of the attached flexible abrasive disk non-precision-flat annular abrasive surface and wherein the abrading platen precision-flat annular abrading-surface provides conformal support of the full-abrasive-surface of the flexible abrasive disk non-precision-flat annular abrasive surface where the abrading platen precision-flat annular abrading-surface inner radius is less than the inner radius of the attached flexible abrasive disk non-precision-flat annular abrasive surface and where the abrading platen precision-flat annular abrading-surface outer radius is greater than the outer radius of the attached flexible abrasive disk non-precision-flat annular abrasive surface;

k) attaching each flexible abrasive disk in flat conformal contact with the abrading platen precision-flat annular abrading-surface by a disk attachment systems selected from the group consisting of vacuum disk attachment, mechanical disk attachment and adhesive disk attachment;

l) attaching abrasive disk components having abrasive surfaces concentric to the circular flat surfaces of at least three spindle-tops wherein the spindle-top abrasive disk components have abrasive disk component outer diameters that are larger than the radial width of the non-precision-flat annular abrasive surface of the flexible disk that is attached to the abrading platen precision-flat annular abrading-surface wherein outer diameter portions of the spindle-top abrasive disk components extend radially over both the abrasive disk's non-precision-flat annular abrasive surface inner radius and the abrasive disk's non-precision-flat annular abrasive surface outer radius;

m) moving the abrading platen vertically along the abrading platen rotation axis by the abrading platen spherical-action rotation device to allow the flexible abrasive disk non-precision-flat annular abrasive surface to contact the abrasive surfaces of the spindle-top disk-type abrasive components wherein the at least three rotary spindles having the attached spindle-top disk-type abrasive components provide at least three-point support of the abrading platen; and n) applying a total abrading platen abrading contact force to the abrasive surface of the spindle-top disk-type abrasive components by contact of the flexible abrasive disk non-precision-flat annular abrasive surface with the abrasive surfaces of the disk-type abrasive components that are attached to the flat surfaces of the respective at least three spindle-tops that is controlled through the abrading platen spherical-action abrading platen rotation device to allow the total abrading platen abrading contact force to be evenly distributed to the respective at least three rotary spindles' spindle-top disk-type abrasive components;

o) rotating the at least three spindle-tops having the attached disk-type abrasive components about the respective spindle-tops' rotation axes of rotation and rotating the abrading platen having the attached flexible abrasive disk with the non-precision-flat annular abrasive surface about the abrading platen rotation axis to abrade the non-precision-flat annular abrasive surface of the flexible abrasive disk with the spindle-top disk-type abrasive components while the moving non-precision-flat annular abrasive surface of the flexible abrasive disk that is attached to the moving abrading platen is in force-controlled abrading contact with the abrasive surfaces of the spindle-top disk-type abrasive components and where the non-precision-flat annular abrasive surface of the flexible abrasive disk develops a precision-flat annular abrasive surface due to the at least three spindle-tops disk-type abrasive components' abrading action on the flexible abrasive disk annular abrasive surface and where the abrading platen precision-flat annular abrading-surface assumes a co-planar alignment with the precisely co-planar flat surfaces of the at least three spindle-tops.

18. The process of claim 17 where the non-precision-flat abrasive disk annular abrasive surface of an abrasive disk that is attached to a precision-flat annular abrading platen abrading-surface is abraded to recondition or reestablish planar precision-flatness of the annular abrasive surface of the non-precision-flat abrasive disk using abrasive conditioning rings types of abrasive components comprising:

a) attaching abrasive conditioning ring abrasive components concentric to the circular flat surfaces of at least three spindle-tops where the spindle-top abrasive conditioning rings have an abrasive coated annular flat surface that has an abrasive conditioning ring abrasive coated annular outer diameter that is larger than the radial width of the abrasive disk non-precision-flat annular abrasive surface and wherein outer diameter portions of the abrasive conditioning rings' annular abrasive flat surface extend radially over both the abrasive disk non-precision-flat annular abrasive surface inner annular radius and the abrasive disk non-precision-flat annular abrasive surface outer annular radius; and b) attaching the abrasive conditioning rings to the at least three spindle-tops where the abrasive conditioning ring annular abrasive flat surfaces have equal-heights above each respective spindle-top;

c) moving the abrading platen vertically along the abrading platen rotation axis by the abrading platen spherical-action rotation device to allow the flexible abrasive disk non-precision-flat annular abrasive surface to contact the abrasive flat surfaces of the spindle-top abrasive conditioning rings wherein the at least three rotary spindles having the attached spindle-top abrasive conditioning rings provide at least three-point support of the abrading platen; and d) applying a total abrading platen abrading contact force to the abrasive flat surface of the abrasive conditioning rings abrasive components that are attached to the at least three spindle-top flat surfaces by contact of the non-precision-flat annular abrasive surface of the flexible abrasive disk with the abrasive flat surfaces of the abrasive conditioning rings is controlled through the abrading platen spherical-action rotation device to allow the total abrading platen abrading contact force to be evenly distributed to the respective at least three rotary spindles' abrasive conditioning rings;

e) rotating the at least three spindle-tops having the attached abrasive conditioning rings about the respective at least three spindle-tops axes of rotation and rotating the abrading platen about the abrading platen rotation axis to abrade the non-precision-flat annular abrasive surface of the flexible abrasive disk with the abrasive conditioning rings' abrasive flat surfaces while the moving non-precision-flat annular abrasive surface of the abrasive disk that is attached to the moving abrading platen is in force-controlled abrading contact with the abrasive conditioning rings abrasive flat surfaces and where the non-precision-flat abrasive disk annular abrasive surface develops a precision-flat annular abrasive surface due to the at least three spindle-tops' abrasive conditioning rings abrasive flat surfaces abrading action on the flexible abrasive disk annular abrasive surface and where the abrading platen precision-flat annular abrading-surface assumes a co-planar alignment with the precisely co-planar flat surfaces of the at least three spindle-tops.

19. The process of claim 17 where the spindle-top flat surfaces of the at least three rotary spindles that are mechanically attached to respective at least three rotary spindle two-piece spindle-mount devices' rotatable spindle-mount spherical-action rotors are aligned to be precisely co-planar with the other spindle-tops' flat surfaces by adjusting the spherical angle of the rotatable spindle-mount spherical-action rotors relative to the respective stationary spindle-mount spherical-bases while the rotatable spindle-mount spherical-action rotor is supported by respective stationary spindle-mount spherical-bases after which the rotary spindle two-piece spindle-mount device' locking devices are engaged to lock the respective rotatable spindle-mount spherical-action rotors to the respective stationary spindle-mount spherical-bases to maintain the co-planar alignment of the at least three spindle-tops' flat surfaces.

20. The process of claim 17 wherein the abrading platen flexible abrasive disk articles are selected from the group consisting of: flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization resilient disk pads that are suitable for use with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, and flexible flat-surfaced metal or polymer disks.

* * * * *